US009495923B2

(12) United States Patent
Shiomi

(10) Patent No.: US 9,495,923 B2
(45) Date of Patent: Nov. 15, 2016

(54) LIQUID CRYSTAL DISPLAY DEVICE, METHOD OF DRIVING LIQUID CRYSTAL DISPLAY DEVICE, AND TELEVISION RECEIVER

(75) Inventor: Makoto Shiomi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 395 days.

(21) Appl. No.: 14/117,671

(22) PCT Filed: May 15, 2012

(86) PCT No.: PCT/JP2012/062434

§ 371 (c)(1),
(2), (4) Date: Nov. 14, 2013

(87) PCT Pub. No.: WO2012/157651

PCT Pub. Date: Nov. 22, 2012

(65) Prior Publication Data

US 2014/0085279 A1 Mar. 27, 2014

(30) Foreign Application Priority Data

May 18, 2011 (JP) ..... 2011-111903

(51) Int. Cl.

| | |
|---|---|
| ***G09G 3/36*** | (2006.01) |
| ***G09G 3/20*** | (2006.01) |
| *G09G 3/34* | (2006.01) |

(52) U.S. Cl.

CPC ..... *G09G 3/3611* (2013.01); *G09G 3/2074* (2013.01); *G09G 3/3655* (2013.01); *G09G 3/3666* (2013.01); *G09G 3/3426* (2013.01); *G09G 3/3614* (2013.01); *G09G 2300/0876* (2013.01); *G09G 2320/0219* (2013.01); *G09G 2320/0233* (2013.01); *G09G 2320/0285* (2013.01); *G09G 2320/0646* (2013.01); *G09G 2330/021* (2013.01); *G09G 2370/08* (2013.01)

(58) Field of Classification Search

None

See application file for complete search history.

(56) References Cited

U.S. PATENT DOCUMENTS

| | | | | |
|---|---|---|---|---|
| 2002/0075219 | A1* | 6/2002 | Morita | G09G 3/3648 345/92 |
| 2010/0253668 | A1 | 10/2010 | Sugihara et al. | |
| 2010/0265410 | A1* | 10/2010 | Sugihara | G09G 3/3614 348/731 |

FOREIGN PATENT DOCUMENTS

| | | | |
|---|---|---|---|
| JP | 2002-091364 | A | 3/2002 |
| JP | 2008-070406 | A | 3/2008 |
| WO | WO-2009/084331 | A1 | 7/2009 |

OTHER PUBLICATIONS

International Search Report PCT/ISA/210 for PCT/JP2012/062434 dated Jun. 12, 2012.

Written Opinion PCT/ISA/237 for PCT/JP2012/062434 dated Jun. 12, 2012.

* cited by examiner

*Primary Examiner* — Amare Mengistu

*Assistant Examiner* — Sarvesh J Nadkarni

(74) *Attorney, Agent, or Firm* — Harness, Dickey & Pierce, P.L.C.

(57) ABSTRACT

Data signal lines, scanning signal lines, and pixels are formed in each of first and second regions of a liquid crystal panel, and the first half of a current frame and the second half of the current frame are written to the first and second regions, respectively. A data signal with polarity inverted for each vertical scanning period is supplied to each data signal line. A scanning direction of the first region is identical to a scanning direction of the second region and the first and second regions are arranged to line up in this order in the scanning direction. In the first and second regions, the potential of the data signal is corrected according to a distance from a scanning start end portion.

12 Claims, 27 Drawing Sheets

-- PRIOR ART --

-- PRIOR ART --

LIQUID CRYSTAL DISPLAY DEVICE, METHOD OF DRIVING LIQUID CRYSTAL DISPLAY DEVICE, AND TELEVISION RECEIVER

TECHNICAL FIELD

The present invention relates to a liquid crystal display device in which a screen division driving scheme and a V inversion driving scheme are combined and a method of driving the liquid crystal display device.

BACKGROUND ART

With increases in the quality of broadcast images and performance of PCs, liquid crystal display devices used therein have advanced without interruption for high resolutions such as VGA (SD), XGA, WXGA, FHD, 2K4K, and 4K8K or high refresh rates such as 24 Hz, 30 Hz, 60 Hz interlaced, 60 Hz progressive, 120 Hz (double speed), and 240 Hz.

As technologies corresponding to shortening of a write time to each pixel with high definition of the liquid crystal display devices, a V inversion driving scheme and a screen division driving scheme have been suggested in the related art.

The V inversion driving scheme refers to a driving method (a 1 V inversion driving scheme or an nV inversion driving scheme) of supplying data signal lines with data signals with polarity inverted for each vertical scanning period or every plurality of vertical scanning periods.

The screen division driving scheme refers to a driving method of dividing a display unit into a plurality of regions and driving the respective regions separately (for example, PTL 1). In the screen division driving scheme, for example, when one screen is divided into upper and lower regions (the upper region is referred to as a first region and the lower region is referred to as a second region), the first half of a frame is displayed in the first region and the second half of the frame is displayed in the second region.

In recent liquid crystal display devices, high definition and an increase in a driving speed have been realized by using such technologies.

CITATION LIST

Patent Literature

PTL 1: Japanese Unexamined Patent Application Publication No. 2008-70406 (filed on Mar. 27, 2008)

SUMMARY OF INVENTION

Technical Problem

Here, the inventors and others of the present application have found that when the V inversion driving scheme and the screen division driving scheme according to the related art are combined, a change in luminance is considerable in a boundary portion between the first and second regions and thus display quality considerably deteriorates. Hereinafter, a principle of occurrence of the change in luminance in the boundary portion between the first and second regions will be described.

FIG. 25 is an equivalent circuit diagram of an active matrix substrate used in a liquid crystal panel according to the related art. FIG. 26 is a timing chart illustrating an ideal driving method (normally black mode) for a liquid crystal display device when a white solid image is displayed. FIG. 28(*a*) illustrates a display image displayed according to this driving method. FIG. 27 is a timing chart illustrating a driving method (normally black mode) for a liquid crystal display device according to the related art when a white solid image is displayed. FIG. 28(*b*) illustrates a display image displayed according to this driving method.

In FIGS. 26 and 27, S indicates a data signal supplied to a data signal line SL(a) (FIG. 25). GSP indicates a gate start pulse. G(1), G(2), G(3), . . . , G(k), . . . , G(n−1), and G(n) indicate gate signals (scanning signals) supplied to scanning signal lines GL(1), GL(2), GL(3), . . . , GL(k), . . . , GL(n−1), and GL(n) (FIG. 25), respectively. VP(1), VP(2), VP(3), . . . , VP(k), . . . , VP(n−1), and VP(n) indicate potentials (pixel potentials) of pixel electrodes PD(a1), PD(a2), PD(a3), . . . , PD(ak), . . . , PD(an−1), and PD(an) (FIG. 25). Here, the description will be made mainly focusing on an arbitrary a-th column.

In the driving method, as illustrated in FIGS. 26 and 27, the data signal S with polarity inverted for each vertical scanning period (1 V) is supplied to data signal lines SL, while the data signals S with the polarities opposite to each other are supplied to two adjacent data signal lines (for example, data signal lines SL(a) and SL(b)) for the same horizontal scanning period (H) (1 V inversion driving). Here, since a display image is assumed to be a white solid image, the potential (absolute value) of the data signal S is assumed to be constant. Hereinafter, the description will be made assuming that the pixel potential VP is an effective potential (the absolute value with reference to Vcom).

Specifically, in a frame F1 among arbitrary consecutive frames F1 to F4, the data signal S with the positive polarity is supplied to the data signal line SL(a) for the first horizontal scanning period (including the scanning period of the scanning signal line GL(1)), the data signal S with the positive polarity is also supplied to the data signal line SL(a) for the second horizontal scanning period (including the scanning period of the scanning signal line GL(2)), the data signal S with the positive polarity is also supplied to the data signal line SL(a) for a k-th (which is an integer of "1≤k≤n") horizontal scanning period (including the scanning period of the scanning signal line GL(k)), and the data signal S with the positive polarity is also supplied to the data signal line SL(a) for an n-th horizontal scanning period (including the scanning period of the scanning signal line GL(n)). Further, the data signal S with the negative polarity is supplied to the data signal line SL(b) for the first horizontal scanning period (including the scanning period of the scanning signal line GL(1)), the data signal S with the negative polarity is also supplied to the data signal line SL(b) for the second horizontal scanning period (including the scanning period of the scanning signal line GL(2)), the data signal S with the negative polarity is also supplied to the data signal line SL(b) for a k-th horizontal scanning period (including the scanning period of the scanning signal line GL(k)), and the data signal S with the negative polarity is also supplied to the data signal line SL(b) for an n-th horizontal scanning period (including the scanning period of the scanning signal line GL(n)).

In the frame F2, the polarity of the data signal S supplied to the data signal line SL(a) and the data signal line SL(b) is assumed to be opposite to that of the frame F1. In the frame F3, the same operation as that of the frame F1 is performed. In the frame F4, the same operation as that of the frame F2 is performed. Thereafter, the same operations are repeated.

Herein, when a white solid image is displayed, the data signals S with the positive polarity and the same size (the absolute value of a voltage) are supplied to the pixel electrodes PD(a1), PD(a2), PD(ak), PD(an−1), and PD(an) in the frames F1 and F3 and the data signals S with the negative polarity and the same size (the absolute value of a voltage) are supplied to the pixel electrodes PD(a1), PD(a2), PD(ak), PD(an−1), and PD(an) in the frames F2 and F4. Accordingly, ideally, the white solid image is displayed, as illustrated in FIG. 28(*a*).

In the liquid crystal display device according to the related art, however, a problem may arise in that the pixel potential VP is changed (lowered) from a potential Vsl (white) of the written data signal S and luminance may not be uniform due to a parasitic capacitance (Csd) occurring between a data signal line and a pixel electrode. Hereinafter, specific description will be made with reference to FIG. 27.

In the pixel electrode PD(a1), the potential VP(1) is held at the potential Vsl of the written data signal S (data signal with the positive polarity corresponding to white) for one vertical scanning period (1 V) from the supply of the data signal S with the positive polarity for the first horizontal scanning period (including the scanning period of the scanning signal line GL(1)) of the frame F1 to the supply of the data signal S with the negative polarity for the first horizontal scanning period (including the scanning period of the scanning signal line GL(1)) of the frame F2 (the absolute value of the pixel potential VP(1) with reference to Vcom=the absolute value of the data signal potential Vsl with reference to Vcom). This is because a write start timing (rising of the gate signal G(1)) of the data signal S during the first horizontal scanning period of the frame F2 is identical to a timing at which the data signal S is switched from the positive polarity to the negative polarity, and thus the pixel potential VP(1) is not affected by the polarity inversion of the data signal S. Even at the time of transition from the frame F2 to the frame F3, the pixel potential VP(1) is likewise held at the data signal potential Vsl without the effect of the polarity inversion, since the data signal S is switched from the negative polarity to the positive polarity at the write start timing (rising of the gate signal G(1)) of the data signal S for the first horizontal scanning period of the frame F3.

On the other hand, in the pixel electrode PD(a2), the polarity of the data signal S is switched from the positive polarity to the negative polarity from the supply of the data signal S with the positive polarity for the second horizontal scanning period (including the scanning period of the scanning signal line GL(2)) of the frame F1 to the supply of the data signal S with the negative polarity for the second horizontal scanning period (including the scanning period of the scanning signal line GL(2)) of the frame F2. That is, the polarity of the data signal S is switched from the positive polarity to the negative polarity at a timing 1 H (rising of the gate signal G(1)) earlier than the gate signal G(2) rises in the frame F2. Therefore, the potential VP(2) of the pixel electrode PD(a2) in a floating state deteriorates (is pushed down) due to the parasitic capacitance Csd by ΔVp from the potential Vsl of the data signal S (the data signal S with the positive polarity corresponding to white) written in the frame F1 at the switching timing of the polarity of the data signal S from the positive polarity to the negative polarity (the absolute value of the pixel potential VP(2) (=Vsl−ΔVp) with reference to Vcom<the absolute value of the data signal potential Vsl with reference to Vcom). Likewise, even at the time of transition from the frame F2 to the frame F3, since the polarity of the data signal S is changed from the negative polarity to the positive polarity at a timing 1 H (rising of the gate signal G(1)) earlier than the write start timing (rising of the gate signal G(2)) of the data signal S for the second horizontal scanning period of the frame F3 with regard to the pixel potential VP(2), the pixel potential VP(2) of the pixel electrode PD(a2) deteriorates (is pushed up) by ΔVp from the potential Vsl of the data signal S (the data signal S with the negative polarity corresponding to white) written in the frame F2 due to the effect of the polarity inversion of the data signal S (the absolute value of the pixel potential VP(2) (=Vsl−ΔVp) with reference to Vcom<the absolute value of the data signal potential Vsl with reference to Vcom).

Since the deterioration period of the potential of the pixel electrode PD(a2) is about 1 H, the display quality is not affected, but the deterioration period of the potential becomes longer on an end side in a scanning direction.

For example, in the pixel electrode PD(an) which is the termination portion in the scanning direction, the polarity of the data signal S is switched from the positive polarity to the negative polarity from the supply of the data signal S with the positive polarity for an n-th horizontal scanning period (including the scanning period of the scanning signal line GL(n)) of the frame F1 to the supply of the data signal S with the negative polarity for an n-th horizontal scanning period (including the scanning period of the scanning signal line GL(n)) of the frame F2. That is, immediately after the gate signal G(n) in the frame F1 rises and the data signal potential Vsl is written to the pixel electrode PD(an), the polarity of the data signal S is switched from the positive polarity to the negative polarity. Therefore, the potential Vn of the pixel electrode PD(an) deteriorates (is pushed down) due to the parasitic capacitance Csd by ΔVp from the potential Vsl of the data signal S (the data signal S with the positive polarity corresponding to white) written in the frame F1 at the switching timing of the polarity of the data signal S from the positive polarity to the negative polarity (the absolute value of the pixel potential VP(n) (=Vsl−ΔVp) with reference to Vcom<the absolute value of the data signal potential Vsl with reference to Vcom). Likewise, even at the time of transition from the frame F2 to the frame F3, since the polarity of the data signal S is switched from the negative polarity to the positive polarity immediately after the gate signal G(n) rises in the frame F2 and the data signal potential Vsl is written to the pixel electrode PD(an) with regard to the pixel potential VP(n), the pixel potential VP(n) of the pixel electrode PD(an) deteriorates (is pushed up) by ΔVp from the potential Vsl of the data signal S (the data signal S with the negative polarity corresponding to white) written in the frame F2 due to the effect of the polarity inversion of the data signal S (the absolute value of the pixel potential VP(n) (=Vsl−ΔVp) with reference to Vcom<the absolute value of the data signal potential Vsl with reference to Vcom).

Thus, in the pixel electrode PD(an), since the deterioration period of the potential is an (n−1) horizontal scanning period, the luminance considerably deteriorates compared to the pixel electrode PD(a1) located at the scanning start end portion.

That is, with regard to a potential VP(k) of a pixel electrode PD(ak), a period of "VP(k)=Vsl−ΔVp" becomes longer from the scanning start end portion (k=1) to the scanning termination end portion (k=n). Accordingly, as illustrated in FIG. 28(*b*), an actually displayed image is an image (so-called gradation image) of which luminance deteriorates from the scanning start end portion to the scanning termination end portion.

When the V inversion driving scheme is applied to a normal driving scheme rather than the screen division driving scheme, the change in luminance is continuous in the scanning direction. Therefore, the display quality is not considerably affected at a visual level. However, when the V inversion driving scheme is applied to the screen division driving scheme, luminance is considerably changed in a boundary portion between the first and second regions, as illustrated in FIG. 29, due to the fact that the scanning termination end portion of the first region in which the largest deterioration in the luminance occurs and the scanning start end portion of the second region in which an image is displayed with the original luminance are adjacent to each other. Accordingly, the display quality considerably deteriorates.

The present invention is devised in view of the foregoing problems and an object of the present invention is to provide a configuration in which a change in luminance rarely occurs in a boundary portion between divided regions in a liquid crystal display device in which a screen division scheme and a V inversion driving scheme are combined.

Solution to Problem

To resolve the foregoing problems, the present invention provides a liquid crystal display device in which data signal lines, scanning signal lines, and pixels are formed in each of first and second regions installed in a display unit and in which a part of a current frame is written to the first region and the remainder of the current frame is written to the second region. A data signal with polarity inverted for each vertical scanning period or every plurality of vertical scanning periods is supplied to each data signal line. A scanning direction in the first region is identical to a scanning direction in the second region and the first and second regions are arranged to line up in this order in the scanning direction. At least in the first region, a potential of the data signal supplied to each data signal line is corrected according to a distance from a scanning start end portion.

With such a configuration, for example, when the potential of the data signal supplied to each data signal line is corrected in the first region, as described above, the luminance of the first region can be uniformed. Therefore the change in the luminance occurring in the boundary portion between the first and second regions can be suppressed. When the potential of the data signal supplied to each data signal line is corrected in the first and second regions, as described above, the luminance of the first and second regions can be uniformed. Therefore, since the change in the luminance in the entire display image can be suppressed, the display quality can be improved.

To resolve the foregoing problems, the present invention provides a method of driving a liquid crystal display device in which data signal lines, scanning signal lines, and pixels are formed in each of first and second regions installed in a display unit and in which a part of a current frame is written to the first region through scanning in the first region of the current frame and the remainder of the current frame is written to the second region through scanning in the second region of the current frame. The method includes: supplying a data signal with polarity inverted for each vertical scanning period or every plurality of vertical scanning periods to each data signal line, allowing a scanning direction in the first region to be identical to a scanning direction in the second region and arranging the first and second regions to line up in this order in the scanning direction, and correcting a potential of the data signal supplied to each data signal line at least in the first region according to a distance from a scanning start end portion.

Advantageous Effects of Invention

As described above, the liquid crystal display device and the method of driving the liquid crystal display device according to the invention have the configuration and the method in which the potential of the data signal supplied to each data signal line is corrected according to a distance from the scanning start end portion at least in the first region. Accordingly, in the liquid crystal display device in which the screen division scheme and the V inversion driving scheme are combined, a change in the luminance rarely occurs in the boundary portion between the divided regions.

DESCRIPTION OF EMBODIMENTS

Figure 1:
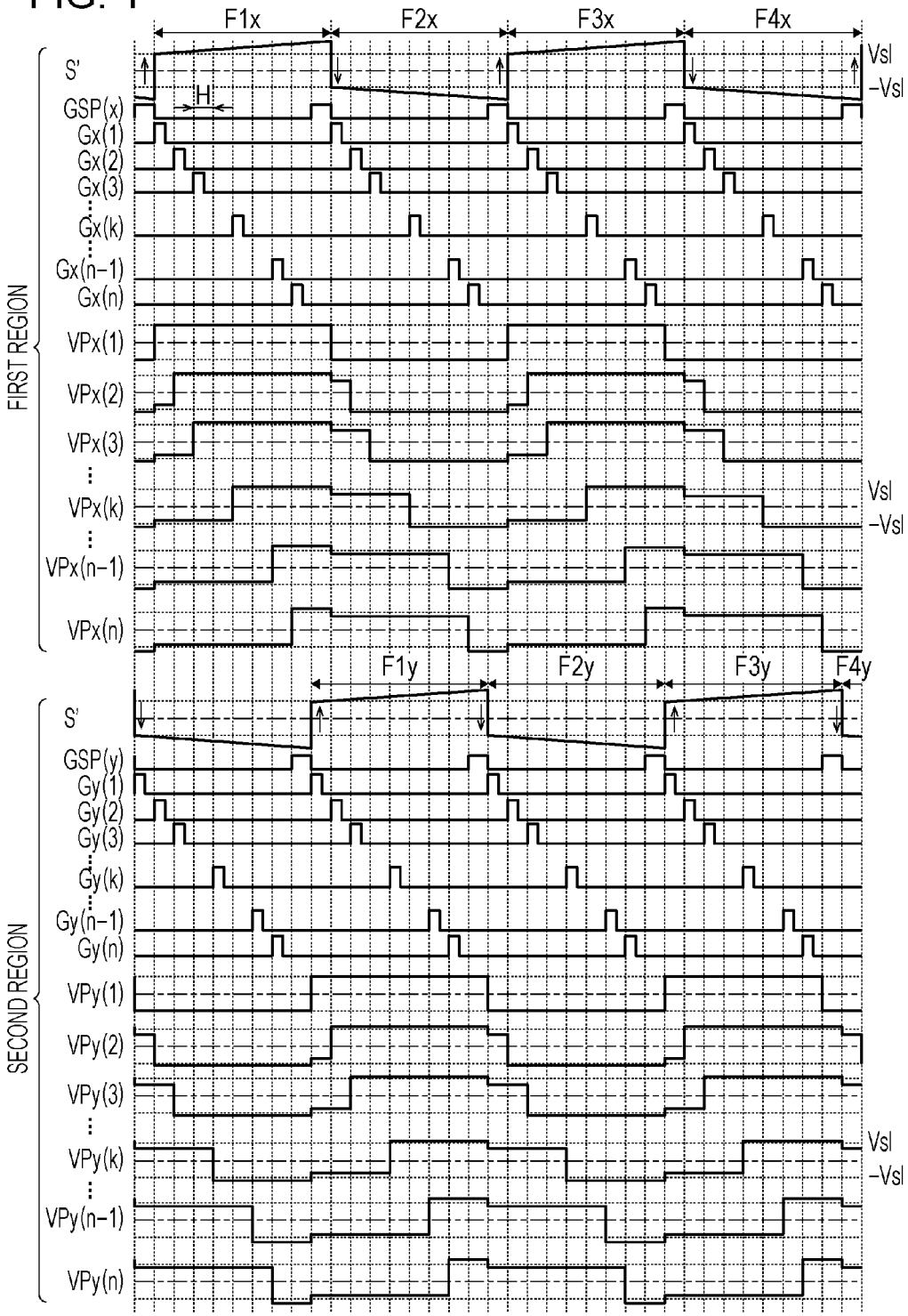
FIG. 1 is a timing chart illustrating a method of driving a liquid crystal display device according to a first embodiment.

Embodiments of the present invention will be described below with reference to FIGS. 1 to 24. To facilitate the description thereof, an extension direction of a scanning signal line is assumed to be a row direction below. However, when a liquid crystal display device including a liquid crystal panel (or an active matrix substrate used therein) herein is used (viewed), the scanning signal lines may, of course, extend in the horizontal direction or may extend in the vertical direction. Further, in the drawings illustrating the liquid crystal panel, an alignment regulation structure is appropriately omitted.

First Embodiment

Configuration of Liquid Crystal Display Device

Figure 2:
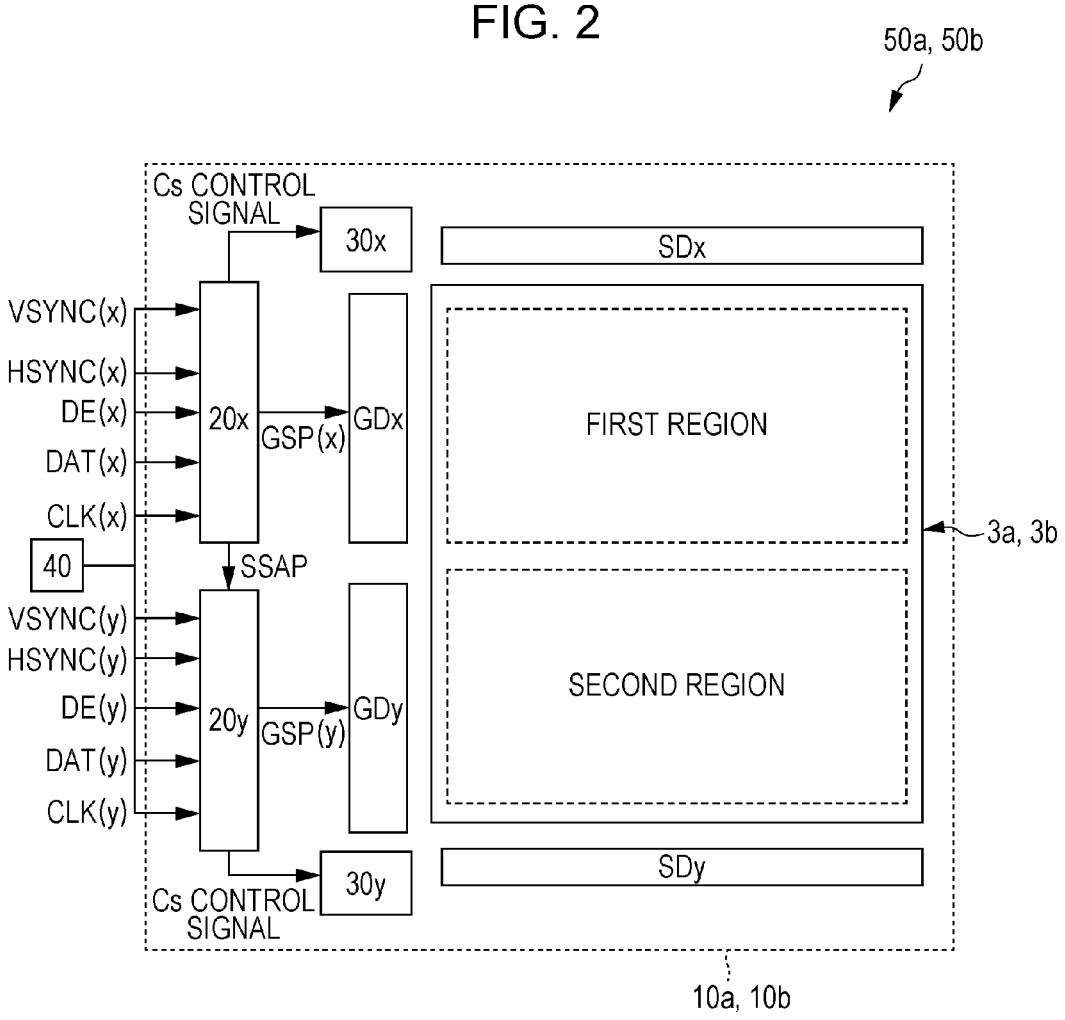
FIG. 2 is a block diagram illustrating a schematic configuration of a television receiver according to the first embodiment.

FIG. 2 is a block diagram illustrating a schematic configuration of a television receiver herein. As illustrated in the drawing, a television receiver 50*a* includes a tuner 40 and a liquid crystal display device 10*a*. The liquid crystal display device 10*a* includes a liquid crystal panel 3*a* divided into first and second regions, a first display control circuit 20*x*, a first source driver SDx, a first gate driver GDx, a first Cs control circuit 30*x*, a second display control circuit 20*y*, a second source driver SDy, a second gate driver GDy, and a second Cs control circuit 30*y*. The first display control circuit 20*x*, the first source driver SDx, the first gate driver GDx, and the first Cs control circuit 30*x* are used to drive the first region and the second display control circuit 20*y*, the second source driver SDy, the second gate driver GDy, and the second Cs control circuit 30*y* are used to drive the second region.

A vertical synchronization signal VSYNC(x), a horizontal synchronization signal HSYNC(x), a data enable signal DE(x), video data DAT(x), and a clock signal CLK(x) are input from the tuner 40 to the first display control circuit 20*x*. A vertical synchronization signal VSYNC(y), a horizontal synchronization signal HSYNC(y), a data enable signal DE(y), video data DAT(y), and a clock signal CLK(y) are input from the tuner 40 to the second display control circuit 20*y*. The first display control circuit 20*x* outputs a gate start pulse GSP(x) for the first region to the first gate driver GDx and outputs a Cs control signal for the first region to the first Cs control circuit 30*x*. Further, the second display control circuit 20*y* outputs a gate start pulse GSP(y) for the second region to the second gate driver GDy and outputs a Cs control signal for the second region to the second Cs control circuit 30*y*. The first Cs control circuit 30*x* supplies a Cs signal (holding capacitance wiring signal) to each holding capacitance wiring of the first region and the second Cs control circuit 30*y* supplies a Cs signal to each holding capacitance wiring of the second region.

(Configuration of Liquid Crystal Panel)

The liquid crystal panel 3*a* according to the first embodiment has a so-called upper and lower division single source configuration (a configuration in which two data signal lines are installed in upper and lower portions per pixel column and two upper and lower scanning signal lines are simultaneously selected) in which one data signal line is installed in correspondence with the upper half (the upstream side of the panel; the first region) of one pixel column and one data signal line is installed in correspondence with the lower half (the downstream side of the panel; the second region) of the pixel column, and thus double speed driving can be achieved compared to a normal panel configuration. Hereinafter, a specific description will be made.

Figure 3:
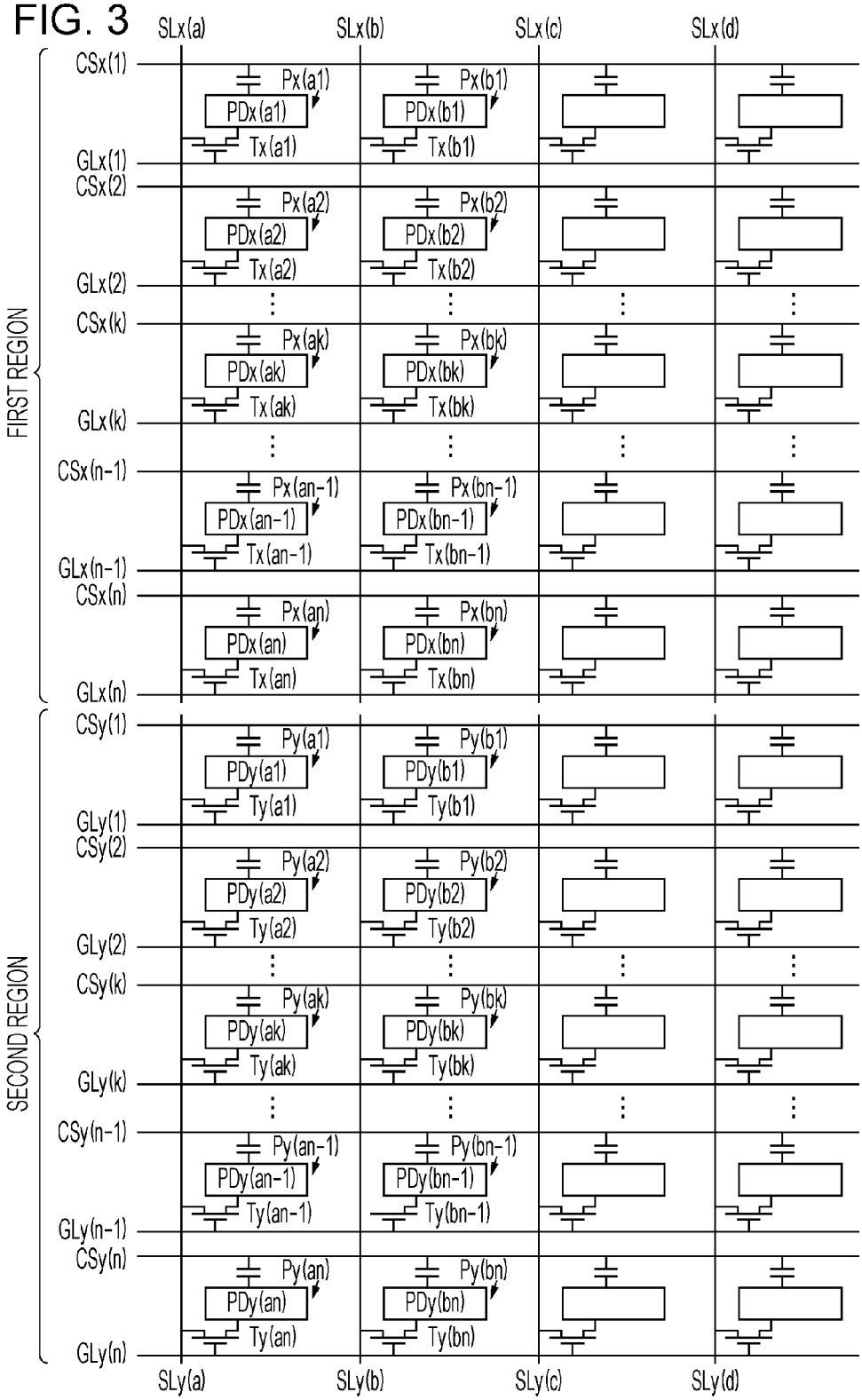
FIG. 3 is an equivalent circuit diagram illustrating a part of a liquid crystal panel according to the first embodiment.

FIG. 3 is an equivalent circuit diagram illustrating a part of the liquid crystal panel 3*a* according to the first embodiment. In the first region of the liquid crystal panel 3*a*, as illustrated in FIG. 3, data signal lines SLx(a), SLx(b), SLx(c), and SLx(d) are arranged to line up in this order, scanning signal lines GLx(1), GLx(2), . . . , GLx(k), . . . , GLx(n−1), and GLx(n) extending in the row direction (the right and left directions in the drawing) are arranged to line up in this order, and holding capacitance wirings CSx(1), CSx(2), . . . , CSx(k), . . . , CSx(n−1), and CSx(n) are arranged to line up in this order in correspondence with the scanning signal lines, respectively. Here, k is an integer equal to or greater than 1 and equal to or less than n ($1 \leq k < n$) and n is, for example, 540 (lines).

In the first region, a pixel Px(a1) is installed in correspondence with the intersection of the data signal line SLx(a) and the scanning signal line GLx(1), a pixel Px(a2) is installed in correspondence with the intersection of the data signal line SLx(a) and the scanning signal line GLx(2), a pixel Px(ak) is installed in correspondence with the intersection of the data signal line SLx(a) and the scanning signal line GLx(k), a pixel Px(an−1) is installed in correspondence with the intersection of the data signal line SLx(a) and the scanning signal line GLx(n−1), and a pixel Px(an) is installed in correspondence with an intersection of the data signal line SLx(a) and the scanning signal line GLx(n). Likewise, a pixel Px(bk) is installed in correspondence with the intersection of the data signal line SLx(b) and the scanning signal line GLx(k).

One pixel electrode PDx is disposed for each pixel Px. A pixel electrode PDx(a1) of the pixel Px(a1) is connected to the data signal line SLx(a) via a transistor (TFT) Tx(a1) connected to the scanning signal line GLx(1). A pixel electrode PDx(a2) of the pixel Px(a2) is connected to the data signal line SLx(a) via a transistor Tx(a2) connected to the scanning signal line GLx(2). A pixel electrode PDx(ak) of the pixel Px(ak) is connected to the data signal line SLx(a) via a transistor Tx(ak) connected to the scanning signal line GLx(k). A pixel electrode PDx(an−1) of the pixel Px(an−1) is connected to the data signal line SLx(a) via a transistor Tx(an−1) connected to the scanning signal line GLx(n−1). A pixel electrode PDx(an) of the pixel Px(an) is connected to the data signal line SLx(a) via a transistor Tx(an) connected to the scanning signal line GLx(n). Likewise, a pixel electrode PDx(bk) of the pixel Px(bk) is connected to the data signal line SLx(b) via a transistor Tx(bk) connected to the scanning signal line GLx(k).

On the other hand, in the second region, as illustrated in FIG. 3, data signal lines SLy(a), SLy(b), SLy(c), and SLy(d) are arranged to line up in this order, scanning signal lines GLy(1), GLy(2), . . . , GLy(k), . . . , GLy(n−1), and GLy(n) extending in the row direction (the right and left directions in the drawing) are arranged to line up in this order, and holding capacitance wirings CSy(1), CSy(2), . . . , CSy(k), . . . , CSy(n−1), and CSy(n) are arranged to line up in this order in correspondence with the scanning signal lines GLy, respectively. Here, k is an integer equal to or greater than 1 and equal to or less than n ($1 \le k \le n$) and n is, for example, 540 (lines).

In the second region, a pixel Py(a1) is installed in correspondence with the intersection of the data signal line SLy(a) and the scanning signal line GLy(1), a pixel Py(a2) is installed in correspondence with the intersection of the data signal line SLy(a) and the scanning signal line GLy(2), a pixel Py(ak) is installed in correspondence with the intersection of the data signal line SLy(a) and the scanning signal line GLy(k), a pixel Py(an−1) is installed in correspondence with the intersection of the data signal line SLy(a) and the scanning signal line GLy(n−1), and a pixel Py(an) is installed in correspondence with an intersection of the data signal line SLy(a) and the scanning signal line GLy(n). Likewise, a pixel Py(bk) is installed in correspondence with the intersection of the data signal line SLy(b) and the scanning signal line GLy(k).

One pixel electrode PDy is disposed for each pixel Py. A pixel electrode PDy(a1) of the pixel Py(a1) is connected to the data signal line SLy(a) via a transistor Ty(a1) connected to the scanning signal line GLy(1). A pixel electrode PDy (a2) of the pixel Py(a2) is connected to the data signal line SLy(a) via a transistor Ty(a2) connected to the scanning signal line GLy(2). A pixel electrode PDy(ak) of the pixel Py(ak) is connected to the data signal line SLy(a) via a transistor Ty(ak) connected to the scanning signal line GLy(k). A pixel electrode PDy(an−1) of the pixel Py(an−1) is connected to the data signal line SLy(a) via a transistor Ty(an−1) connected to the scanning signal line GLy(n−1). A pixel electrode PDy(an) of the pixel Py(an) is connected to the data signal line SLy(a) via a transistor Ty(an) connected to the scanning signal line GLy(n). Likewise, a pixel electrode PDy(bk) of the pixel Py(bk) is connected to the data signal line SLy(b) via a transistor Ty(bk) connected to the scanning signal line GLy(k).

The respective scanning signal lines GLx and GLy are selected one by one sequentially, the scanning direction in the first region is identical to the scanning direction in the second region, and the first and second regions are arranged to line up in this order in the scanning direction. In FIG. 3, the scanning is assumed to be performed from the upper side (upstream side) to the lower side (downstream side) of the sheet surface. That is, the scanning signal lines GLx(1), GLx(2), . . . , GLx(k), . . . , GLx(n−1), GLx(n), GLy(1), GLy(2), . . . , GLy(k), . . . , GLy(n−1), and GLy(n) are selected in this order.

(Screen Division Scheme)

Figure 4:
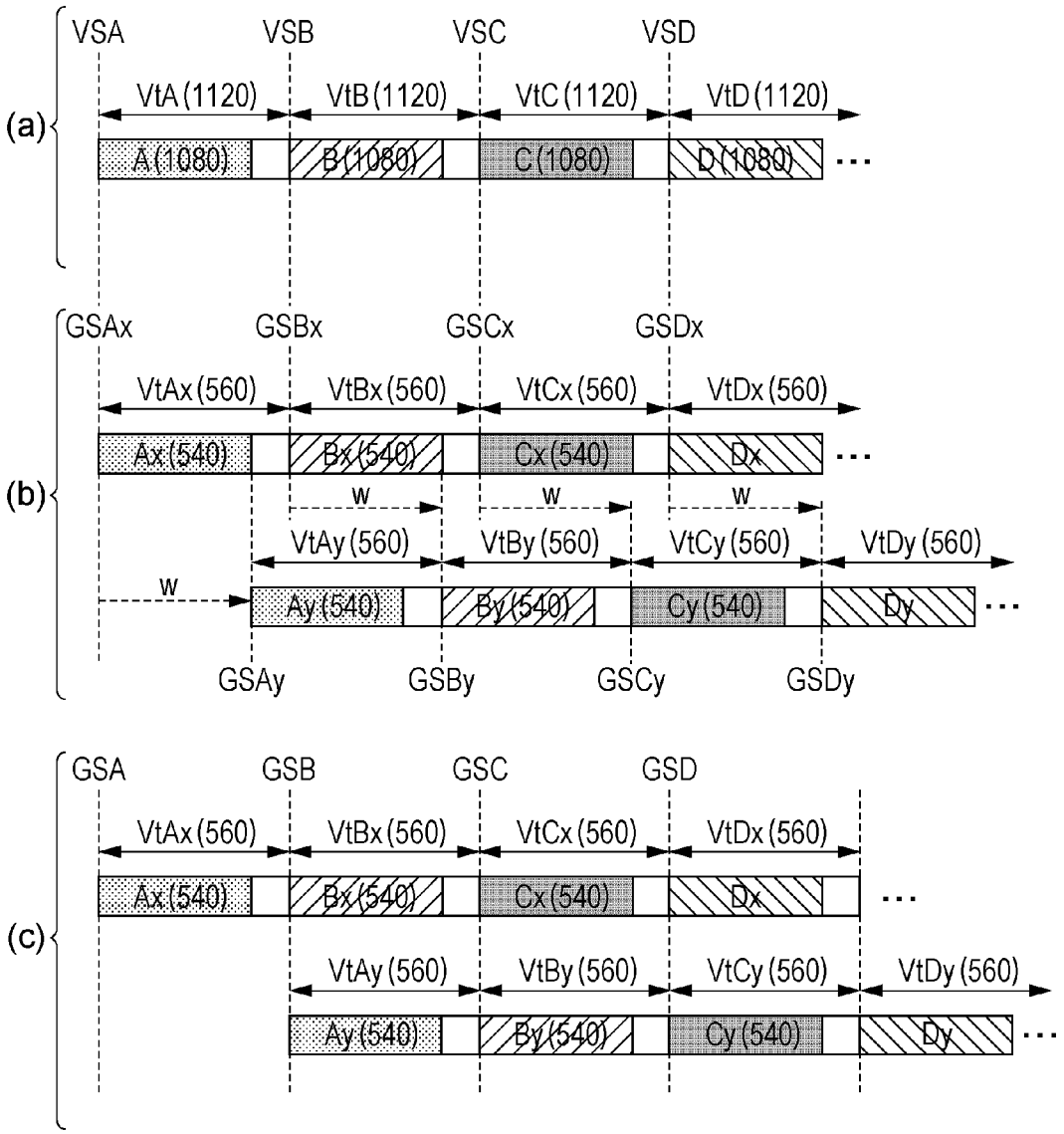
FIG. 4(*a*) is a diagram illustrating input timings of frames A to D in the liquid crystal display device according to the first embodiment, FIG. 4(*b*) is a diagram illustrating a timing of a write operation in the liquid crystal display device, and FIG. 4(*c*) is a diagram illustrating a timing of another write operation in the liquid crystal display device.

Here, an example of a write operation in the liquid crystal display device 10*a* will be described. FIG. 4(*a*) illustrates input timings of frame A to D. In the drawing, vertical synchronization signals of frames A to D are indicated by VSA to VSD, and the periods (VtA to VtD) of the frames A to D are assumed to be the same, 1120 lines (a blanking period is 40 lines among the lines). FIG. 4(*b*) illustrates timings of a write operation in the liquid crystal display device 10*a*.

As illustrated in FIG. 4(*b*), after the first half Ax of the first frame A is written to the first region, the second half Ay of the first frame A is written to the second region. Here, after the first half Bx of the second frame B is written to the first region so as to temporally overlap the write period of the second half Ay of the frame A, the second half By of the second frame B is written to the second region. Then, after the first half Cx of the third frame C is written to the first region so as to temporally overlap the write period of the second half By of the frame B, the second half Cy of the third frame C is written to the second region.

In FIG. 4(*b*), a gate start pulse of the first-half frame Ax is indicated by GSAx, a gate start pulse of the first-half frame Bx is indicated GSBx, a gate start pulse of the first-half frame Cx is indicated by GSCx, and a gate start pulse of the first-half frame Dx is indicated by GSDx. The gate start pulse GSAx of the first-half frame Ax is synchronized with the vertical synchronization signal VSA of the frame A, the gate start pulse GSBx of the first-half frame Bx is synchronized with the vertical synchronization signal VSB of the frame B, the gate start pulse GSCx of the first-half frame Cx is synchronized with the vertical synchronization signal VSC of the frame C, and the gate start pulse GSDx of the first-half frame Dx is synchronized with the vertical synchronization signal VSD of the frame D. Further, the periods (VtAx to VtDx) of the first-half frames Ax to Dx are assumed to be the same and be 560 lines (a blanking period is 20 lines among the lines).

In FIG. 4(*b*), a gate start pulse of the second-half frame Ay is indicated by GSAy, a gate start pulse of the second-half frame By is indicated GSBy, a gate start pulse of the second-half frame Cy is indicated by GSCy, and a gate start pulse of the second-half frame Dy is indicated by GSDy. The gate start pulse GSAy of the second-half frame Ay is activated after W (period of 540 lines) passes from the gate start pulse GSAx of the first-half frame Ax. The gate start pulse GSBy of the second-half frame By is activated after a period W passes from the gate start pulse GSBx of the first-half frame Bx. The gate start pulse GSCy of the second-half frame Cy is activated after the period W passes from the gate start pulse GSCx of the first-half frame Cx.

The gate start pulse GSDy of the second-half frame Dy is activated after the period W passes from the gate start pulse GSDx of the first-half frame Dx. Further, the periods (VtAy to VtDy) of the second-half frames Ay to Dy are assumed to be the same and be 560 lines (a blanking period is 20 lines among the lines).

As illustrated in FIGS. 4(*a*) and 4(*b*), in the liquid crystal display device 10*a* of the screen division (upper and lower division) driving scheme, for example, 540 lines may be output (scanned) for an input period of 1080 lines and 1 H (one horizontal scanning period) of the output side may be two times 1 H (one horizontal scanning period) of the input side. Therefore, a charging rate of each pixel can be increased. Further, it is possible to realize shortening of a write time to each pixel which results in high definition of the liquid crystal display device.

A divided portion (a boundary between the first and second regions) is not limited to the center of the liquid crystal panel in the upper and lower directions, but the areas of the first and second regions may differ from each other. In this case, some of the frames are written to the first region and the remainder of the frames are written to the second region.

The liquid crystal display device 10*a* may have, as a configuration for another write operation, a configuration in which the first half Bx of the frame B and the second half Ay of the frame A are written to the first and second regions, respectively, at the same timing, for example, as illustrated in FIG. 4(*c*). In this case, since control signals such as the same gate start pulse and vertical synchronization signal can be used in the first and second regions, the circuit configuration can be simplified.

However, when the blanking period becomes longer, a lag in the display timing between the first and second regions may occur, and an adverse effect such that a video is interrupted when displaying a fast motion video may also occur. Therefore, the write timings of the first and second regions are preferably adjusted depending on a setting condition of the liquid crystal display device. Further, an examination result of the timings shows that interruption of a video is rarely viewed when a deviation (blanking period) between the final write timing of the first half Ax of the frame A and the initial write timing of the second half Ay of the frame A is about 1/10 of one vertical scanning period.

(V Inversion Driving Scheme)

Here, the liquid crystal display device 10*a* is driven according to the V inversion driving scheme. Here, for convenience sake, the description will be made using a 1 V inversion driving scheme in which a data signal with polarity inverted for each vertical scanning period (1 V) is supplied to data signal lines, while the data signals with polarities opposite to each other are supplied to two adjacent data signal lines for the same horizontal scanning period. Further, the liquid crystal display device of the invention may have a configuration in which a data signal in which the polarity is the same is supplied to two adjacent data signal lines for the same horizontal scanning period in the V inversion driving scheme. Here, a white solid image will be exemplified as an image to be displayed.

Figure 5:
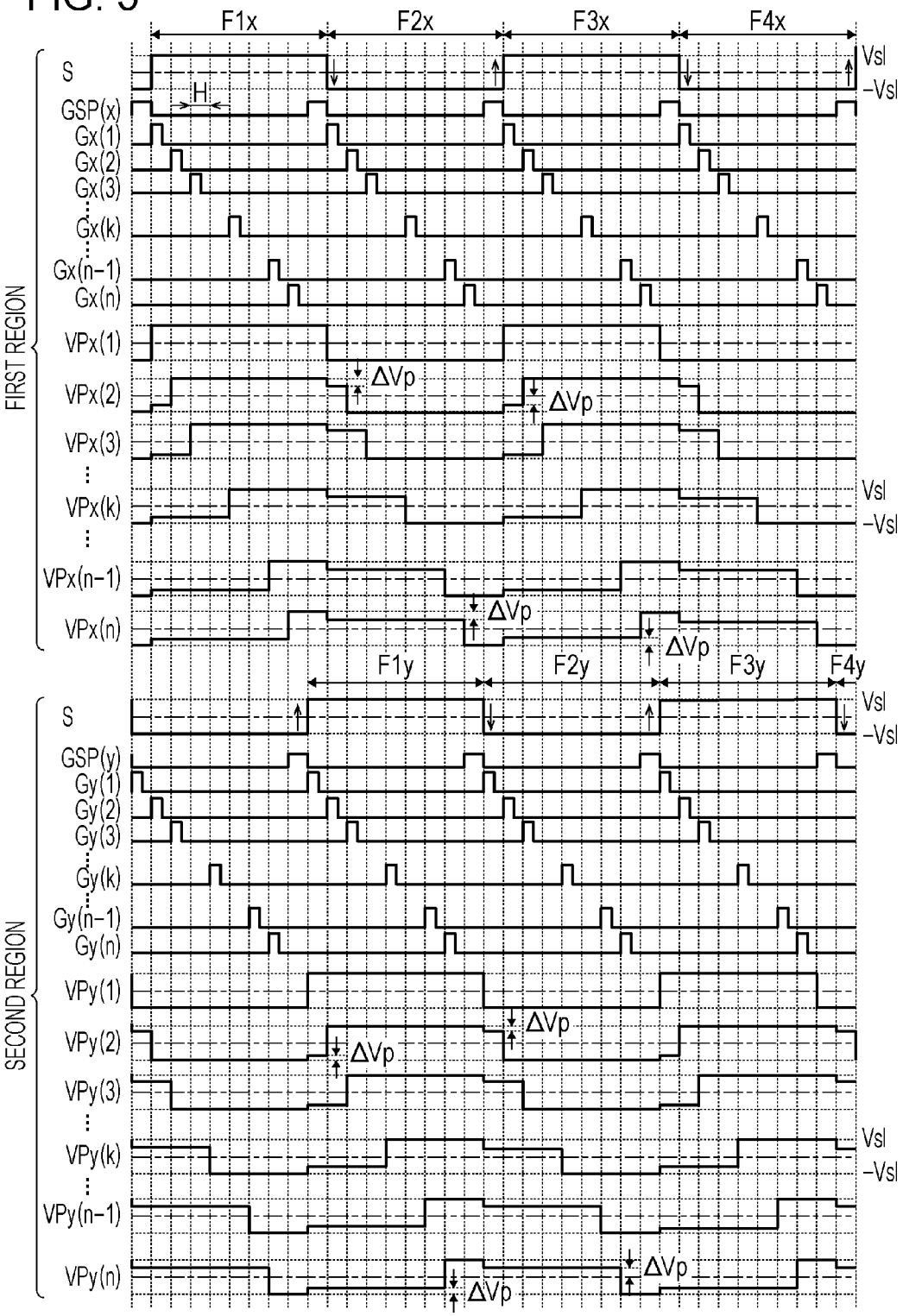
FIG. 5 is a timing chart illustrating an example of the method of driving the liquid crystal display device in correspondence with a display image (gradation image) in FIG. 29.
Figure 28:
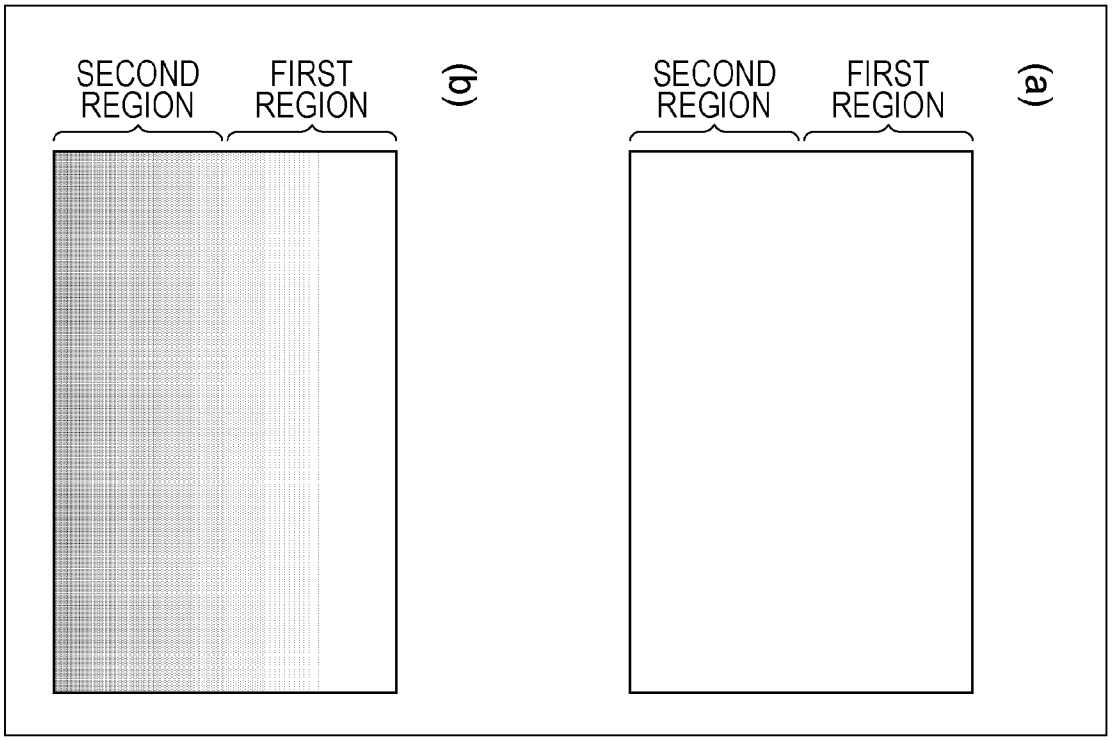
FIG. 28(*a*) is a diagram illustrating a display image displayed according to the driving method in FIG. 26 and FIG. 28(*b*) is a diagram illustrating a display image displayed according to the driving method in FIG. 27.
Figure 29:
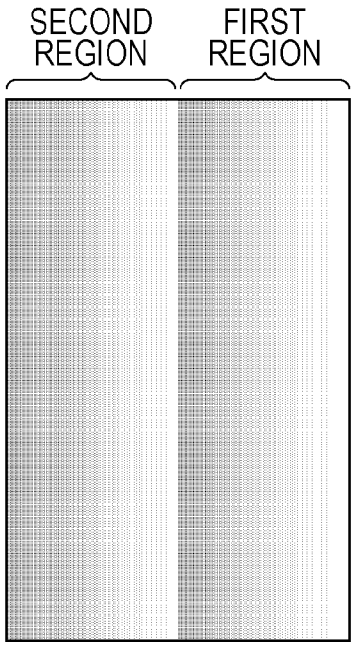
FIG. 29 is a diagram illustrating a display image (gradation image) displayed according to the driving method in the liquid crystal display device of the related art in which a V inversion driving scheme is applied to a screen division driving scheme.

In the 1 V inversion driving scheme of the related art, an image (gradation image) in which luminance deteriorates from a scanning start end portion to a scanning termination end portion is displayed, as illustrated in FIG. 28(*b*). Further, when the 1 V inversion driving scheme is applied to the screen division driving scheme, the termination end side of the first region in which the luminance deteriorates approaches the start end side of the second region in which an image is displayed with the original luminance. Therefore, as illustrated in FIG. 29, the luminance is considerably changed in the boundary portion between the first and second regions, and thus the display quality considerably deteriorates. FIG. 5 is a timing chart corresponding to a display image (gradation image) in FIG. 29. The driving method will be described below.

A frame F1 is divided into a first-half frame Fix and a second-half frame F1*y*, a frame F2 is divided into a first-half frame F2*x* and a second-half frame F2*y*, a frame F3 is divided into a first-half frame F3*x* and a second-half frame F3*y*, and a frame F4 is divided into a first-half frame F4*x* and a second-half frame F4*y*. The first-half frames F1*x*, F2*x*, F3*x*, and F4*x* are written to the first region and the second-half frames F1*y*, F2*y*, F3*y*, and F4*y* are written to the second region.

After the first first-half frame Fix is written to the first region, the second-half frame F1*y* is written to the second region. Here, after the second first-half frame F2*x* is written to the first region so as to temporally overlap the write period of the second-half frame F1*y*, the second second-half frame F2*y* is written to the second region. Then, after the third first-half frame F3*x* is written to the first region so as to temporally overlap the write period of the second-half frame F2*y*, the third second-half frame F3*y* is written to the second region.

Figure 27:
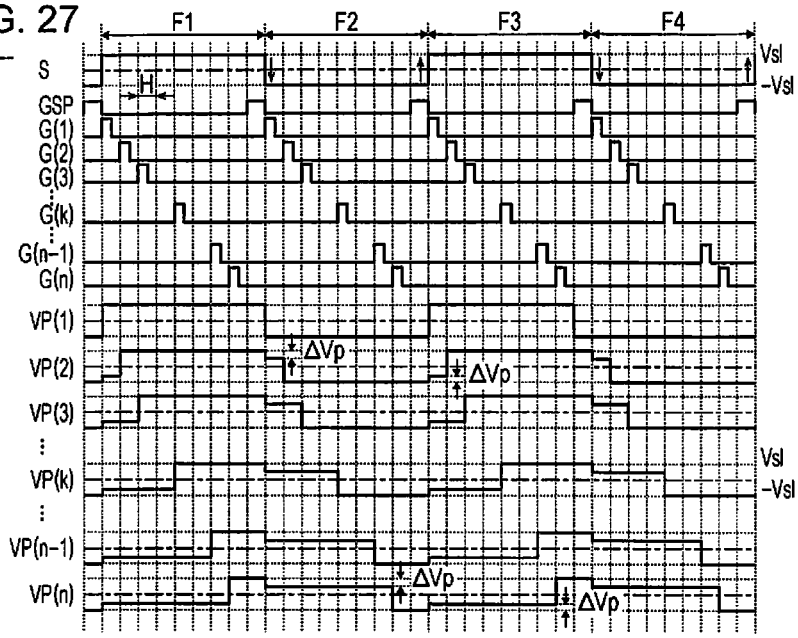
FIG. 27 is a timing chart illustrating a method (normally black mode) of driving a liquid crystal display device according to the related art when a white solid image is displayed.

A driving method for the first and second regions is the same as that of FIG. 27.

When a decrease amount from a potential Vsl is assumed to be ΔVp, as illustrated in FIG. 5, the pixel potential VPx(n) is "Vsl−ΔVp" across a (n−1) horizontal scanning period in the pixel electrode PDx(an) located at a scanning termination end portion of the first region. On the other hand, a pixel potential VPy(1) is held at Vsl across an n horizontal scanning period in the pixel electrode PDy(a1) located at a scanning start end portion of the second region and adjacent to the pixel electrode PDx(an) in the column direction. Therefore, a difference in luminance corresponding to the maximum ΔVp×(n−1) occurs in the boundary portion between the first and second regions per each frame period.

Figure 8:
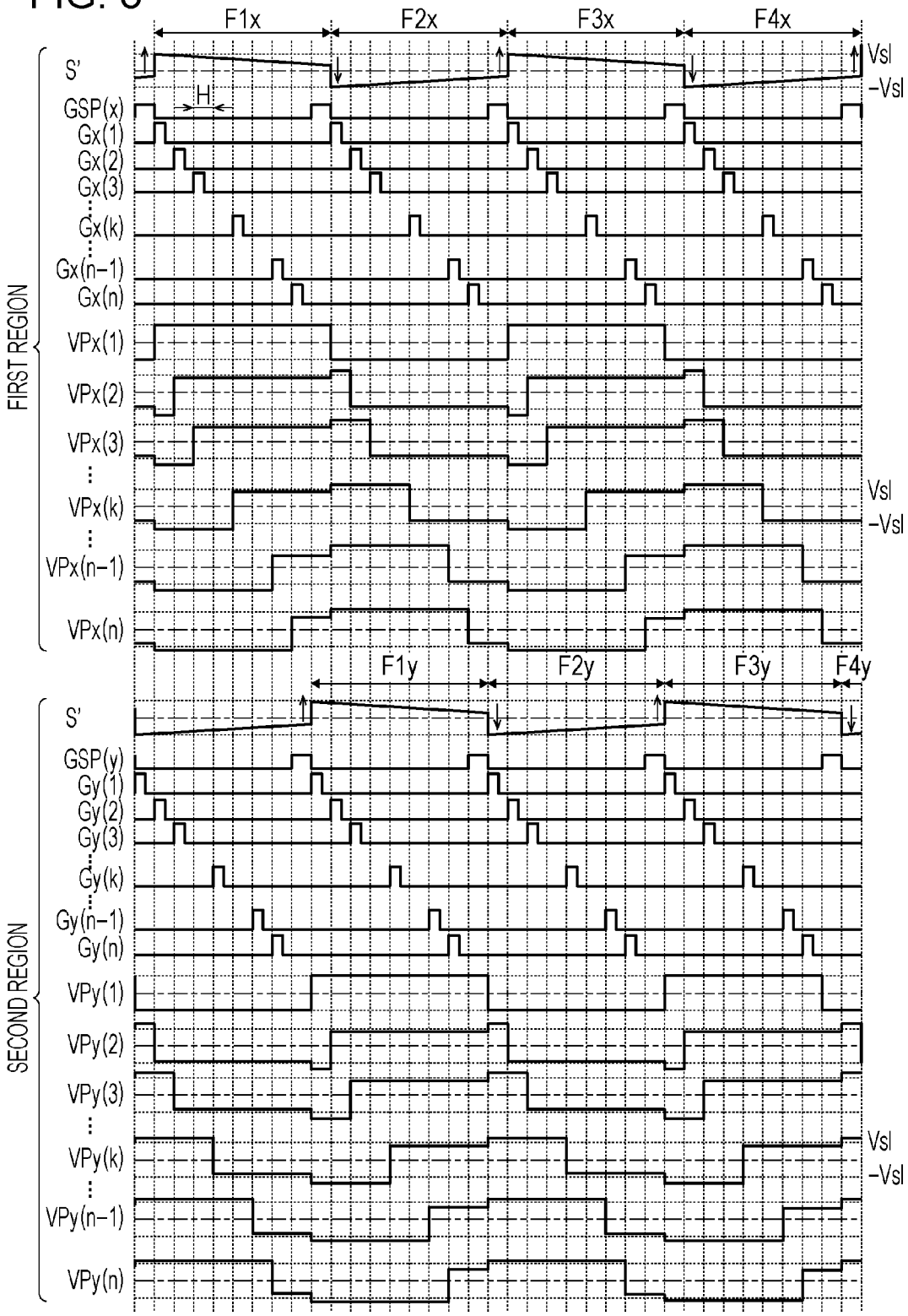
FIG. 8 is a timing chart illustrating another method of driving the liquid crystal display device according to the first embodiment.

Here, for convenience sake, an effect of a parasitic capacitance formed with a data signal line (another data signal line) not electrically connected to the pixel electrodes between two data signal lines disposed left and right is ignored. The effect of the parasitic capacitance will be described later (FIG. 8).

(Correction of Change in Luminance)

The liquid crystal display device 10*a* has a configuration in which the change in the luminance is corrected (reduced). Hereinafter, a configuration for reducing the change in the luminance will be described. In the liquid crystal display device 10*a*, the potential of the data signal S corresponding to the input video data DAT is corrected to reduce the change in the luminance and a corrected data signal S' is supplied to the data signal line SL. The correction of the data signal S is performed at least in the first region. Hereinafter, a case in which the correction is performed in both of the first and second regions will be described. Since the correction is performed in the first and second regions in the same way, the correction of the first region will be described.

Figure 6:
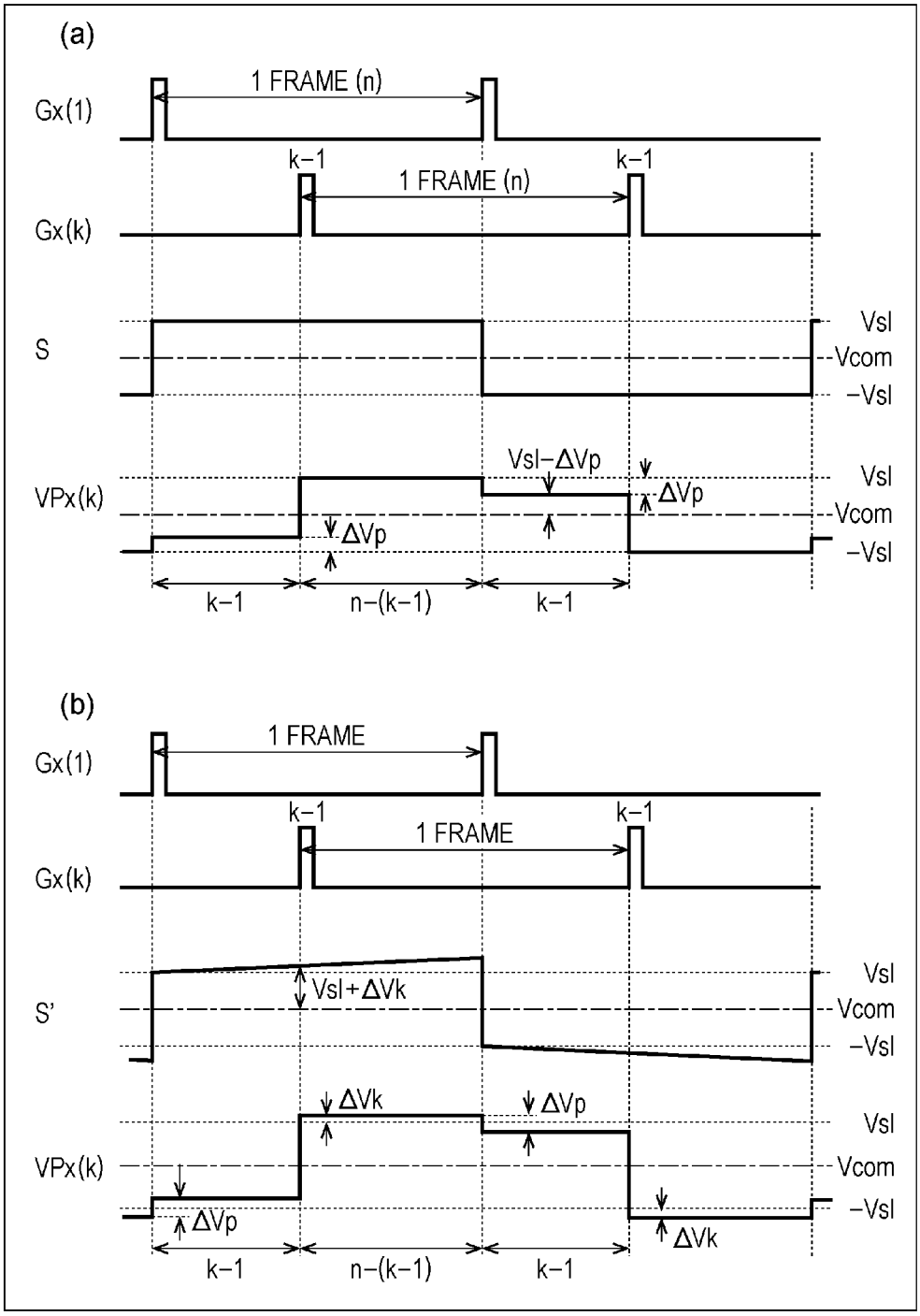
FIG. 6(*a*) is a timing chart illustrating a driving method corresponding to a pixel electrode PDx(k) when a data signal is not corrected and FIG. 6(*b*) is a timing chart illustrating a driving method corresponding to the pixel electrode PDx(k) when the data signal is corrected.
Figure 7:
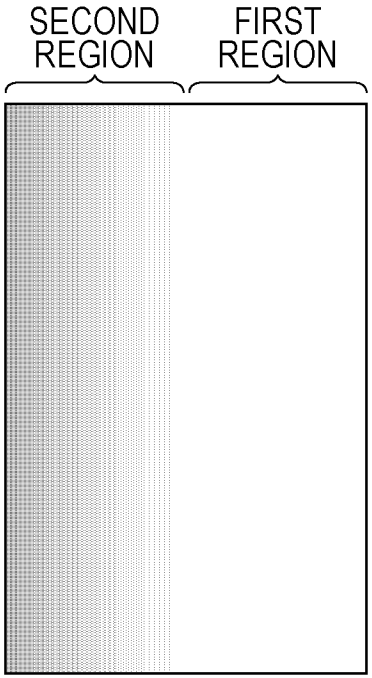
FIG. 7 is a diagram illustrating an image displayed by the method of driving the liquid crystal display device according to the first embodiment.

A method of correcting the data signal S will be described with reference to FIG. 6. FIG. 6(*a*) is a timing chart illustrating a driving method corresponding to a pixel electrode PDx(k) (where k is an integer of "1≤k≤n") when the data signal S is not corrected and FIG. 6(*b*) is a timing chart illustrating a driving method corresponding to the pixel electrode PDx(k) when the data signal S is corrected.

S indicates a data signal supplied to the data signal line SLx, S' indicates a corrected data signal supplied to the data signal line SLx, Gx(1) indicates a gate signal supplied to the scanning signal line GLx(1) selected for the first horizontal scanning period, Gx(k) indicates a gate signal supplied to the scanning signal line GLx(k) selected for the k-th horizontal scanning period, and Vpx(k) indicates the potential of the pixel electrode PDx(k).

A decrease amount of the potential in the pixel electrode PDx(k) is assumed to be ΔVp. In the case of FIG. 6(*a*), an integrated potential Vp(sum) for one frame period is a value obtained by adding an integrated potential for a period after writing of Vsl and an integrated potential for a decrease period of the potential:

the integrated potential for the period after the writing$=Vsl\times(n-(k-1))$, the integrated potential for a decrease period of potential$=(Vsl-\Delta Vp)\times(k-1)$, and $$Vp(\text{sum})=Vsl\times(n-(k-1))+(Vsl-\Delta Vp)\times(k-1)=Vsl\times n-\Delta Vp\times(k-1).$$

From the above equation, it can be understood that the integrated potential Vp(sum) for one frame period is decreased by "ΔVp×(k−1)" from the integrated potential (Vsl×n) for the original one frame period. As a result of this decrease in the amount of the potential, an image may appear as the gradation image illustrated in FIG. 29.

Accordingly, in the liquid crystal display device 10*a* according to the embodiment, the potential decrease amount (ΔVp×(k−1)) for one frame period is converted (averaged) into a potential decrease amount ΔV(k) per horizontal scanning period, and the converted value is added to the potential of the data signal S for each horizontal scanning period in a subsequent frame. ΔV(k) can be expressed as in the following equation:

$$\Delta V(k)=\Delta Vp\times(k-1)/n.$$

In addition, the potential Vsl of the data signal S is corrected to a potential Vsl'(k) of the data signal S' expressed as follows:

$$Vsl'(k)=Vsl+\Delta V(k)=Vsl+\Delta Vp\times(k-1)/n.$$

In the case of FIG. 6(*b*), the integrated potential Vp(sum) of one frame period is expressed as follows:

the integrated potential for the period after the writing$=(Vsl+\Delta Vk)\times(n-(k-1))$, the integrated potential for the decrease period of the potential$=(Vsl+\Delta Vk-\Delta Vp)\times(k-1)$, and $$Vp(\text{sum})=(Vsl+\Delta V(k))\times(n-(k-1))+(Vsl+\Delta V(k)-\Delta Vp)\times(k-1).$$

According to the foregoing equation, it can be understood that the integrated potential Vp(sum) for one frame period is the same as the integrated potential "Vsl×n" for the original one frame period. Therefore, by correcting the data signal S to S', the luminance for one frame period can be averaged.

A potential amount added to the potential of the data signal of the current frame is calculated based on the potential decrease amount (ΔVp) of the data signal of the previous frame (immediately previous frame). However, since the immediately previous frame is used, reliability of the display quality does not deteriorate.

FIG. 1 is a timing chart illustrating a method of driving the liquid crystal display device 10*a* and corresponding to FIG. 6(*b*). In FIG. 1, a dotted line shown in the potential VP of each pixel electrode PD indicates the original potentials Vsl and −Vsl of the data signal. As illustrated in FIG. 1, the potential of the data signal S' supplied to the data signal line is increased from the scanning start end portion to the scanning termination end portion. Thus, the decrease amount of the potential after the writing to the pixel electrode PD is compensated. That is, in the pixel electrode PD(n) which is the termination portion in the scanning direction, the decrease amount of the potential for one frame period is the maximum. Therefore, the potential of the data signal written to the pixel electrodes PDx(n) and PDy(n) for the n-th horizontal scanning period is also the maximum.

According to the foregoing driving method, since the average display luminance for one frame period can be set to be the same in the respective pixels in the first and second regions, the display image illustrated in FIG. 28(*a*) can be displayed.

Thus, in the liquid crystal display device 10*a*, the change in the luminance occurring between the first and second regions can be reduced by correcting the potential of the data signal supplied to the data signal line SLx according to a distance from the scanning start end portion. Further, to reduce the change in the luminance occurring in the boundary portion between the first and second regions, the foregoing correction process (the foregoing driving method) may be performed at least in the first region. When the foregoing correction process is performed only in the first region, a display image illustrated in FIG. 7 can be obtained. In the display image in FIG. 7, the change in the luminance is continuous in the scanning direction in the second region. Therefore, since the change in the luminance can be further suppressed compared to the case of FIG. 28(*b*), the display quality is not considerably affected at a visual level.

Here, in each pixel electrode, a parasitic capacitance is also formed between the pixel electrode and a data signal line (the other data signal line) which is not electrically connected between two data signal lines disposed right and left. For example, in the pixel electrode PDx(k), a parasitic capacitance is also formed between the pixel electrode and the data signal line SLx(b) which is not electrically connected. Accordingly, since each pixel electrode is affected by the parasitic capacitance occurring between the pixel electrode and the other data signal line, a variation amount of potential of the data signal is preferably calculated considering (subtracting) two parasitic capacitances occurring between the pixel electrode and two adjacent data signal lines (one data signal line and the other data signal line).

Here, for example, when the effect of the parasitic capacitance occurring between a pixel electrode and the other data signal line is greater than the effect of the parasitic capacitance occurring between the pixel electrode and the one data signal line, the integrated potential for one frame period is higher than the original integrated potential (Vsl×n) in some cases. Specifically, for example, a case in which black data is supplied to one data signal line and white data (with polarity opposite to that of the black data) is supplied to the other data signal line will be assumed. In this case, since the effect of a variation in the potential caused by the other data signal is greater than the effect of a variation in the potential by the one data signal line, as illustrated in FIG. 8, the potential of the data signal is corrected in each frame such that the potential is decreased (approaches the center potential) continuously from the original potential from the frame start time point to the frame end time point. Accordingly, the change in the luminance occurring in the boundary portion between the first and second regions can be suppressed. In this case, when n (where n is an integer equal to or greater than 1) scanning signal lines are installed in the first region, the potential of the data signal corresponding to a video signal input from the outside is assumed to be Vsl, and the potential amount of the potential of the pixel electrode increased by inverting the polarity of the data signal is assumed to be ΔVph, a correction potential Vsl'(k) of the data signal supplied to each data signal line in the first region for a k-th (where k is an integer equal to or greater than 1 and equal to or less than n) horizontal scanning period is expressed as in:

$$Vsl'(k)=Vsl-\Delta Vph\times(k-1)/n.$$

(Configuration of Data Correction Circuit)

Next, a configuration of the liquid crystal display device 10*a* performing the foregoing correction process (the foregoing driving method) will be described.

Figure 9:
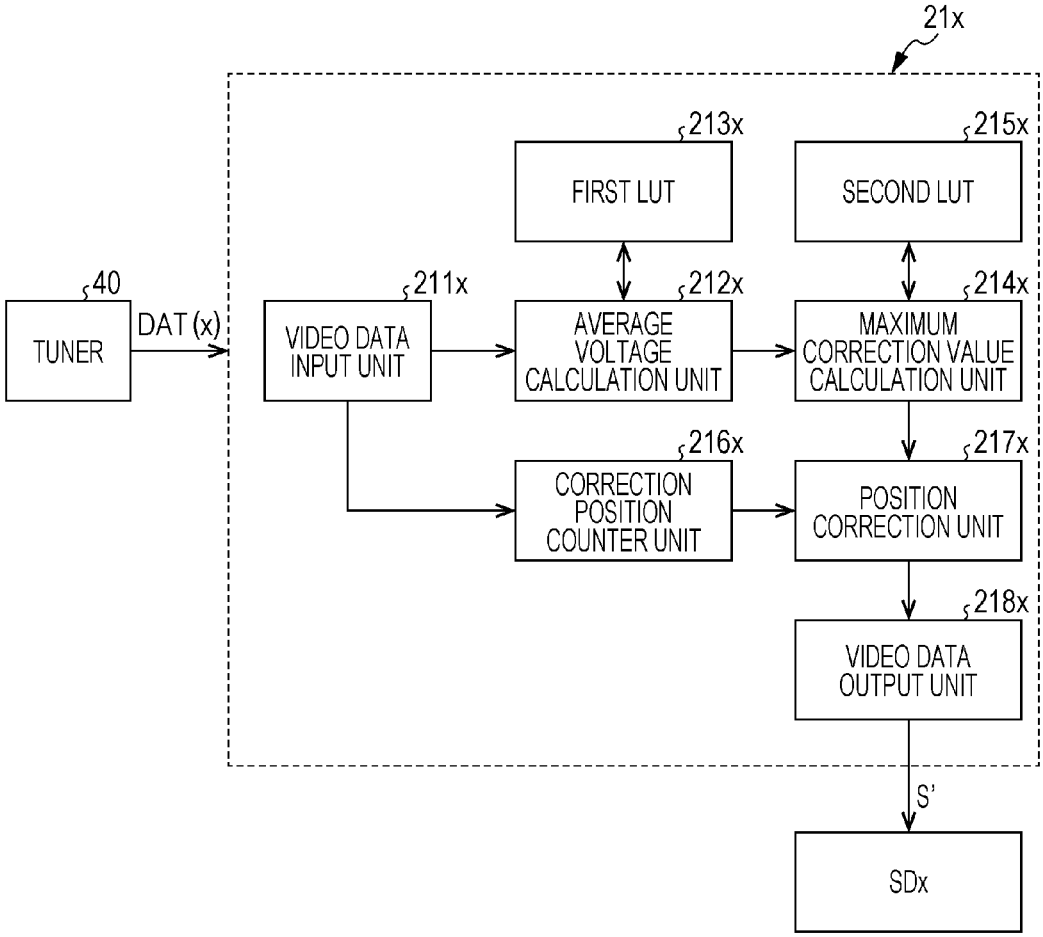
FIG. 9 is a block diagram illustrating the configuration of a data correction circuit in the liquid crystal display device according to the first embodiment.

The first display control circuit 20*x* (see FIG. 2) of the liquid crystal display device 10*a* includes a data correction circuit 21*x* that corrects the video data DAT(x) and the second display control circuit 20*y* (see FIG. 2) includes a data correction circuit 21*y* that corrects the video data DAT(y). Since the data correction circuits 21*x* and 21*y* have the same configuration, the data correction circuit 21*x* will be described below. FIG. 9 is a block diagram illustrating the configuration of the data correction circuit 21*x*. The liquid crystal display device 10*a* includes only the data correction circuit 21*x* in a configuration in which the foregoing correction process is performed only in the first region and includes both of the data correction circuits 21*x* and 21*y* in a configuration in which the foregoing correction process is performed in both of the first and second regions. In the configuration in which the foregoing correction process is performed in both of the first and second regions, one data correction circuit may be installed outside the first display control circuit 20*x* and the second display control circuit 20*y*.

As illustrated in FIG. 9, the data correction circuit 21*x* includes a video data input unit 211*x*, an average voltage calculation unit 212*x*, a first LUT (lookup table) 213*x*, a maximum correction value calculation unit 214*x*, a second LUT 215*x*, a correction position counter unit 216*x*, a position correction unit 217*x*, and a video data output unit 218*x*.

The video data DAT(x) is input from the tuner 40 (FIG. 2) to the video data input unit 211*x*. The video data input unit 211*x* provides the input video data DAT(x) to the average voltage calculation unit 212*x* and the correction position counter unit 216*x* on the rear stage.

The average voltage calculation unit 212*x* calculates an average source voltage of one frame for each data signal line SLx based on the video data DAT(x) acquired from the video data input unit 211*x*. Here, the source voltage refers to the absolute value of the signal potential of the video data DAT(x) with reference to Vcom. Since the signal potential and the source voltage of the video data DAT(x) are matched with each other in the first LUT, the average voltage calculation unit 212*x* acquires a source voltage corresponding to the video data DAT(x), referring to the first LUT 213*x*.

The average voltage calculation unit 212*x* acquires source voltages corresponding to one frame and calculates an average source voltage. The voltage set in the first LUT 213*x* may be assumed to be a liquid crystal application voltage. Since a difference in the voltage set by the data signal line is normally not considered, the first LUT 213*x* can be configured as one table. Accordingly, since processes subsequent to the process of substituting the display image of each frame with a solid image can be performed, the correction process can be simplified.

The average voltage calculation unit 212*x* performs a process of updating the average source voltage by integrating the data (source voltages) corresponding to one frame. The average voltage calculation unit 212*x* discards the old data when new data is integrated. When the new data is read using a line memory for each data signal line and the integration is repeated while discarding the old data, data becomes more accurate. However, since a frame memory is necessary to do so, it is not preferable to do so. Accordingly, in the embodiment, for example, when Vk (where k=1 to n) is input, the current average source voltage is discarded as in "sum(Vk)←sum (Vk−1)+Vk−sum(Vk−1)/n." Accordingly, a time lag occurs between the true average source voltage and the calculated value. However, when 500 pieces of data are integrated during one frame, there is not so much difference as an average value in a video stable although about 100 pieces of data are delayed. In a video in which a motion is large to the degree that this has an effect, the problem of the change in the luminance is not actualized.

Figure 10:
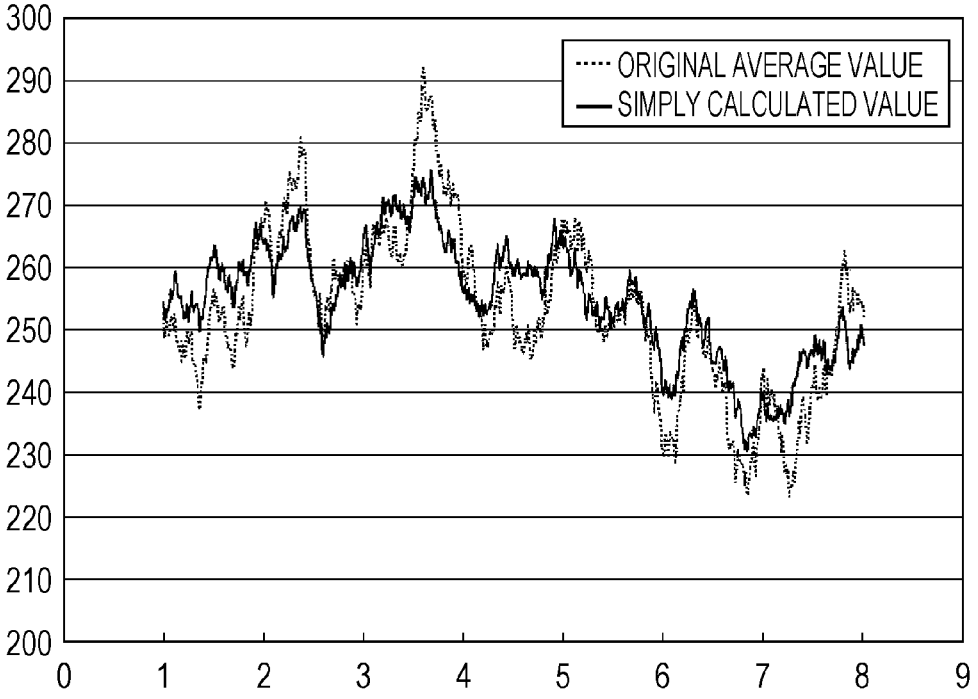
FIG. 10 is a graph for describing a process in an average voltage calculation unit of the data correction circuit illustrated in FIG. 9.

In a graph illustrated in FIG. 10, random number data with an average value of about 250 is generated from 0 to 500, and a calculation result (simple calculation) of the average value obtained when every 100 pieces of data are set as one interval is compared to the original average value. As shown in the graph, it can be confirmed that substantially the same behavior as that of the original average value can be obtained even in the simple calculation. Apparently, when the original average value can be estimated allowing for the fact that the calculation period of the average value becomes longer, the average value obtained through the simple calculation may be multiplied by an integer for use. That is, when random number data from 0 to 255 are used, a difference with an average value calculated with reference to 127 can be expanded and used. However, there is no case in which the video signals are all random numbers, and it is observed that there is no problem even when the simply calculated value is used as an average value without regard to this idea, considering that there is a strong correlation and a problem of the luminance separation is not visible for the random number data in most cases even over the frame. When the average value is a gradation data, the source voltage may be calculated from an LUT. When there is a room for a resource, a voltage may be converted in advance likewise using the LUT at a step of calculating the average value.

When the average source voltage is calculated according to the same rules and the resources of a circuit for division have a non-negligible size, the simplicity can also be achieved. In this case, nc used in the calculation may be set to the power-of-two which is the closest to nr of the calculation of the actual average value. That is, when 1080 pieces of line data are treated with, calculating the average value as the sum voltage/nr using "nr=1080" is suitable. However, the sum voltage/nc may be treated as the average voltage at the time of the calculation of the average value, using "nc=1024≈nr." When nc>nr, the average source voltage of that time may be treated as being input at a timing before a vertical synchronization signal is input. When nc<nr, data immediately after the vertical synchronization signal may be skipped by a necessary number. It is obvious that such a kind of approximation does not cause a serious error from the viewpoint of the correction of the luminance in the boundary portion between the first and second regions. Accordingly, the average source voltage can be calculated using only simple bit manipulation, addition, and subtraction. Here, the "average" is used, but is not strict mathematically. Appropriate calculation can be applied as long as the average source voltage has an output in the range of 80% to 120% of the true average value of the integrated potential. That is, the average source voltage used in the data correction circuit 21$x$ can be set to be in the range of 80% to 120% of the true average source voltage.

Based on the average source voltage acquired from the average voltage calculation unit 212$x$, the maximum correction value calculation unit 214$x$ calculates the maximum correction amount (maximum correction value) in one frame, referring to the second LUT 215$x$. Here, as illustrated in FIG. 5 and FIG. 6($a$), the polarity of the data signal S immediately after the writing of the potential Vsl of the data signal is switched in the pixel electrode PDx(n) which is the termination portion in the scanning direction, and thus the pixel potential VPx(n) is decreased from Vsl to "Vsl−ΔVp." Since the decreased pixel potential VPx(n) (=Vsl−ΔVp) is held only for a (n−1) horizontal scanning period from the first horizontal scanning period to the (n−1)-th horizontal scanning period, the maximum correction value corresponding to one frame is calculated as "ΔVp×(n−1)." That is, in the pixel electrode PDx(k), the maximum correction value corresponding to one frame is calculated as "ΔVp×(k−1)."

The decrease amount ΔVp of the pixel potential can be calculated in advance based on characteristics or the like of the liquid crystal panel such as gradation of the source voltage and the parasitic capacitance Csd. The decrease amount ΔVp can also be calculated using a frame memory based on the average source voltage of the immediately previous frame or a frame before the immediately previous frame and the decreased pixel potential.

In the second LUT 215$x$, the gradation (input gradation) corresponding to the average source voltage is matched in advance with the gradation (output gradation) corresponding to the maximum correction value calculated in the foregoing equation. The maximum correction value calculation unit 214$x$ provides the calculated maximum correction value to the position correction unit 217$x$.

The correction position counter unit 216$x$ specifies a target horizontal scanning period (position) based on the video data DAT(x) acquired from the video data input unit 211$x$ and the horizontal synchronization signal HSYNC(x) input from the tuner 40 and provides information regarding the specified position to the position correction unit 217$x$.

The position correction unit 217$x$ corrects the video data DAT(x) corresponding to the target horizontal scanning period based on the maximum correction value acquired from the maximum correction value calculation unit 214$x$ and the information regarding the position acquired from the correction position counter unit 216$x$. Specifically, a correction value ΔV(k) of the data signal S corresponding to a k-th horizontal scanning period is calculated using the following equation:

$$\text{correction value } \Delta V(k)=\Delta Vp\times(k-1)/n.$$

The position correction unit 217$x$ adds the calculated correction value ΔV(k) to the potential of the data signal S corresponding to the video data DAT(x). Accordingly, the potential Vsl' of the data signal S' after the correction can be expressed as in an equation:

$$Vsl'=Vsl+\Delta V(k)=Vsl+\Delta Vp\times(k-1)/n.$$

The corrected data signal S' is input to the video data output unit 218$x$. The video data output unit 218$x$ supplies the data signal S' to the first source driver SDx via a timing controller (not illustrated) at a predetermined timing.

In the embodiment, as described above, when at least the boundary portion between the first and second regions is suitably corrected, continuous correction can be realized in other regions. Thus, to simplify the process, the LUT may also be used or a table such as a logarithmic table assisting the calculation may be used together. Further, n may be set as a numerical value (power-of-two or the like) easy in the calculation and k may be corrected to be 1 collectively in the scanning termination portion in conformity with the correction of n.

Here, since the effect of the adjacent data signal lines SLb can be calculated numerically as in the data signal lines SLa, both of the correction amounts may be deducted and a correction amount may be determined. Therefore, each correction amount may be calculated up to the final stage, or a factor (−1 to 1) used to further correct the correction amount may be calculated and multiplied in comparison to both of the average source voltages. Further, when the parasitic capacitance Csd in both of the data signal lines SLa and SLb is changed, an LUT for calculation of the correction amount may be prepared and the correction amount may be deducted finally according to the change in the parasitic capacitance.

In this manner, it is possible to suppress the effect of the change in the luminance indicating the relatively complex behavior, to a minimum, with the least amount of resources.

Second Embodiment

A second embodiment of the invention will be described below with reference to the drawings. To facilitate the description, the same reference numerals are given to members having the same functions as the members indicated in the foregoing first embodiment, and the description thereof will be omitted. The terms defined in the first embodiment are used also in the embodiment according to the definition, as long as the terms are not particularly mentioned.

(Configuration of Liquid Crystal Display Device)

FIG. 2 is a block diagram illustrating a schematic configuration of a television receiver. As illustrated in the drawing, a television receiver 50$b$ includes a tuner 40 and a liquid crystal display device 10$b$. The liquid crystal display device 10$b$ includes a liquid crystal panel 3$b$ divided into first and second regions, a first display control circuit 20$x$, a first source driver SDx, a first gate driver GDx, a first Cs control circuit 30$x$, a second display control circuit 20$y$, a second source driver SDy, a second gate driver GDy, and a second Cs control circuit 30$y$. The first display control circuit 20$x$, the first source driver SDx, the first gate driver GDx, and the first Cs control circuit 30$x$ are used to drive the first region and the second display control circuit 20$y$, the second source driver SDy, the second gate driver GDy, and the second Cs control circuit 30$y$ are used to drive the second region.

(Configuration of Liquid Crystal Panel)

Figure 11:
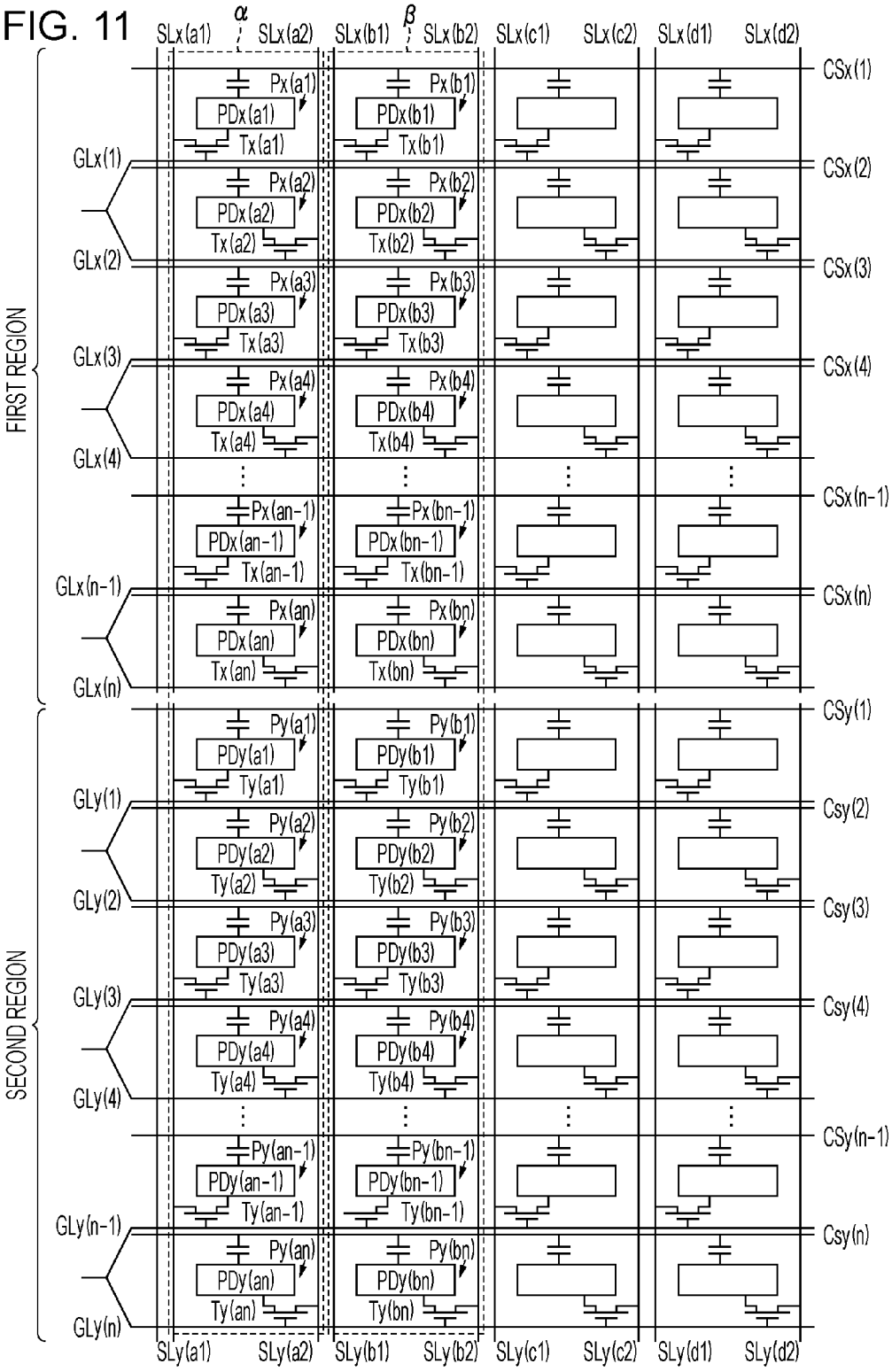
FIG. 11 is an equivalent circuit diagram illustrating a part of a liquid crystal panel according to a second embodiment.

The liquid crystal panel 3$b$ according to the second embodiment has a so-called upper and lower division double source configuration (a configuration in which four data signal lines are installed in the upper, lower, right, and left portions per pixel column, for example, data signal lines SLx(a1), SLx(a2), SLy(a1), and SLy(a2) are installed in a pixel column α of FIG. 11, and the four scanning signal lines can simultaneously be selected) in which two data signal lines are installed in correspondence with the upper half (the upstream side of the panel; the first region) of one pixel column and two data signal lines are installed in correspondence with the lower half (the downstream side of the panel;

the second region) of the pixel column, and thus fourfold TFT writing time can be allocated as to as to be suitable for an ultra-high resolution panel or 4 times speed driving, compared to a normal panel configuration. Hereinafter, a specific description will be made.

FIG. 11 is an equivalent circuit diagram illustrating a part of the liquid crystal panel 3*b* according to the second embodiment. In the first region of the liquid crystal panel 3*b*, as illustrated in FIG. 11, data signal lines SLx(a1), SLx(a2), SLx(b1), SLx(b2), SLx(c1), SLx(c2), SLx(d1), and SLx(d2) are arranged to line up in this order, scanning signal lines GLx(1), GLx(2), GLx(3), GLx(4), . . . , GLx(k−1), GLx(k), . . . , GLx(n−1), and GLx(n) extending in the row direction (the right and left directions in the drawing) are arranged to line up in this order, and holding capacitance wirings CSx(1), CSx(2), CSx(3), CSx(4), . . . , CSx(k−1), CSx(k), . . . , CSx(n−1), and CSx(n) are arranged to line up in this order in correspondence with the scanning signal lines, respectively. Here, k is an even number equal to or greater than 2 and equal to or less than n (2≤k≤n) and n is, for example, 540 (lines). For convenience sake, GLx(k) and CSx(k) are omitted in FIG. 11 and the subsequent drawings.

In the first region, a pixel Px(a1) is installed in correspondence with the intersection of the data signal lines SLx(a1) and SLx(a2) and the scanning signal line GLx(1), a pixel Px(a2) is installed in correspondence with the intersection of the data signal lines SLx(a1) and SLx(a2) and the scanning signal line GLx(2), a pixel Px(an−1) is installed in correspondence with the intersection of the data signal lines SLx(a1) and SLx(a2) and the scanning signal line GLx(n−1), and a pixel Px(an) is installed in correspondence with an intersection of the data signal lines SLx(a1) and SLx(a2) and the scanning signal line GLx(n).

Likewise, a pixel Px(b1) is installed in correspondence with the intersection of the data signal lines SLx(b1) and SLx(b2) and the scanning signal line GLx(1), a pixel Px(b2) is installed in correspondence with the intersection of the data signal lines SLx(b1) and SLx(b2) and the scanning signal line GLx(2), a pixel Px(bn−1) is installed in correspondence with the intersection of the data signal lines SLx(b1) and SLx(b2) and the scanning signal line GLx(n−1), and a pixel Px(bn) is installed in correspondence with an intersection of the data signal lines SLx(b1) and SLx(b2) and the scanning signal line GLx(n).

Here, the data signal lines SLx(a1) and SLx(a2) are installed in correspondence with the pixel column α (first pixel column) including pixels Px(a1) to Px(an), and the data signal lines SLx(b1) and SLx(b2) are installed in correspondence with a pixel column β (second pixel column) including pixels Px(b1) to Px(bn).

One pixel electrode PDx is disposed for each pixel Px. A pixel electrode PDx(a1) of the pixel Px(a1) is connected to the data signal line SLx(a1) via a transistor Tx(a1) connected to the scanning signal line GLx(1). A pixel electrode PDx(a2) of the pixel Px(a2) is connected to the data signal line SLx(a2) via a transistor Tx(a2) connected to the scanning signal line GLx(2). A pixel electrode PDx(an−1) of the pixel Px(an−1) is connected to the data signal line SLx(a1) via a transistor Tx(an−1) connected to the scanning signal line GLx(n−1). A pixel electrode PDx(an) of the pixel Px(an) is connected to the data signal line SLx(a2) via a transistor Tx(an) connected to the scanning signal line GLx(n).

Likewise, a pixel electrode PDx(b1) of the pixel Px(b1) is connected to the data signal line SLx(b1) via a transistor Tx(b1) connected to the scanning signal line GLx(1). A pixel electrode PDx(b2) of the pixel Px(b2) is connected to the data signal line SLx(b2) via a transistor Tx(b2) connected to the scanning signal line GLx(2). A pixel electrode PDx(bn−1) of the pixel Px(bn−1) is connected to the data signal line SLx(b1) via a transistor Tx(bn−1) connected to the scanning signal line GLx(n−1). A pixel electrode PDx(bn) of the pixel Px(bn) is connected to the data signal line SLx(b2) via a transistor Tx(bn) connected to the scanning signal line GLx(n).

That is, the data signal line SLx(a2) to which the pixel electrodes (the pixel electrodes PDx(a2), PDx(a4), and PDx(an)) of the even pixels (the pixels Px(a2), Px(a4), and Px(an)) of the pixel column α are connected is adjacent to the data signal line SLx(b1) to which the pixel electrodes (the pixel electrodes PDx(b1), PDx(b3), and PDx(bn−1)) of the odd pixels (the pixels Px(b1), Px(b3), and Px(bn−1)) of the pixel column β are connected.

The scanning signal line GLx(1) corresponding to the pixel electrode PDx(a1) of the pixel Px(a1) and the pixel electrode PDx(b1) of the pixel Px(b1) is connected to the scanning signal line GLx(2) corresponding to the pixel electrode PDx(a2) of the pixel Px(a2) and the pixel electrode PDx(b2) of the pixel Px(b2) inside or outside the panel, and thus the scanning signal lines GLx(1) and GLx(2) are simultaneously selected. The scanning signal line GLx(3) corresponding to the pixel electrode PDx(a3) of the pixel Px(a3) and the pixel electrode PDx(b3) of the pixel Px(b3) is connected to the scanning signal line GLx(4) corresponding to the pixel electrode PDx(a4) of the pixel Px(a4) and the pixel electrode PDx(b4) of the pixel Px(b4) inside or outside the panel, and thus the scanning signal lines GLx(3) and GLx(4) are simultaneously selected. The scanning signal line GLx(n−1) corresponding to the pixel electrode PDx(an−1) of the pixel Px(an−1) and the pixel electrode PDx(bn−1) of the pixel Px(bn−1) is connected to the scanning signal line GLx(n) corresponding to the pixel electrode PDx(an) of the pixel Px(an) and the pixel electrode PDx(bn) of the pixel Px(bn) inside or outside the panel, and thus the scanning signal lines GLx(n−1) and GLx(n) are simultaneously selected. Of course, the scanning signal lines GLx(1) and GLx(2), the scanning signal lines GLx(3) and GLx(4), and the scanning signal lines GLx(n−1) and GLx(n) can be configured to be simultaneously selected in a non-connection manner inside or outside the panel.

On the other hand, in the second region, as illustrated in FIG. 11, data signal lines SLy(a1), SLy(a2), SLy(b1), SLy(b2), SLy(c1), SLy(c2), SLy(d1), and SLy(d2) are arranged to line up in this order, scanning signal lines GLy(1), GLy(2), GLy(3), GLy(4), . . . , GLy(k−1), GLy(k), . . . , GLy(n−1), and GLy(n) extending in the row direction (the right and left directions in the drawing) are arranged to line up in this order, and holding capacitance wirings CSy(1), CSy(2), CSy(3), CSy(4), . . . , CSy(k−1), CSy(k), . . . , CSy(n−1), and CSy(n) are arranged to line up in this order in correspondence with the scanning signal lines, respectively. Here, k is an even number equal to or greater than 2 and equal to or less than n (2≤k≤n) and n is, for example, 540 (lines). For convenience sake, GLy(k) and CSy(k) are omitted in FIG. 11 and the subsequent drawings.

In the second region, a pixel Py(a1) is installed in correspondence with the intersection of the data signal lines SLy(a1) and SLy(a2) and the scanning signal line GLy(1), a pixel Py(a2) is installed in correspondence with the intersection of the data signal lines SLy(a1) and SLy(a2) and the scanning signal line GLy(2), a pixel Py(an−1) is installed in correspondence with the intersection of the data signal lines SLy(a1) and SLy(a2) and the scanning signal line GLy(n−1), and a pixel Py(an) is installed in correspondence with an intersection of the data signal lines SLy(a1) and SLy(a2) and the scanning signal line GLy(n).

Likewise, a pixel Py(b1) is installed in correspondence with the intersection of the data signal lines SLy(b1) and SLy(b2) and the scanning signal line GLy(1), a pixel Py(b2) is installed in correspondence with the intersection of the data signal lines SLy(b1) and SLy(b2) and the scanning signal line GLy(2), a pixel Py(bn−1) is installed in correspondence with the intersection of the data signal lines SLy(b1) and SLy(b2) and the scanning signal line GLy(n−1), and a pixel Py(bn) is installed in correspondence with an intersection of the data signal lines SLy(b1) and SLy(b2) and the scanning signal line GLy(n).

Here, the data signal lines SLy(a1) and SLy(a2) are installed in correspondence with the pixel column α including pixels Py(a1) to Py(an), and the data signal lines SLy(b1) and SLy(b2) are installed in correspondence with the pixel column β including pixels Py(b1) to Py(bn).

One pixel electrode PDy is disposed for each pixel Py. A pixel electrode PDy(a1) of the pixel Py(a1) is connected to the data signal line SLy(a1) via a transistor Ty(a1) connected to the scanning signal line GLy(1). A pixel electrode PDy (a2) of the pixel Py(a2) is connected to the data signal line SLy(a2) via a transistor Ty(a2) connected to the scanning signal line GLy(2). A pixel electrode PDy(an−1) of the pixel Py(an−1) is connected to the data signal line SLy(a1) via a transistor Ty(an−1) connected to the scanning signal line GLy(n−1). A pixel electrode PDy(an) of the pixel Py(an) is connected to the data signal line SLy(a2) via a transistor Ty(an) connected to the scanning signal line GLy(n).

Likewise, a pixel electrode PDy(b1) of the pixel Py(b1) is connected to the data signal line SLy(b1) via a transistor Ty(b1) connected to the scanning signal line GLy(1). A pixel electrode PDy(b2) of the pixel Py(b2) is connected to the data signal line SLy(b2) via a transistor Ty(b2) connected to the scanning signal line GLy(2). A pixel electrode PDy(bn−1) of the pixel Py(bn−1) is connected to the data signal line SLy(b1) via a transistor Ty(bn−1) connected to the scanning signal line GLy(n−1). A pixel electrode PDy(bn) of the pixel Py(bn) is connected to the data signal line SLy(b2) via a transistor Ty(bn) connected to the scanning signal line GLy(n).

That is, the data signal line SLy(a2) to which the pixel electrodes (the pixel electrodes PDy(a2), PDy(a4), and PDy (an)) of the even pixels (the pixels Py(a2), Py(a4), and Py(an)) of the pixel column α are connected is adjacent to the data signal line SLy(b1) to which the pixel electrodes (the pixel electrodes PDy(b1), PDy(b3), and PDy(bn−1)) of the odd pixels (the pixels Py(b1), Py(b3), and Py(bn−1)) of the pixel column β are connected.

The scanning signal line GLy(1) corresponding to the pixel electrode PDy(a1) of the pixel Py(a1) and the pixel electrode PDy(b1) of the pixel Py(b1) is connected to the scanning signal line GLy(2) corresponding to the pixel electrode PDy(a2) of the pixel Py(a2) and the pixel electrode PDy(b2) of the pixel Py(b2) inside or outside the panel, and thus the scanning signal lines GLy(1) and GLy(2) are simultaneously selected. The scanning signal line GLy(3) corresponding to the pixel electrode PDy(a3) of the pixel Py(a3) and the pixel electrode PDy(b3) of the pixel Py(b3) is connected to the scanning signal line GLy(4) corresponding to the pixel electrode PDy(a4) of the pixel Py(a4) and the pixel electrode PDy(b4) of the pixel Py(b4) inside or outside the panel, and thus the scanning signal lines GLy(3) and GLy(4) are simultaneously selected. The scanning signal line GLy(n−1) corresponding to the pixel electrode PDy(an−1) of the pixel Py(an−1) and the pixel electrode PDy(bn−1) of the pixel Py(bn−1) is connected to the scanning signal line GLy(n) corresponding to the pixel electrode PDy(an) of the pixel Py(an) and the pixel electrode PDy(bn) of the pixel Py(bn) inside or outside the panel, and thus the scanning signal lines GLy(n−1) and GLy(n) are simultaneously selected. Of course, the scanning signal lines GLy(1) and GLy(2), the scanning signal lines GLy(3) and GLy(4), and the scanning signal lines GLy(n−1) and GLy(n) can be configured to be simultaneously selected in a non-connection manner inside or outside the panel.

The scanning direction in the first region is identical to the scanning direction in the second region, and the first and second regions are arranged to be lined up in this order in the scanning direction. In FIG. 11, the scanning is assumed to be performed from the upper side (upstream side) to the lower side (downstream side) of the sheet surface. That is, the scanning signal lines GLx(1), GLx(2), GLx(3), GLx(4), . . . , GLx(n−1), GLx(n), GLy(1), GLy(2), GLy(3), GLy(4), . . . , GLy(n−1), and GLy(n) are selected in this order.

(Screen Division Scheme)

Here, a writing operation in the liquid crystal display device 10*b* is the same as the writing operation in the liquid crystal display device 10*a* illustrated in FIG. 4(*b*). That is, after the first half Ax of the first frame A is written to the first region, the second half Ay of the first frame A is written to the second region. Here, after the first half Bx of the second frame B is written to the first region so as to temporally overlap the write period of the second half Ay of the frame A, the second half By of the second frame B is written to the second region. Then, after the first half Cx of the third frame C is written to the first region so as to temporally overlap the write period of the second half By of the frame B, the second half Cy of the third frame C is written to the second region.

As in the liquid crystal display device 10*a*, the liquid crystal display device 10*b* may have, as a configuration for another write operation, a configuration in which the first half Bx of the frame B and the second half Ay of the frame A are written to the first and second regions, respectively, at the same timing, as illustrated in FIG. 4(*c*).

(V Inversion Driving Scheme)

Figure 12:
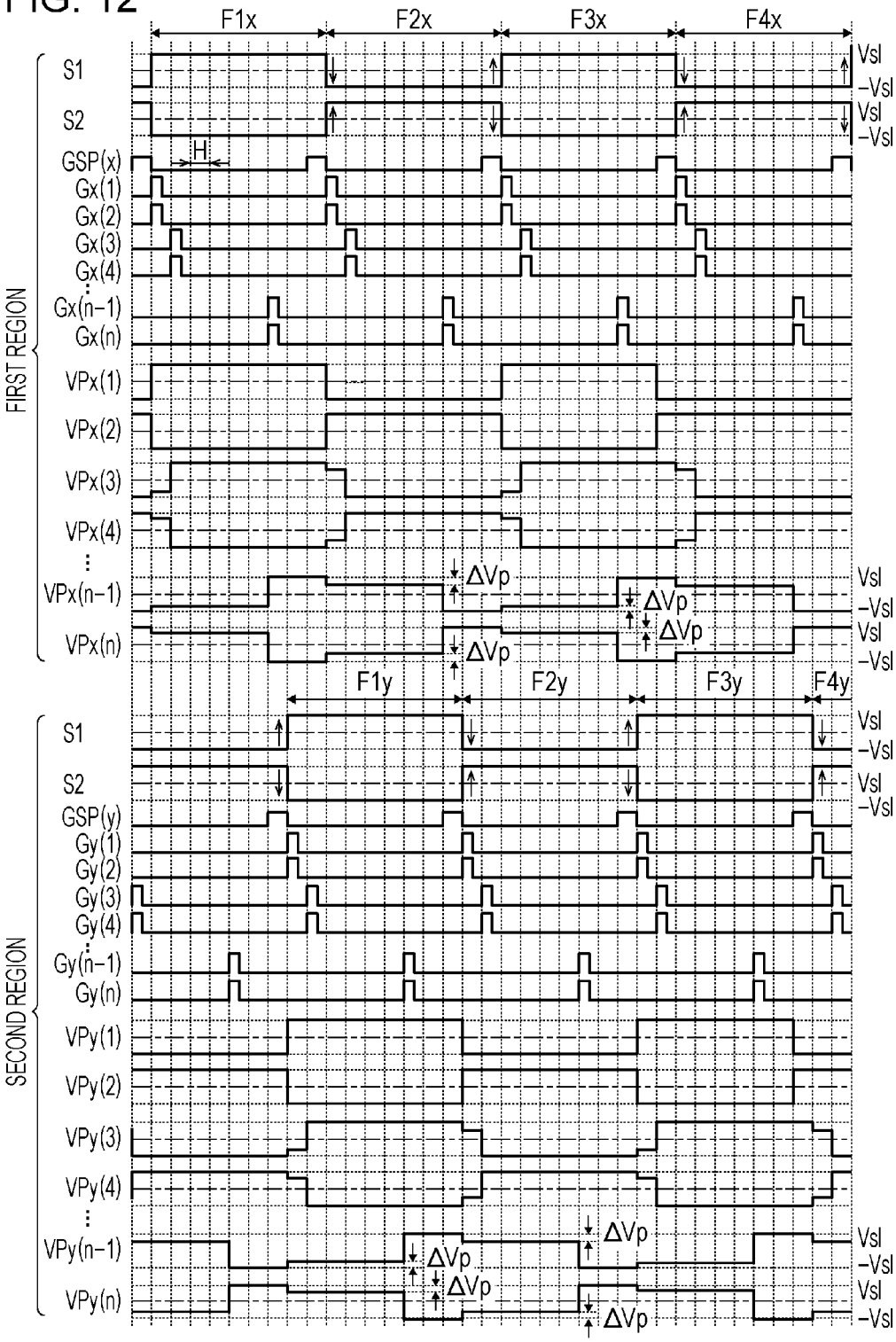
FIG. 12 is a timing chart illustrating a driving method when a data signal is not corrected.

Here, the liquid crystal display device 10*b* is driven according to the V inversion driving scheme. First, a method of driving the liquid crystal display device will be described when correction of the data signal S is not performed. FIG. 12 is a timing chart illustrating a method (normally black mode) of driving a liquid crystal panel when a correction process is not performed. S1 indicates a data signal supplied to the data signal line SL(a1), S2 indicates a data signal supplied to the data signal line SL(a2), and GSP indicates a gate start pulse. G(1), G(2), G(3), G(4), . . . , G(n−1), and G(n) indicate gate signals (scanning signals) supplied to the scanning signal lines GL(1), GL(2), GL(3), GL(4), . . . , GL(n−1), and GL(n), respectively. VP(1), VP(2), VP(3), VP(4), . . . , VP(n−1), and VP(n) indicate the potentials (pixel potentials) of the pixel electrodes PD(a1), PD(a2), PD(a3), PD(a4), . . . , PD(an−1), and PD(an), respectively.

In the driving method, as illustrated in FIG. 12, two scanning signal lines of the first region and two scanning signal lines of the second region, i.e., a total of four scanning signal lines, are simultaneously selected and the polarities of the data signals supplied to the data signal lines SL are inverted for each vertical scanning period (1 V). For the same horizontal scanning period (H), while the data signals with opposite polarities are supplied to two data signal lines (for example, the data signal lines SLx(a1) and SLx(a2) or the data signal lines SLx(b1) and SLx(b2)) corresponding to the same pixel column, the data signals with the same polarity are supplied to two adjacent data signal lines (for example, the data signal lines SLx(a2) and SLx(b1)) (1 V inversion driving). For convenience sake, a white solid image will be exemplified as an image to be displayed. Further, the polarities of the data signals supplied to the data signal lines SL may be inverted for each vertical scanning period (1 V). For the same horizontal scanning period (H), while the data signals with the same polarity may be supplied to two data signal lines (for example, the data signal lines SLx(a1) and SLx(a2) or the data signal lines SLx(b1) and SLx(b2)) corresponding to the same pixel column, the data signals with the opposite polarities may be configured to be supplied to two adjacent data signal lines (for example, the data signal lines SLx(a2) and SLx(b1)) (1 V inversion driving).

Specifically, in first-half frames Fix of a frame F1 (a first-half frame Fix and a second-half frame F1*y*) to a frame F4 (a first half-frame F4*x* and a second-half frame F4*y*) which are arbitrarily consecutive, the data signal line SLx (a1) and the data signal line SLx(b2) are supplied with the data signals with the positive polarity for the first horizontal scanning period (including the scanning periods of the scanning signal lines GLx(1) and GLx(2)), are also supplied with the data signals with the positive polarity for the second horizontal scanning period (including the scanning periods of the scanning signal lines GLx(3) and GLx(4)), and are also supplied with the data signals with the positive polarity for an n/2-th horizontal scanning period (including the scanning periods of the scanning signal lines GLx(n−1) and GLx(n)). The data signal lines SLx(a2) and SLx(b1) are supplied with the data signals with the negative polarity for the first horizontal scanning period (including the scanning periods of the scanning signal lines GLx(1) and GLx(2)), are also supplied with the data signals with the negative polarity for the second horizontal scanning period (including the scanning periods of the scanning signal lines GLx(3) and GLx(4)), and are also supplied with the data signal with the negative polarity for the n/2-th horizontal scanning period (including the scanning periods of the scanning signal lines GLx(n−1) and GLx(n)). Then, the pulse of the gate signal Gx(1) and the pulse of the gate signal Gx(2) rise simultaneously at the start of the first horizontal scanning period, the pulse of the gate signal Gx(3) and the pulse of the gate signal Gx(4) rise simultaneously at the start of the second horizontal scanning period, and the pulse of the gate signal Gx(n−1) and the pulse of the gate signal Gx(n) rise simultaneously at the start of the n/2-th horizontal scanning period.

In the second-half frame F1*y*, the data signal lines SLy(a1) and SLy(b2) are supplied with the data signals with the positive polarity for the first horizontal scanning period (including the scanning periods of the scanning signal lines GLy(1) and GLy(2)), are also supplied with the data signals with the positive polarity for the second horizontal scanning period (including the scanning periods of the scanning signal lines GLy(3) and GLy(4)), and are also supplied with the data signals with the positive polarity for the n/2-th horizontal scanning period (including the scanning periods of the scanning signal lines GLy(n−1) and GLy(n)). The data signal lines SLy(a2) and SLy(b1) are supplied with the data signals with the negative polarity for the first horizontal scanning period (including the scanning periods of the scanning signal lines GLy(1) and GLy(2)), are also supplied with the data signals with the negative polarity for the second horizontal scanning period (including the scanning periods of the scanning signal lines GLy(3) and GLy(4)), and are also supplied with the data signal with the negative polarity for the n/2-th horizontal scanning period (including the scanning periods of the scanning signal lines GLy(n−1) and GLy(n)). Then, the pulse of the gate signal Gy(1) and the pulse of the gate signal Gy(2) rise simultaneously at the start of the first horizontal scanning period, the pulse of the gate signal Gy(3) and the pulse of the gate signal Gy(4) rise simultaneously at the start of the second horizontal scanning period, and the pulse of the gate signal Gy(n−1) and the pulse of the gate signal Gy(n) rise simultaneously at the start of the n/2-th second horizontal scanning period.

Figure 13:
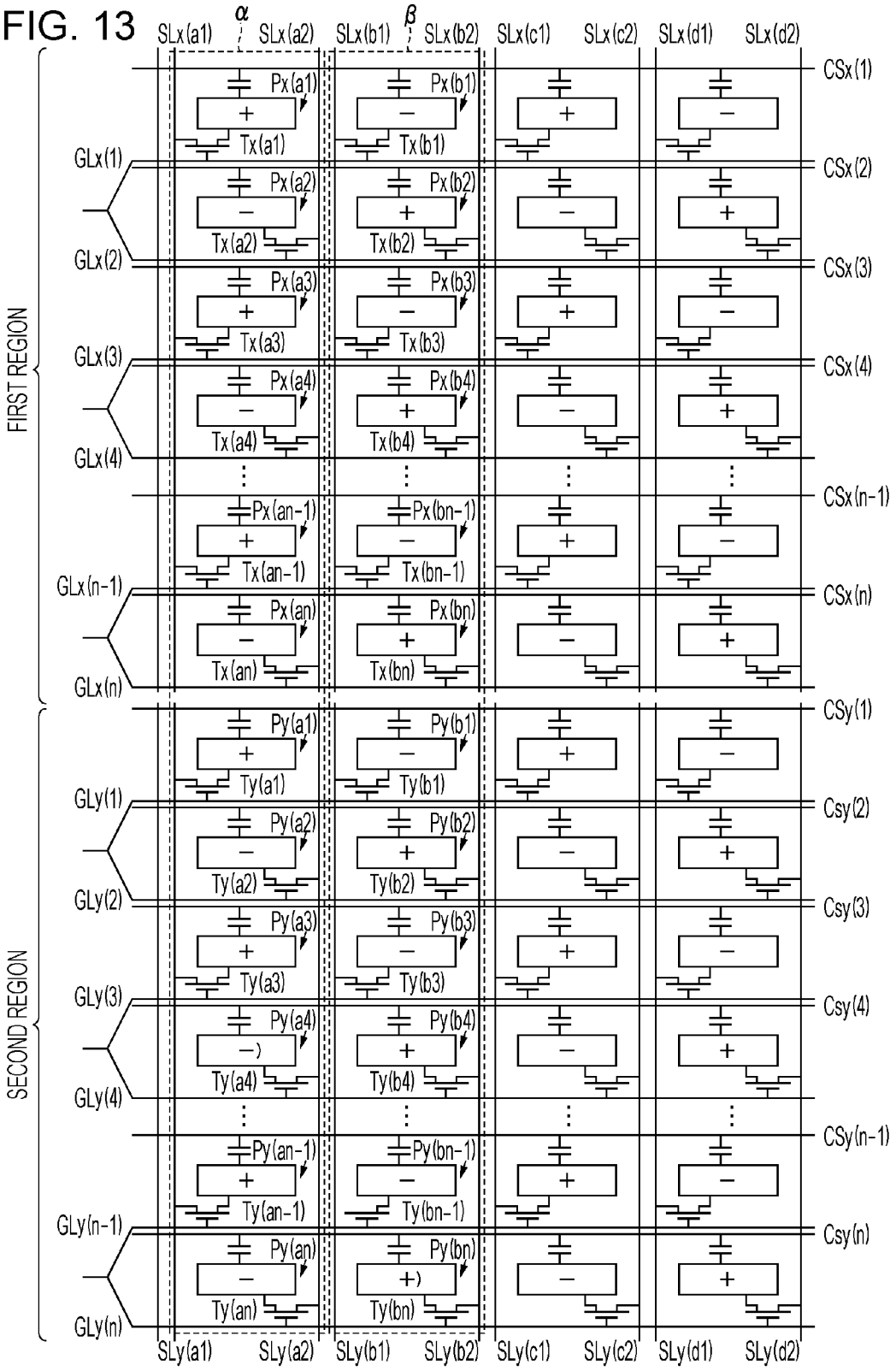
FIG. 13 is a schematic diagram illustrating a display state when the driving method in FIG. 12 is used.

Accordingly, as illustrated in FIG. 13, the positive polarity is written to the pixel electrodes PDx(a1) and PDy(a1), the negative polarity is written to the pixel electrodes PDx(a2) and PDy(a2), the positive polarity is written to the pixel electrodes PDx(a3) and PDy(a3), and the negative polarity is written to the pixel electrodes PDx(a4) and PDy(a4). The positive polarity is written to the pixel electrodes PDx(b1) and PDy(b1), the negative polarity is written to the pixel electrodes PDx(b2) and PDy(b2), the positive polarity is written to the pixel electrodes PDx(b3) and PDy(b3), and the negative polarity is written to the pixel electrodes PDx(b4) and PDy(b4).

In the first-half frame F2*x* of the frame F2 subsequent to the first-half frame Fix of the frame F1, the polarity of the data signal supplied to the data signal line SLx(a1) is inverted from the positive polarity to the negative polarity and the polarity of the data signal supplied to the data signal line SLx(a2) is inverted from the negative polarity to the positive polarity. In the second-half frame F2*y* of the frame F2 subsequent to the second-half frame F1*y* of the frame F1, the polarity of the data signal supplied to the data signal line SLy(a1) is inverted from the positive polarity to the negative polarity and the polarity of the data signal supplied to the data signal line SLy(a2) is inverted from the negative polarity to the positive polarity.

Accordingly, the negative polarity is written to the pixel electrodes PDx(a1) and PDy(a1), the positive polarity is written to the pixel electrodes PDx(a2) and PDy(a2), the negative polarity is written to the pixel electrodes PDx(a3) and PDy(a3), and the positive polarity is written to the pixel electrodes PDx(a4) and PDy(a4). The positive polarity is written to the pixel electrodes PDx(b1) and PDy(b1), the negative polarity is written to the pixel electrodes PDx(b2) and PDy(b2), the positive polarity is written to the pixel electrodes PDx(b3) and PDy(b3), and the negative polarity is written to the pixel electrodes PDx(b4) and PDy(b4).

According to the driving method illustrated in FIG. 12, for example, the potential VPx(n−1) of the pixel electrode PDx(n−1) in a floating state after the writing of the first-half frame Fix deteriorates (is pushed down) due to the parasitic capacitance Csd of the data signal line SLx(a1) by ΔVp from the potential Vsl of the data signal S (the data signal S with the positive polarity corresponding to white) written in the first-half frame Fix at the switching timing of the polarity of the data signal S1 from the positive polarity to the negative polarity (the absolute value of the pixel potential VPx(n−1) (=Vsl−ΔVp) with reference to Vcom<the absolute value of the data signal potential Vsl with reference to Vcom). Further, the potential VPx(n) of the pixel electrode PDx(n) in the floating state after the writing of the first-half frame Fix deteriorates (is pushed up) due to the parasitic capacitance Csd of the data signal line SLx(a2) by ΔVp from the potential Vsl of the data signal S (the data signal S with the negative polarity corresponding to white) written in the first-half frame Fix at the switching timing of the polarity of the data signal S2 from the negative polarity to the positive polarity (the absolute value of the pixel potential VPx(n)

(=Vsl−ΔVp) with reference to Vcom<the absolute value of the data signal potential Vsl with reference to Vcom).

Accordingly, the pixel potentials VPx(n−1) and VPx(n) are "Vsl−ΔVp" across a (n/2−1) horizontal scanning period in the pixel electrodes PDx(an−1) and PDx(an) located at scanning termination end portions of the first region. On the other hand, pixel potentials VPy(1) and VPy(2) are held at Vsl across an n horizontal scanning period in the pixel electrodes PDy(a1) and PDy(a2) located at scanning start end portions of the second region and adjacent to the scanning termination end portions of the first region (the pixel electrodes PDx(an−1) and PDx(an)). Therefore, a difference in luminance corresponding to the maximum ΔVp×(n/2−1) occurs in the boundary portion between the first and second regions per each frame period.

Here, for convenience sake, an effect of a parasitic capacitance formed with a data signal line (another data signal line) not electrically connected to the pixel electrodes between two data signal lines disposed left and right is ignored. The effect of the parasitic capacitance will be described later.

(Correction of Change in Luminance)

The liquid crystal display device 10*b* has a configuration in which the change in the luminance is corrected (reduced). Hereinafter, a configuration for reducing the change in the luminance will be described. In the liquid crystal display device 10*b*, the potentials of the data signals S1 and S2 corresponding to the input video data DAT are corrected to reduce the change in the luminance and corrected data signals S1' and S2' are supplied to the data signal lines SL. The correction of the data signals S1 and S2 is performed at least in the first region. Hereinafter, a case in which the correction is performed in both of the first and second regions are corrected will be described. Since the correction is configured to be corrected in the first and second regions in the same way, the correction of the first region will be described below.

Figure 14:
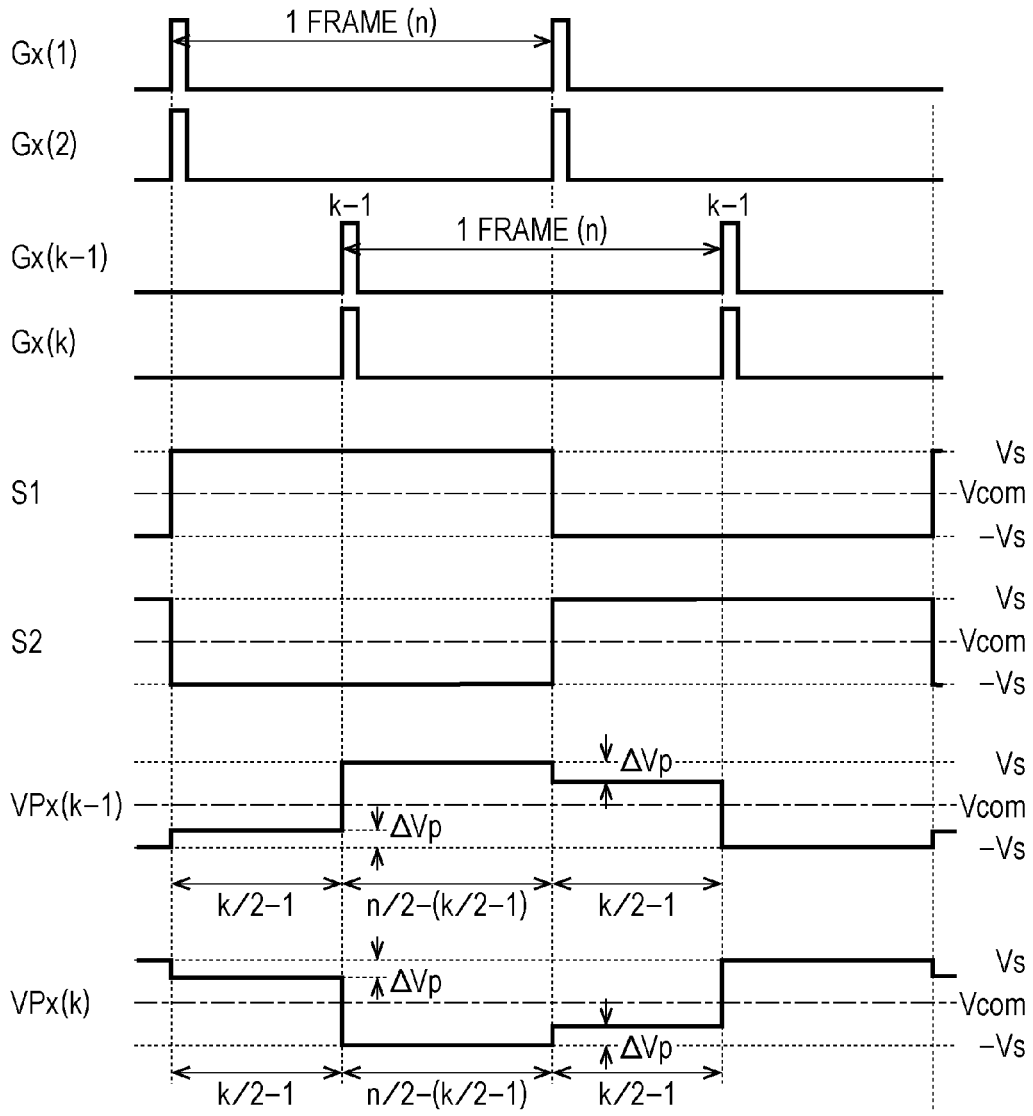
FIG. 14 is a timing chart illustrating a driving method corresponding to pixel electrodes PDx(k−1) and PDx(k) when the data signal is not corrected.
Figure 15:
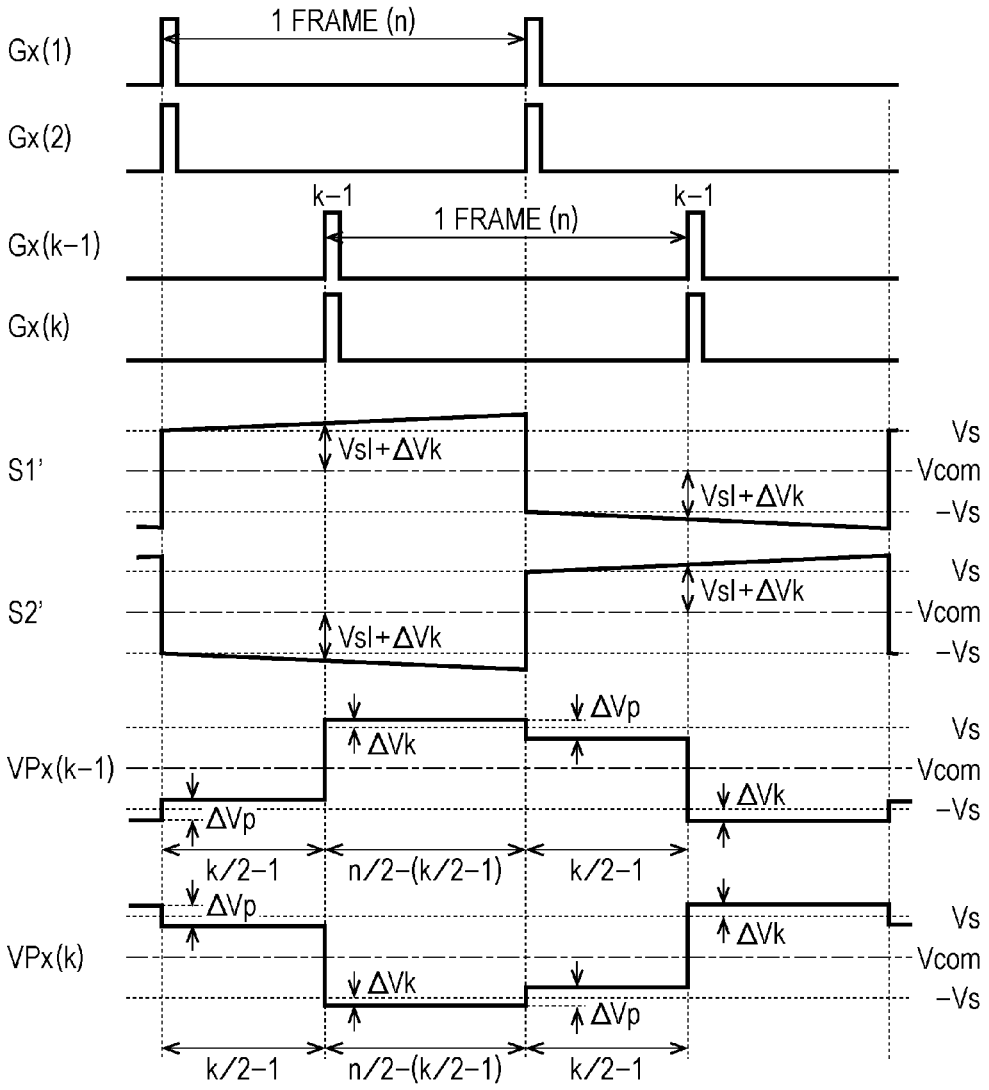
FIG. 15 is a timing chart illustrating a driving method corresponding to the pixel electrodes PDx(k−1) and PDx(k) in a liquid crystal display device according to the second embodiment.

A method of correcting the data signals S will be described with reference to FIGS. 14 and 15. FIG. 14 is a timing chart illustrating a driving method corresponding to pixel electrodes PDx(k−1) and PDx(k) (where k is an even number of "2≤k≤n") when the data signals S are not corrected. FIG. 15 is a timing chart illustrating a driving method corresponding to the pixel electrodes PDx(k−1) and PDx(k) when the data signals S1 and S2 are corrected. S1 indicates data signals supplied to the data signal lines SLx(a1), SLx(b1), and SLx(c1), and so on. S2 indicates data signals supplied to the data signal lines SLx(a2), SLx(b2), and SLx(c2), and so on. S1' indicates corrected data signals supplied to the data signal lines SLx(a1), SLx(b1), and SLx(c1), and so on. S2' indicates corrected data signals supplied to the data signal lines SLx(a2), SLx(b2), and SLx(c2), and so on. Gx(1) and Gx(2) indicate gate signals supplied to the scanning signal lines GLx(1) and GLx(2) simultaneously selected for the first horizontal scanning period. Gx(k−1) and Gx(k) indicate gate signals supplied to the scanning signal lines GLx(k−1) and GLx(k) simultaneously selected for a k/2-th horizontal scanning period. Vpx (k−1) indicates the potential of the pixel electrode PDx(k−1) and Vpx(k) indicates the potential of the pixel electrode PDx(k).

A decrease amount of the potential in the pixel electrodes PDx(k−1) and PDx(k) is assumed to be ΔVp. In the case of FIG. 14, an integrated potential Vp(sum) for one frame period is a value obtained by adding an integrated potential for a period after writing of Vsl and an integrated potential for a decrease period of the potential:

the integrated potential for the period after the writing=$Vsl\times(n/2-(k/2-1))$;

the integrated potential for a decrease period of potential=$(Vsl-\Delta Vp)\times(k/2-1)$; and $$Vp(\text{sum})=Vsl\times(n/2-(k/2-1))+(Vsl-\Delta Vp)\times(k/2-1)=Vsl\times n/2-\Delta Vp\times(k/2-1).$$

From the above equation, it can be understood that the integrated potential Vp(sum) for one frame period is decreased by "ΔVp×(k/2−1)" from the integrated potential (Vsl×n/2) for the original one frame period. Due to the decrease amount, an image is viewed as the gradation image illustrated in FIG. 29.

Accordingly, in the liquid crystal display device 10*b* according to the embodiment, the potential decrease amount (ΔVp×(k/2−1)) for one frame period is converted (averaged) into a potential decrease amount ΔV(k) per horizontal scanning period, and the converted value is added to the potential of the data signal S for each horizontal scanning period in a subsequent frame. ΔV(k) can be expressed as in the following equation:

$$\Delta V(k)=\Delta Vp\times(k/2-1)\times 2/n.$$

In addition, the potentials Vsl of the data signals S1 and S2 are corrected to potentials Vsl'(k) of the data signals S1' and S2' expressed as follows:

$$Vsl'(k)=Vsl+\Delta V(k)=Vsl+\Delta Vp\times(k/2-1)\times 2/n.$$

In the case of FIG. 15, the integrated potential Vp(sum) of one frame period is expressed as follows:

the integrated potential for the period after the writing=$(Vsl+\Delta Vk)\times(n/2-(k/2-1))$, the integrated potential for the decrease period of the potential=$(Vsl+\Delta Vk-\Delta Vp)\times(k/2-1)$, and $$Vp(\text{sum})=(Vsl+\Delta V(k))\times(n/2-(k/2-1))+(Vsl+\Delta V(k)-\Delta Vp)\times(k/2-1).$$

According to the foregoing equation, it can be understood that the integrated potential Vp(sum) for one frame period is the same as the integrated potential "Vsl×n/2" for the original one frame period. Therefore, by correcting the data signals S1 and S2 to S1' and S2', the luminance for one frame period can be averaged.

A potential amount added to the potential of the data signal of the current frame is calculated based on the potential decrease amount (ΔVp) of the data signal of the previous frame (immediately previous frame). However, since the immediately previous frame is used, reliability of the display quality does not deteriorate.

Figure 16:
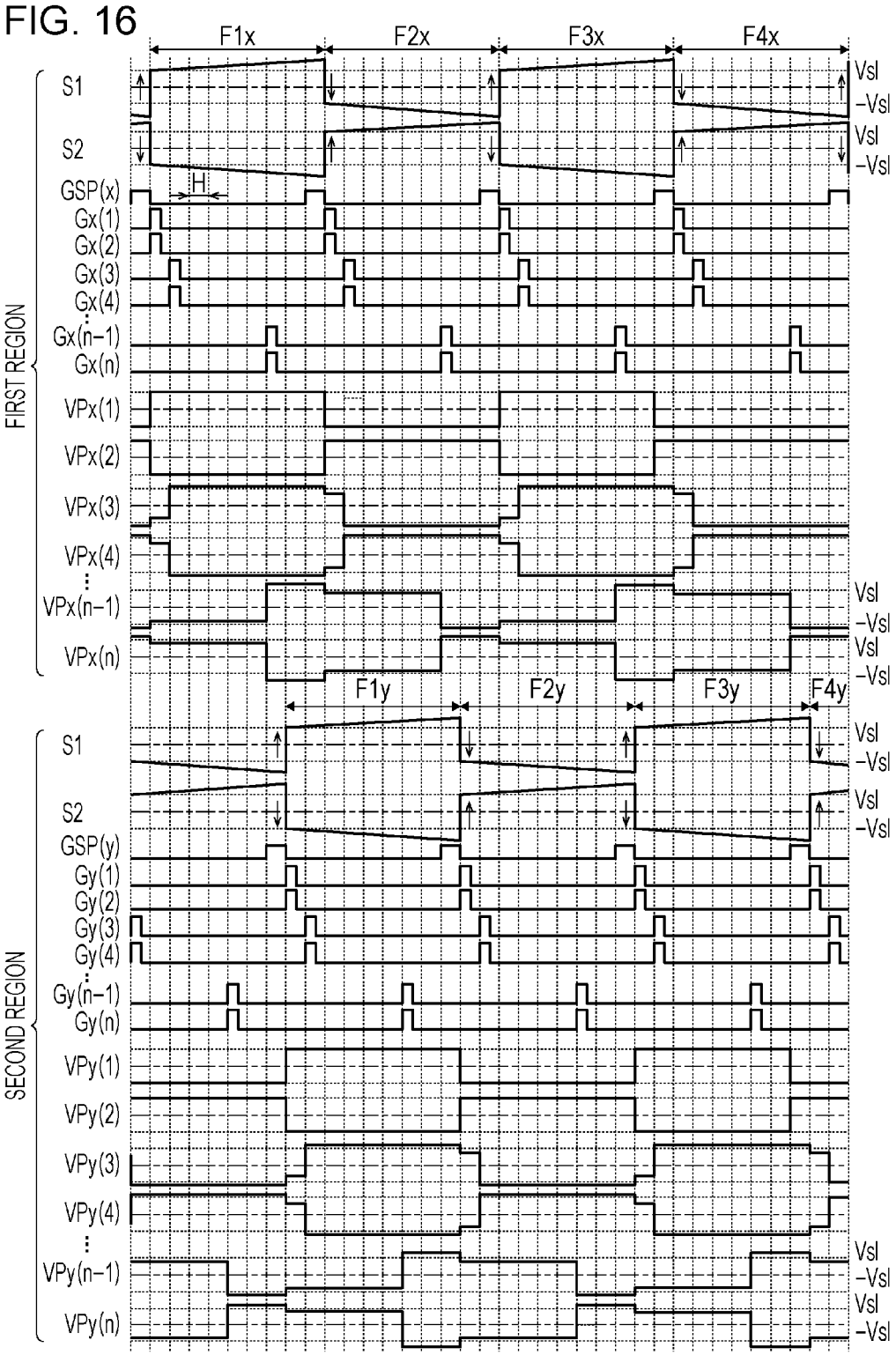
FIG. 16 is a timing chart illustrating a method of driving the liquid crystal display device according to the second embodiment.

FIG. 16 is a timing chart illustrating a method of driving the liquid crystal display device 10*b* and corresponding to FIG. 15. In FIG. 16, a dotted line shown in the potential VP of each pixel electrode PD indicates the original potentials Vsl and −Vsl of the data signal. As illustrated in FIG. 16, the potentials of the data signals S1' and S2' supplied to the data signal lines are increased from the scanning start end portion to the scanning termination end portion. Thus, the decrease amount of the potential after the writing to the pixel electrode PD is compensated. That is, in the pixel electrodes PD(n−1) and PD(n) which are the termination portions in the scanning direction, the decrease amount of the potential for one frame period is the maximum. Therefore, the potentials of the data signals written to the pixel electrodes PDx(n−1), PDx(n), PDy(n−1), and PDy(n) for the n/2-th horizontal scanning period is also the maximum.

According to the foregoing driving method, since the average display luminance for one frame period can be set to be the same in the respective pixels in the first and second regions, the display image illustrated in FIG. 28(*a*) can be displayed.

Thus, in the liquid crystal display device 10*b*, the change in the luminance occurring between the first and second regions can be reduced by correcting the potential of the data signal supplied to the data signal line SLx according to a distance from the scanning start end portion. Further, to reduce the change in the luminance occurring in the boundary portion between the first and second regions, the foregoing correction process (the foregoing driving method) may be performed at least in the first region, as in the liquid crystal display device 10*a* of the first embodiment. When the foregoing correction process is performed only in the first region, a display image illustrated in FIG. 7 can be obtained. In the display image in FIG. 7, the change in the luminance is continuous in the scanning direction in the second region. Therefore, since the change in the luminance can be suppressed even in the case of FIG. 28(*b*), the display quality is not considerably affected at a visual level.

Further, since the potentials of the data signals can simultaneously be written to two pixels adjacent in the column direction in the liquid crystal display device 10*b*, a screen rewrite speed can be increased, and thus a charging time of each pixel can be increased.

Here, in each pixel electrode, a parasitic capacitance is also formed between the pixel electrode and a data signal line (the other data signal line) which is not electrically connected between two data signal lines disposed right and left. For example, in the pixel electrode PDx(a3), a parasitic capacitance is also formed between the pixel electrode and the data signal line SLx(a2) which is not electrically connected. Accordingly, since each pixel electrode is affected by the parasitic capacitance occurring between the pixel electrode and the other data signal line, a variation amount of potential of the data signal is preferably calculated considering (subtracting) two parasitic capacitances occurring between the pixel electrode and two adjacent data signal lines (one data signal line and the other data signal line). Here, for example, when the effect of the parasitic capacitance occurring between a pixel electrode and the other data signal line (data signal line SLx(a2)) is greater than the effect of the parasitic capacitance occurring between the pixel electrode and the one data signal line (data signal line SLx(a1)), the integrated potential for one frame period is higher than the original integrated potential (Vsl×n) in some cases. Specifically, for example, a case in which black data is supplied to one data signal line and white data (with polarity opposite to that of the black data) is supplied to the other data signal line will be assumed. In this case, since the effect of a variation in the potential caused by the one data signal line is greater than the effect of a variation in the potential by the other data signal line, as illustrated in FIG. 8 in the first embodiment, the potential of the data signal is corrected in each frame such that the potential is decreased (approaches the center potential) continuously from the original potential from the frame start time point to the frame end time point. Accordingly, the change in the luminance occurring in the boundary portion between the first and second regions can be suppressed. In this case, when n (where n is an integer equal to or greater than 1) scanning signal lines are installed in the first region, the potential of the data signal corresponding to a video signal input from the outside is assumed to be Vsl, and the potential amount of the potential of the pixel electrode increased by inverting the polarity of the data signal is ΔVph, a correction potential Vsl'(k) of the data signal supplied to each data signal line in the first region for a k-th (where k is an integer equal to or greater than 1 and equal to or less than n) horizontal scanning period is expressed as in:

$$Vsl'(k)=Vsl-\Delta Vph\times(k/2-1)\times 2/n.$$

(Configuration of Data Correction Circuit)

Next, a configuration of the liquid crystal display device 10*b* performing the foregoing correction process (the foregoing driving method) will be described.

The first display control circuit 20*x* (see FIG. 2) of the liquid crystal display device 10*b* includes a data correction circuit 21*x* that corrects the video data DAT(x) and the second display control circuit 20*y* (see FIG. 2) includes a data correction circuit 21*y* that corrects the video data DAT(y). The data correction circuits 21*x* and 21*y* have the same configuration. The liquid crystal display device 10*b* includes only the data correction circuit 21*x* in a configuration in which the foregoing correction process is performed only in the first region and includes both of the data correction circuits 21*x* and 21*y* in a configuration in which the foregoing correction process is performed in both of the first and second regions. In the configuration in which the foregoing correction process is performed in both of the first and second regions, one data correction circuit may be installed outside the first display control circuit 20*x* and the second display control circuit 20*y*.

The specific configuration of the data correction circuit 21*x* is the same as that of the data correction circuit 21*x* of the first embodiment illustrated in FIG. 9. Hereinafter, differences from the data correction circuit 21*x* according to the first embodiment will be described.

The average voltage calculation unit 212*x* performs a process of updating the average source voltage by integrating data (source voltages) corresponding to one frame. The average voltage calculation unit 212*x* discards the old data when new data is integrated. When the new data is read using a line memory for each data signal line and the integration is repeated while discarding the old data, data becomes more accurate. However, since a frame memory is necessary to do so, it is not preferable to do so. Accordingly, in the embodiment, for example, when Vk (where k=1 to n) is input, the current average source voltage is discarded as in "sum(Vk)←sum (Vk−1)+Vk−sum(Vk−1)×2/n." Accordingly, a time lag occurs between the true average source voltage and the calculated value. However, when 500 pieces of data are integrated during one frame, there is not so much difference as an average value in a video stable although about 100 pieces of data are delayed. In a video in which a motion is large to the degree that this has an effect, the problem of the change in the luminance is not actualized.

Based on the average source voltage acquired from the average voltage calculation unit 212*x*, the maximum correction value calculation unit 214*x* calculates the maximum correction amount (maximum correction value) in one frame, referring to the second LUT 215*x*. Here, as illustrated in FIG. 12 and FIG. 14, the polarities of the data signals S immediately after the writing of the potential Vsl of the data signal are switched in the pixel electrodes PDx(n−1) and PDx(n) which are the termination portions in the scanning direction, and thus the pixel potentials VPx(n−1) and VPx(n) are decreased by "Vsl−ΔVp" from Vsl. Since the decreased pixel potential VPx(n) (=Vsl−ΔVp) is held only for a (n/2−1) horizontal scanning period from the first horizontal scanning period to the (n/2−1)-th horizontal scanning period, the maximum correction value corresponding to one frame is calculated as "ΔVp×(n/2−1)." That is, in the pixel electrodes PDx(k−1) and PDx(k), the maximum correction value corresponding to one frame is calculated as "ΔVp×(k/2−1)."

The decrease amount ΔVp of the pixel potential can be calculated in advance based on characteristics or the like of the liquid crystal panel such as gradation of the source voltage and the parasitic capacitance Csd. The decrease amount ΔVp can also be calculated using a frame memory based on the average source voltage of the immediately previous frame or a frame before the immediately previous frame and the decreased pixel potential.

In the second LUT 215*x*, the gradation (input gradation) corresponding to the average source voltage can be matched in advance with the gradation (output gradation) corresponding to the maximum correction value calculated in the foregoing equation. The maximum correction value calculation unit 214*x* provides the calculated maximum correction value to the position correction unit 217*x*.

The correction position counter unit 216*x* specifies a target horizontal scanning period (position) based on the video data DAT(x) acquired from the video data input unit 211*x* and the horizontal synchronization signal HSYNC(x) input from the tuner 40 and provides information regarding the specified position to the position correction unit 217*x*.

The position correction unit 217*x* corrects the video data DAT(x) corresponding to the target horizontal scanning period based on the maximum correction value acquired from the maximum correction value calculation unit 214*x* and the information regarding the position acquired from the correction position counter unit 216*x*. Specifically, a correction value ΔV(k) of the data signal S corresponding to a k/2-th horizontal scanning period is calculated using the following equation:

$$\text{correction value } \Delta V(k)=\Delta Vp\times(k/2-1)\times 2/n.$$

The position correction unit 217*x* adds the calculated correction value ΔV(k) to the potential of the data signal S corresponding to the video data DAT(x). Accordingly, the potential Vsl' of the data signal S' after the correction can be expressed as in an equation:

$$Vsl'=Vsl+\Delta V(k)=Vsl+\Delta Vp\times(k/2-1)\times 2/n.$$

The foregoing corrected data signal S' is input to the video data output unit 218*x*. The video data output unit 218*x* supplies the data signal S' to the first source driver SDx via a timing controller (not illustrated) at a predetermined timing.

In the embodiment, as described above, when at least the boundary portion between the first and second regions is suitably corrected, continuous correction can be realized in other regions. Thus, to simplify the process, the LUT may also be used or a table such as a logarithmic table assisting the calculation may be used together. Further, n may be set as a numerical value (power-of-two or the like) easy in the calculation and k may be corrected to be 1 collectively in the scanning termination portion in conformity with the correction of n.

Here, since the effect of the adjacent data signal lines SLx(a2) can be calculated numerically as in the data signal lines SLx(a1), both of the correction amounts may be deducted and a correction amount may be determined. Therefore, each correction amount may be calculated up to the final stage, or a factor (−1 to 1) used to further correct the correction amount may be calculated and multiplied in comparison to both of the average source voltages. Further, when the parasitic capacitance Csd in both of the data signal lines SLx(a1) and SLx(a2) is changed, an LUT for calculation of the correction amount may be prepared and the correction amount may be deducted finally according to the change in the parasitic capacitance.

In this manner, it is possible to suppress the effect of the change in the luminance indicating the relatively complex behavior, to a minimum, with the least amount of resources.

Third Embodiment

A third embodiment of the invention will be described below with reference to the drawings. To facilitate the description, the same reference numerals are given to members having the same functions as the members indicated in the foregoing first and second embodiments, and the description thereof will be omitted. The terms defined in the first and second embodiments are used also in the embodiment according to the definition, as long as the terms are particularly rejected.

The resolution of a current high-definition television (HDTV) broadcast is horizontal 1920 pixels×vertical 1080 pixels (so-called 2K1K; hereinafter, this resolution is also referred to as a full-HD resolution). Video standards of four times resolution (so-called 4K2K) and 16 times resolution (so-called 8K4K; a kind of super high-vision (SHV)) of the full-HD resolution have been proposed.

Figure 17:
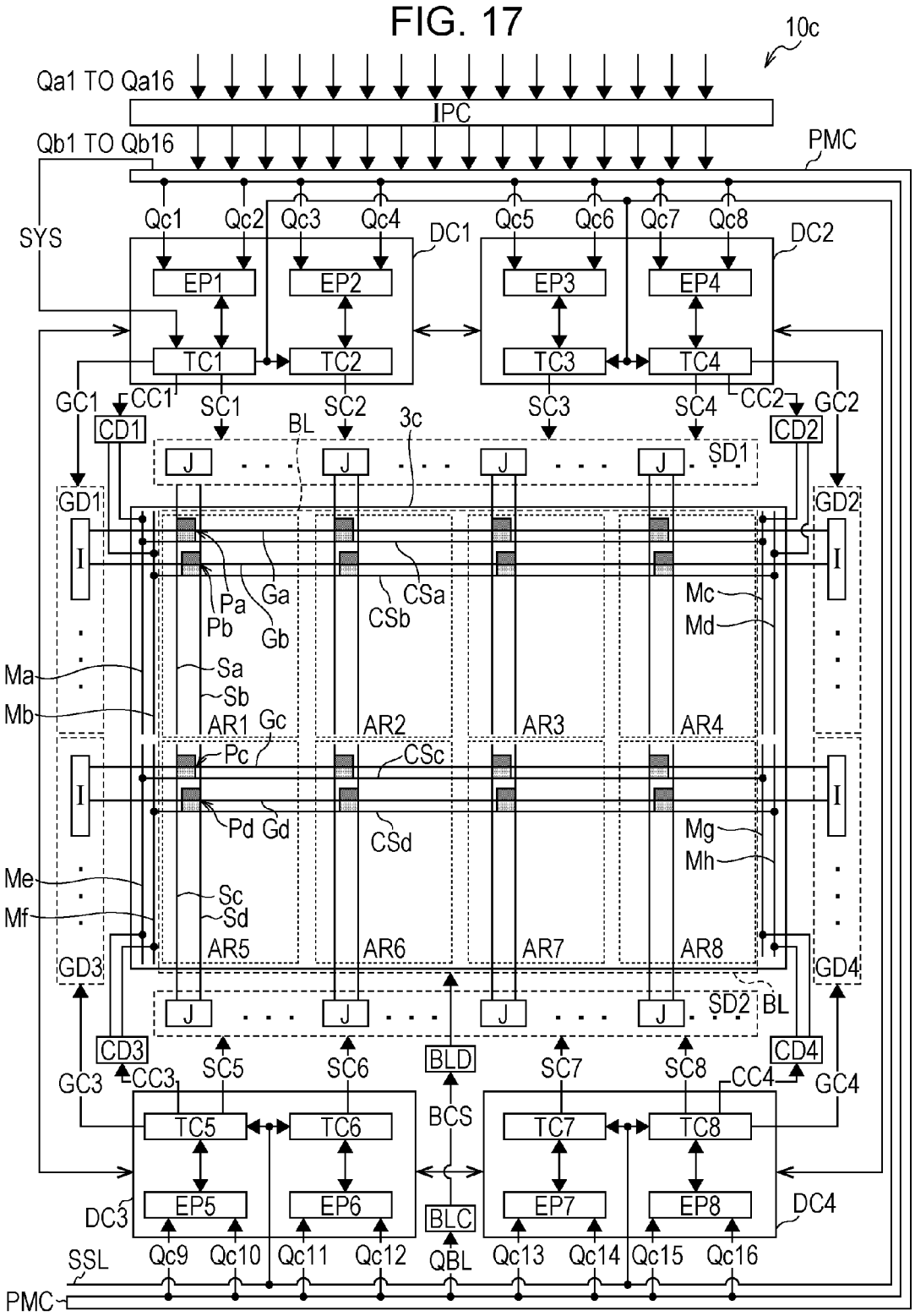
FIG. 17 is a block diagram illustrating a schematic configuration of a liquid crystal display device according to a third embodiment.

A liquid crystal display device 10*c* according to the embodiment corresponds to the video standard (for example, a super high-vision of the resolution of horizontal 7680 pixels×vertical 4320 pixels) of a resolution (8K4K) of 16 times the full-HD resolution. As illustrated in FIG. 17, the liquid crystal display device 10*c* includes an input processing circuit IPC, a pixel mapping circuit PMC, four display control substrates (timing controller substrates) DC1 to DC4, a liquid crystal panel 3*c*, four gate drivers GD1 to GD4, two source drivers SD1 and SD2, four CS drivers CD1 to CD4, three power devices (not illustrated) connected to different commercial power supplies, a power controller (not illustrated), a backlight BL, a backlight driver BLD, and a backlight controller BLC.

A video signal input to the input processing circuit IPC may be a video signal (for example, a super high-vision) having the 8K4K resolution of a block scan format or may be a video signal having an 8K4K resolution of a multi-display format. Of course, the video signal may be a video signal having a 4K2K resolution or may be a video signal having a 2K1K resolution (full-HD resolution).

The block scan format is a scheme of dividing one frame (a whole image having the 8K4K resolution) into 16 whole images (so-called thinned images) of a rough texture (of the full-HD resolution) and transmitting the images. In this case, each of 16 video signals Qa1 to Qa16 input to the input processing circuit IPC becomes a whole image (full-HD resolution) of a rough texture.

The multi-display format is a scheme of dividing one frame (a whole image having the 8K4K resolution) into 16 partial images without change in fineness of a texture and transmitting the 16 partial images. In this case, each of 16 video signals Qa1 to Qa16 input to the input processing circuit IPC becomes a partial image (full-HD resolution) of a fine texture.

The input processing circuit IPC performs a video data synchronization process of, a 7 correction process, a color temperature correction process, a color gamut conversion process, or the like and outputs video signals Qb1 to Qb16 to the pixel mapping circuit PMC.

Here, the display control substrate DC1 includes two video processing circuits EP1 and EP2 and two timing controllers TC1 and TC2. The display control substrate DC2 includes two video processing circuits EP3 and EP4 and two timing controllers TC3 and TC4. The display control substrate DC3 includes two video processing circuits EP5 and EP6 and two timing controllers TC5 and TC6. The display control substrate DC4 includes two video processing circuits EP7 and EP8 and two timing controllers TC7 and TC8. The video processing circuits EP1 to EP4 correspond to the data correction circuit 21*x* in FIG. 2 in the first and second embodiments. The video processing circuits EP5 to EP8 correspond to the data correction circuit 21*y* in FIG. 2 in the first and second embodiments. Specific configurations of the data correction circuits 21*x* and 21*y* are the same in the first and second embodiments (see FIG. 9).

The pixel mapping circuit PMC divides a video signal (resolution of 2K2K) corresponding to a left half AR1 of a first region (an upper left region when the liquid crystal panel 3*c* is divided into four regions vertically and horizontally) into two signals (video signals Qc1 and Qc2 of the full-HD resolution) and outputs the two signals to the video processing circuit EP1 of the display control substrate DC1; divides a video signal (resolution of 2K2K) corresponding to a right half AR2 of the first region into two signals (video signals Qc3 and Qc4 of the full-HD resolution) and outputs the two signals to the video processing circuit EP2 of the display control substrate DC1; divides a video signal (resolution of 2K2K) corresponding to a left half AR3 of a second region (an upper right region when the liquid crystal panel 3*c* is divided into four regions vertically and horizontally) into two signals (video signals Qc5 and Qc6 of the full-HD resolution) and outputs the two signals to the video processing circuit EP3 of the display control substrate DC2; divides a video signal (resolution of 2K2K) corresponding to a right half AR4 of the second region into two signals (video signals Qc7 and Qc8 of the full-HD resolution) and outputs the two signals to the video processing circuit EP4 of the display control substrate DC2; divides a video signal (resolution of 2K2K) corresponding to a left half AR5 of a third region (a lower left region when the liquid crystal panel 3*c* is divided into four regions vertically and horizontally) into two signals (video signals Qc9 and Qc10 of the full-HD resolution) and outputs the two signals to the video processing circuit EP5 of the display control substrate DC3; divides a video signal (resolution of 2K2K) corresponding to a right half AR6 of the third region into two signals (video signals Qc11 and Qc12 of the full-HD resolution) and outputs the two signals to the video processing circuit EP6 of the display control substrate DC3; divides a video signal (resolution of 2K2K) corresponding to a left half AR7 of a fourth region (a lower right region when the liquid crystal panel 3*c* is divided into four regions vertically and horizontally) into two signals (video signals Qc13 and Qc14 of the full-HD resolution) and outputs the two signals to the video processing circuit EP7 of the display control substrate DC4; and divides a video signal (resolution of 2K2K) corresponding to a right half AR8 of the fourth region into two signals (video signals Qc15 and Qc16 of the full-HD resolution) and outputs the two signals to the video processing circuit EP8 of the display control substrate DC4.

The pixel mapping circuit PMC outputs synchronization signal SYS (a vertical synchronization signal, a horizontal synchronization signal, a clock signal, a data enable signal, a polarity inversion signal, or the like) to the timing controller TC1 of the display control substrate DC1. The timing controller TC1 receiving the synchronization signal SYS transmits the synchronization signal SYS to an inter-substrate sharing line SSL connected to the display control substrates DC1 to DC4.

The timing controller TC1 receives the synchronization signal SYS received from the pixel mapping circuit PMC and performs video processing such as a gray-scale conversion process or a frame rate conversion (FRC) process on the video signals Qc1 and Qc2 in cooperation with the video processing circuit EP1. Thereafter, the timing controller TC1 outputs a source control signal SC1 to a source driver substrate (not illustrated) corresponding to the AR1, outputs a gate control signal GC1 to a gate driver substrate (not illustrated) of the gate driver GD1, and outputs a CS control signal CC1 to the CS driver CD1.

The timing controller TC2 receives the synchronization signal SYS transmitted from the timing controller TC1 via the inter-substrate sharing line SSL and performs the video processing on the video signals Qc3 and Qc4 in cooperation with the video processing circuit EP2. Thereafter, the timing controller TC2 outputs a source control signal SC2 to a source driver substrate (not illustrated) corresponding to the AR2.

The timing controller TC3 receives the synchronization signal SYS transmitted from the timing controller TC1 via the inter-substrate sharing line SSL and performs the video processing on the video signals Qc5 and Qc6 in cooperation with the video processing circuit EP3. Thereafter, the timing controller TC3 outputs a source control signal SC3 to a source driver substrate (not illustrated) corresponding to the AR3.

The timing controller TC4 receives the synchronization signal SYS transmitted from the timing controller TC1 via the inter-substrate sharing line SSL and performs the video processing on the video signals Qc7 and Qc8 in cooperation with the video processing circuit EP4. Thereafter, the timing controller TC4 outputs a source control signal SC4 to a source driver substrate (not illustrated) corresponding to the AR4, outputs a gate control signal GC2 to a gate driver substrate (not illustrated) of the gate driver GD2, and outputs a CS control signal CC2 to the CS driver CD2.

The timing controller TC5 receives the synchronization signal SYS transmitted from the timing controller TC1 via the inter-substrate sharing line SSL and performs the video processing on the video signals Qc9 and Qc10 in cooperation with the video processing circuit EP5. Thereafter, the timing controller TC5 outputs a source control signal SC5 to a source driver substrate (not illustrated) corresponding to the AR5, outputs a gate control signal GC3 to a gate driver substrate (not illustrated) of the gate driver GD3, and outputs a CS control signal CC3 to the CS driver CD3.

The timing controller TC6 receives the synchronization signal SYS transmitted from the timing controller TC1 via the inter-substrate sharing line SSL and performs the video processing on the video signals Qc11 and Qc12 in cooperation with the video processing circuit EP6. Thereafter, the timing controller TC6 outputs a source control signal SC6 to a source driver substrate (not illustrated) corresponding to the AR6.

The timing controller TC7 receives the synchronization signal SYS transmitted from the timing controller TC1 via the inter-substrate sharing line SSL and performs the video processing on the video signals Qc13 and Qc14 in cooperation with the video processing circuit EP7. Thereafter, the timing controller TC7 outputs a source control signal SC7 to a source driver substrate (not illustrated) corresponding to the AR7.

The timing controller TC8 receives the synchronization signal SYS transmitted from the timing controller TC1 via the inter-substrate sharing line SSL and performs the video processing on the video signals Qc15 and Qc16 in cooperation with the video processing circuit EP8. Thereafter, the timing controller TC8 outputs a source control signal SC8 to a source driver substrate (not illustrated) corresponding to the AR8, outputs a gate control signal GC4 to a gate driver substrate (not illustrated) of the gate driver GD4, and outputs a CS control signal CC4 to the CS driver CD4.

The source control signals SC1 to SC8 include a data signal, a data enable signal (DE signal), a source start pulse, and a source clock. The gate control signals GC1 to GC4 includes an initial signal, a gate start pulse, and a gate clock.

Here, the gray-scale conversion process may include a high-speed display process (QS process) and a gray-scale correction process (the correction process of the second embodiment) corresponding to a combination of the screen division driving (upper and lower division driving) and the 1 V inversion driving of the data signal lines and performed according to a pixel position (position in the column direction).

In the foregoing FRC process, each video processing circuit may calculate a motion vector using any one (a whole image of a rough texture which has the full-HD resolution) of the 16 video signals Qa1 to Qa16 and may generate a partial image (full-HD resolution) for interpolation using one corresponding video signal (a partial image of a fine texture which has the full-HD resolution) among the video signals Qc1 to Qc16.

When an HDMI (high-definition multimedia interface registered trademark) of 12-bit transmission is used at the time of the input of the video signals Qc1 to Qc16, an error may occur in that the DE signal (of 1920 lines) may extend before one clock (corresponding to one line) and have 1921 lines. Therefore, the width of the DE signal may be monitored and an error correction process of starting the DE signal by delaying one clock may be performed when the DE signal has 1921 lines.

The display control substrates DC1 to DC4 synchronize mutual operations by exchanging or sharing various signals between the substrates. Specifically, the display control substrate DC1 serving as a master transmits an RDY (preparation completion) signal to the display control substrate DC2 serving as a slave. The display control substrate DC2 receiving the RDY signal transmits the RDY signal to the display control substrate DC3 serving as a slave as soon as the preparation is completed. The display control substrate DC3 receiving the RDY signal transmits the RDY signal to the display control substrate DC4 serving as a slave as soon as the preparation is completed. The display control substrate DC4 receiving the RDY signal transmits the RDY signal to the display control substrate DC1 as soon as the preparation is completed.

The display control substrate DC1 receives the returned RDY signal and concurrently transmits an operation start (SRST) signal to the display control substrates DC2 to DC4 via the inter-substrate sharing line SSL. After the operation start (SRST) signal is transmitted, the timing controller TC1 of the display control substrate DC1 concurrently transmits the synchronization signal SYS received from the pixel mapping circuit PMC to the display control substrates DC1 to DC4 (the timing controllers TC2 to TC8 included in the display control substrates DC1 to DC4) via the inter-substrate sharing line SSL.

When an abnormality occurs in one control substrate during the operation of the display control substrates DC1 to DC4, a fail-safe signal transmitted from the display control substrate in which the abnormality occurs is received by all of the other display control substrates, and thus all of the control display substrates instantly enter a self-state (black display) mode. Accordingly, video breakdown is avoided.

In each of the display control substrates DC1 to DC4, various kinds of driving powers are individually generated and lines supplied with the same kind (the same potential or the same phase) of driving power are connected between the display control substrates via a current-limit circuit. By doing this, adjustment of the same kind of driving power is achieved and an overcurrent can be prevented from flowing in various drivers or display control substrate due to, for example, a deviation in a rise timing between the substrates.

The liquid crystal panel 3*c* includes an active matrix substrate, a liquid crystal layer (not illustrated), and a counter substrate (not illustrated). A plurality of pixel electrodes (not illustrated), a plurality of TFTs (thin film transistors not illustrated), scanning signal lines Ga to Gd extending the row direction (which is a direction along the longer side of the panel), a plurality of data signal lines Sa to Sd extending in the column direction, holding capacitance wirings (CS wirings) CSa to CSd extending in the row direction, and inter-CS wirings Ma to Mh extending in the column direction are installed in the active matrix substrate. A common electrode (not illustrated), a color filter, and a back matrix (not illustrated) are installed in the counter substrate.

The liquid crystal panel 3*c* has a so-called upper and lower division double source configuration (a configuration in which four data signal lines are installed near one pixel column and four scanning signal lines can simultaneously be selected) in which two data signal lines are installed in correspondence with the upper half (the first region and the upstream side of the panel) of one pixel column and two data signal lines are installed in correspondence with the lower half (the second region and the downstream side of the panel) of the pixel column. The liquid crystal panel 3*c* has a configuration suitable for ultra-high definition display or high-speed display such as 4 times speed driving in that a 4-fold writing time can be ensured compared to a normal panel configuration. Further, in the liquid crystal panel 3*c*, a so-called multi-pixel scheme in which at least two pixel electrodes are formed in one pixel is used and viewing angle characteristics can be improved due to a bright region and a dark region formed within one pixel.

For example, as illustrated in FIGS. 17 to 24, scanning signal lines Ga and Gb and holding capacitance wirings CSa and CSb are installed in the upper half (upstream side) of the panel, and scanning signal lines Gc and Gd and holding capacitance wirings CSc and CSd are installed in the lower half (downstream side) of the panel. The upper half (upstream side) of one pixel column α includes two pixels Pa and Pb adjacent to each other in the column direction and the lower half (downstream side) of the pixel column α includes two pixels Pc and Pd adjacent to each other in the column direction. The data signal lines Sa and Sb are installed in correspondence with the upper half (upstream side) of the pixel column α and the data signal lines Sc and Sd are installed in correspondence with the lower half (downstream side) of the pixel column α.

Of two pixel electrodes 17A and 17*a* included in the pixel Pa, a transistor (TFT) 12A connected to the pixel electrode 17A and a transistor 12*a* connected to the pixel electrode 17*a* are connected to the data signal line Sa and the scanning signal line Ga, respectively, the pixel electrode 17A forms a holding capacitance wiring CSn and a holding capacitor CA, and the pixel electrode 17*a* forms the holding capacitance wiring CSa and a holding capacitor Ca. Of two pixel electrodes 17B and 17*b* included in the pixel Pb, a transistor 12B connected to the pixel electrode 17B and a transistor 12*b* connected to the pixel electrode 17*b* are connected to the data signal lines Sb and the scanning signal line Gb, respectively, the pixel electrode 17B forms the holding capacitance wiring CSa and a holding capacitor CB, and the pixel electrode 17*b* forms the holding capacitance wiring CSb and a holding capacitor Cb. Of two pixel electrodes 17C and 17*c* included in the pixel Pc, a transistor 12C connected to the pixel electrode 17C and a transistor 12*c* connected to the pixel electrode 17*c* are connected to the data signal line Sc and the scanning signal line Gc, respectively, the pixel electrode 17C forms the holding capacitance wiring CSm and a holding capacitor CC, and the pixel electrode 17*c* forms the holding capacitance wiring CSc and a holding capacitor Cc. Of two pixel electrodes 17D and 17*d* included in the pixel Pd, a transistor 12D connected to the pixel electrode 17D and a transistor 12*d* connected to the pixel electrode 17*d* are connected to the data signal line Sd and the scanning signal line Gd, respectively, the pixel electrode 17D forms the holding capacitance wiring CSc and a holding capacitor CD, and the pixel electrode 17*d* forms the holding capacitance wiring CSd and a holding capacitor Cd. Thus, the four scanning signal lines Ga to Gd are simultaneously selected.

In the pixel column α, the signal lines Sa and Sc are arranged to line up in the column direction at the left end and the data signal lines Sb and Sd are arranged to line up in the column direction at the right end. In the pixel column β adjacent to the pixel column α, the data signal lines SA and SC are arranged to line up in the column direction at the left end and the data signal lines SB and SD are arranged to line up in the column direction at the right end.

In the pixel column β, two pixel electrodes included in a pixel adjacent to the pixel electrode Pa are connected to the data signal SB via different transistors, two pixel electrodes included in a pixel adjacent to the pixel electrode Pb are connected to the data signal line SA via different transistors, two pixel electrodes included in a pixel adjacent to the pixel electrode Pc are connected to the data signal line SD via different transistors, and two pixel electrodes included in a pixel adjacent to the pixel electrode Pd are connected to the data signal line SC via different transistors.

Figure 19:
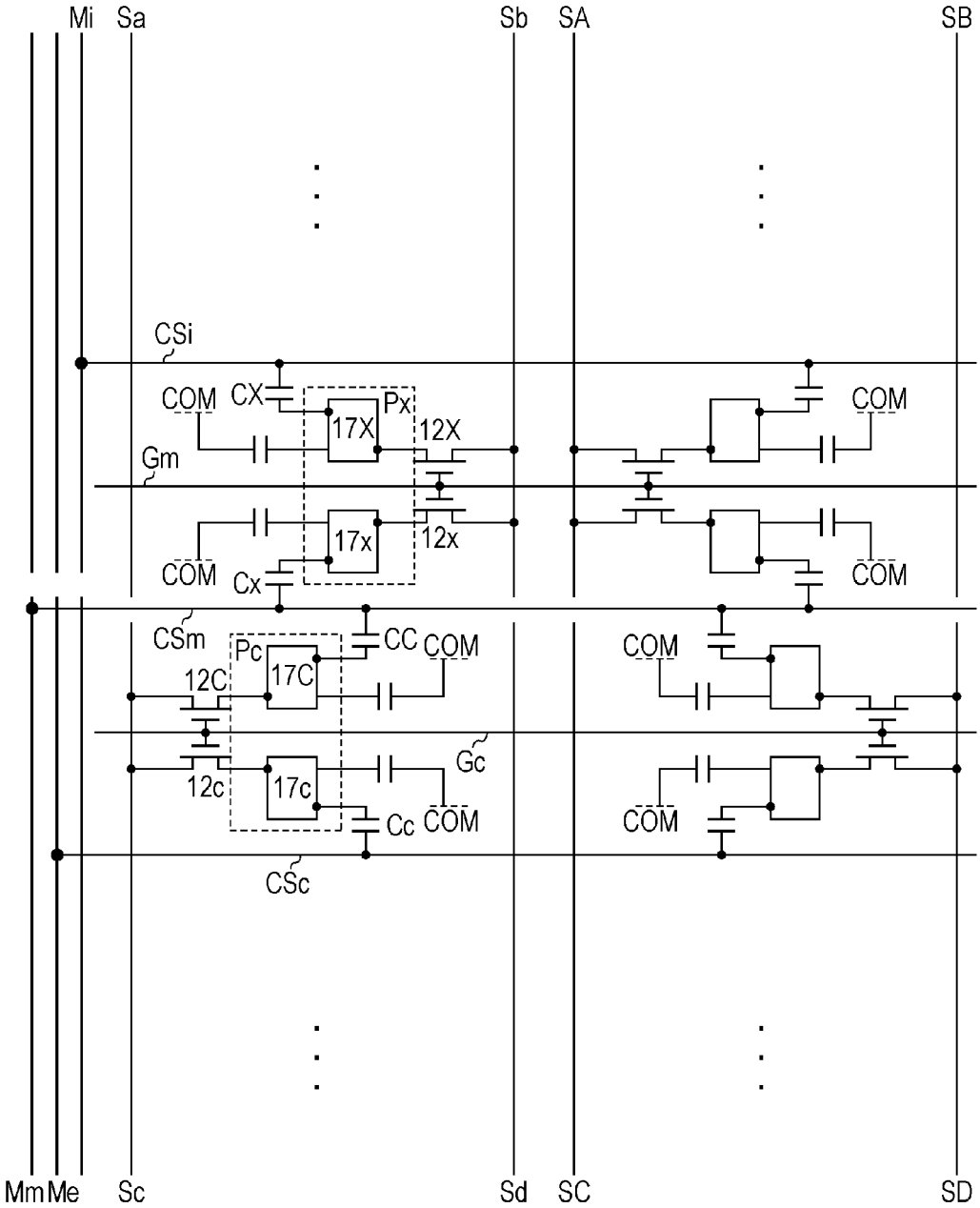
FIG. 19 is an equivalent circuit diagram illustrating a part (scanning termination side) of the liquid crystal panel according to the third embodiment.

A configuration near the boundary between the upper half (first region) and the lower half (second region) is illustrated in FIG. 19. That is, of two pixel electrodes 17*x* and 17*x* included in a pixel Px located in the bottom (scanning termination end portion) of the first region, a transistor 12*x* connected to the pixel electrode 17*x* and a transistor 12*x* connected to the pixel electrode 17*x* are connected to the data signal line Sb and the scanning signal line Gm, respectively, the pixel electrode 17*x* forms a holding capacitance wiring CSi and a holding capacitor CX, the pixel electrode 17*x* forms a holding capacitance wiring CSm and a holding capacitor Cx, and the pixel Pc is located in the top (scanning start end portion) of the second region.

The number of data signal lines installed in the upper half of the panel is at least "7680 (pixels)×3 (primary colors)×2 (double source)=46080," the number of scanning signal lines installed in the upper half of the panel is at least 2160, the number of holding capacitance wirings installed in the upper half of the panel is at least 2160, the number of data signal lines installed in the lower half of the panel is at least 46080, the number of scanning signal lines installed in the lower half of the panel is at least 2160, and the number of holding capacitance wirings installed in the lower half of the panel is at least 2160.

The inter-CS wiring Ma and the inter-CS wiring Mb are installed in proximity to one of two end sides of the upper half of the active matrix substrate and are each driven by the CS driver CD1 so as to have different phases. The inter-CS wiring Mc and the inter-CS wiring Md are installed in proximity to the other of the two end sides of the upper half of the active matrix substrate and are each driven by the CS driver CD2 so as to have different phases. The inter-CS wiring Me and the inter-CS wiring Mf are installed in proximity to one of two end sides of the lower half of the active matrix substrate and are each driven by the CS driver CD3 so as to have different phases. The inter-CS wiring Mg and the inter-CS wiring Mh are installed in proximity to the other of the two end sides of the lower half of the active matrix substrate and are each driven by the CS driver CD4 so as to have different phases. Further, one holding capacitance wiring is connected to two inter-CS wirings disposed on both side thereof and modulation (pulse) signals with the same phases are supplied from the two inter-CS wirings to the one holding capacitance wiring. By doing this, it is possible to suppress a variation (a change in the degree of signal dullness due to a position in the row direction) in dullness of a signal caused due to CR (time constant) of the holding capacitance wiring.

For example, the holding capacitance wiring CSa is connected to the inter-CS wirings Ma and Mc, the holding capacitance wiring CSb is connected to the inter-CS wirings Mb and Md, the holding capacitance wiring CSc is connected to the inter-CS wirings Me and Mg, and the holding capacitance wiring CSd is connected to the inter-CS wirings Mf and Mh. Accordingly, for example, when the potentials of the inter-CS wirings Ma and Mb are controlled so that the phases thereof are opposite, the potentials of the holding capacitance wirings CSa and CSb also have the opposite phases. Of the two pixel electrodes 17B and 17*b* in the pixel Pb, the pixel electrode 17B forms the holding capacitance wiring CSa and the holding capacitor CB and the pixel electrode 17*b* forms the holding capacitance wiring CSb and the holding capacitor Cb. Thus, after the same signal potential is written to the pixel electrodes 17B and 17*b*, for example, the effective potential of the pixel electrode 17B is shifted in a direction in which the effective potential is close to the center potential, while the effective potential of the pixel electrode 17*b* is shifted in a direction in which the effective potential is distant from the center potential (accordingly, a dark region corresponding to the pixel electrode 17B and a bright region corresponding to the pixel electrode 17*b* are formed within one pixel).

The polarity of a data signal supplied to one data signal line is inverted for each vertical scanning period (1 V), and during the same vertical scanning period, the polarities of the data signals supplied to one and the other of two data signal lines installed in correspondence with one pixel column are opposite to each other. By doing this, while each data signal line is 1 V-inverted (that is, a polarity inversion period is lengthened and power consumption is reduced), a polarity distribution of the pixels within the screen is dot-inverted (accordingly, it is possible to suppress flicker caused in a pulling voltage occurring when a transistor is turned OFF).

Figure 18:
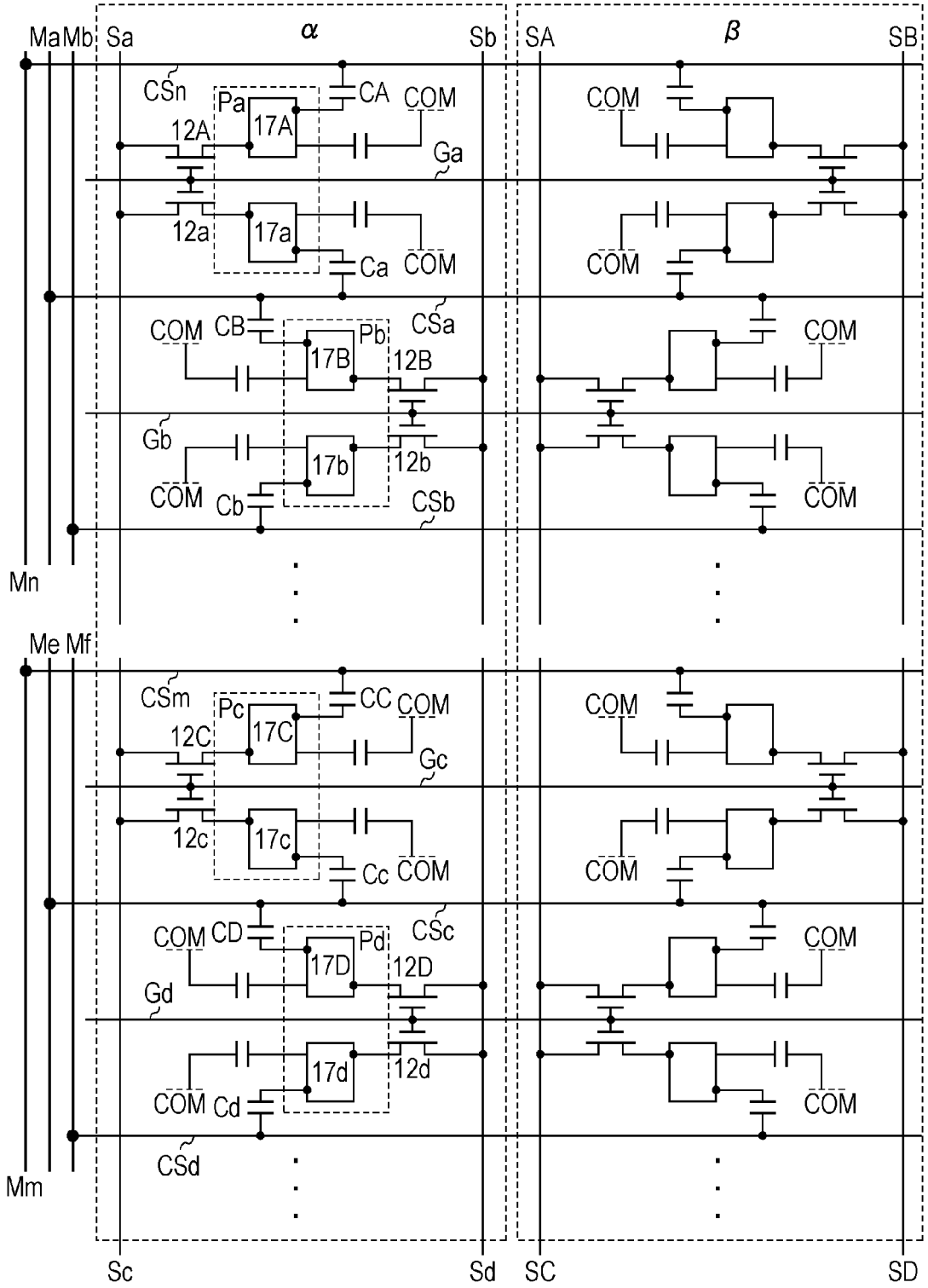
FIG. 18 is an equivalent circuit diagram illustrating a part (scanning start side) of a liquid crystal panel according to the third embodiment.
Figure 20:
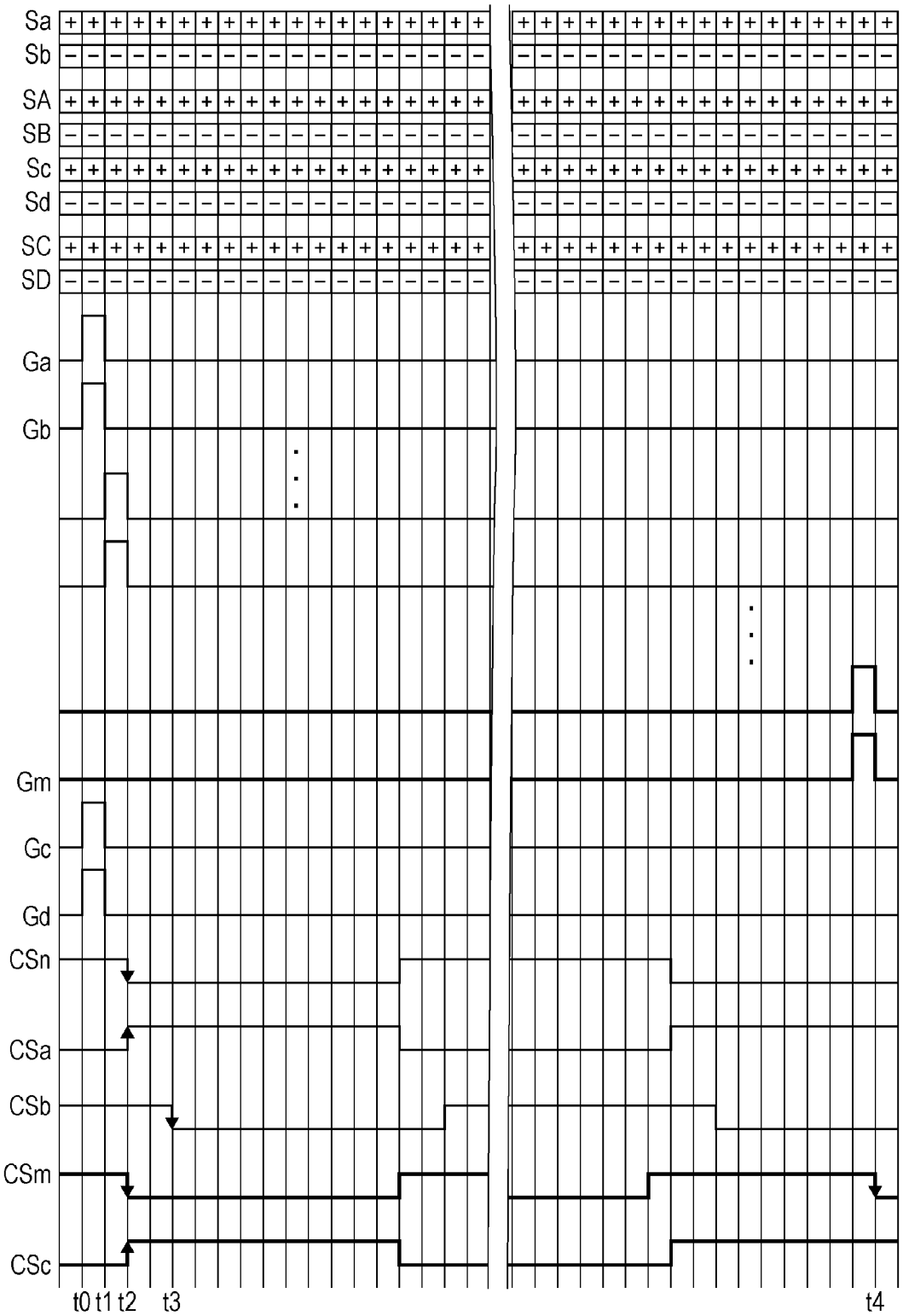
FIG. 20 is a timing chart illustrating a method of driving the liquid crystal display device according to the third embodiment.
Figure 21:
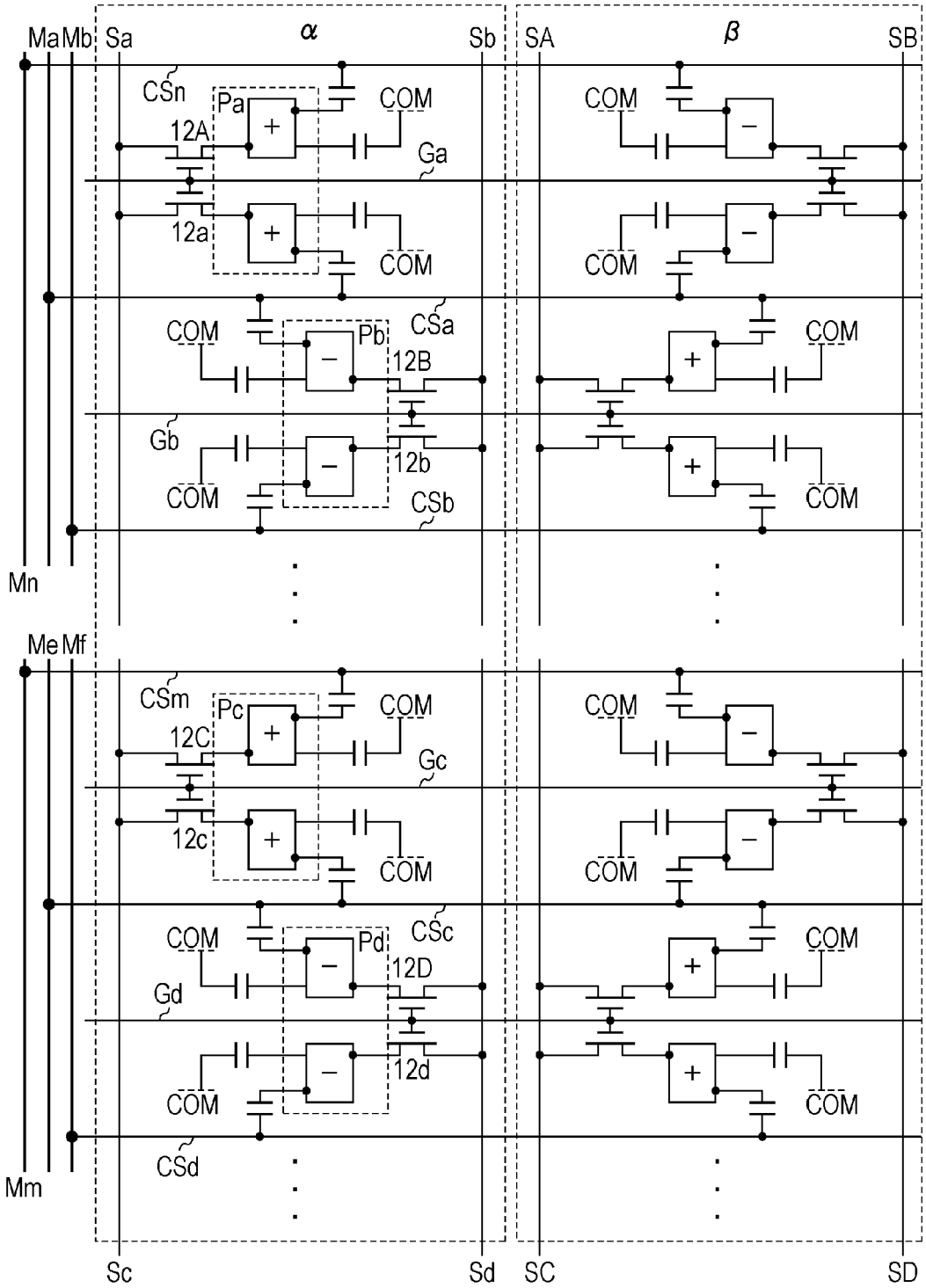
FIG. 21 is a schematic diagram illustrating a display state of the scanning start side when the driving method in FIG. 20 is used.
Figure 22:
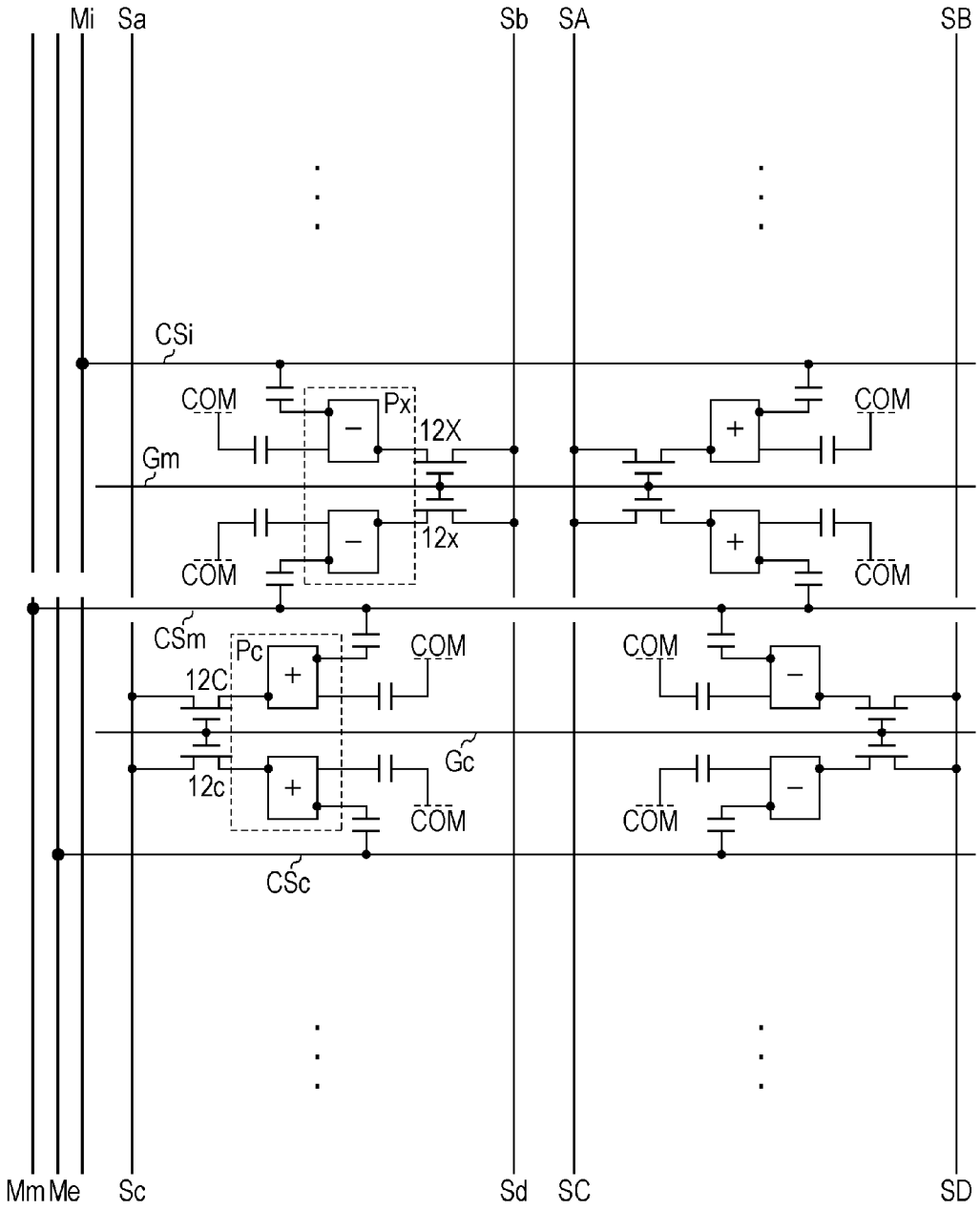
FIG. 22 is a schematic diagram illustrating a display state of the scanning termination side when the driving method in FIG. 20 is used.
Figure 23:
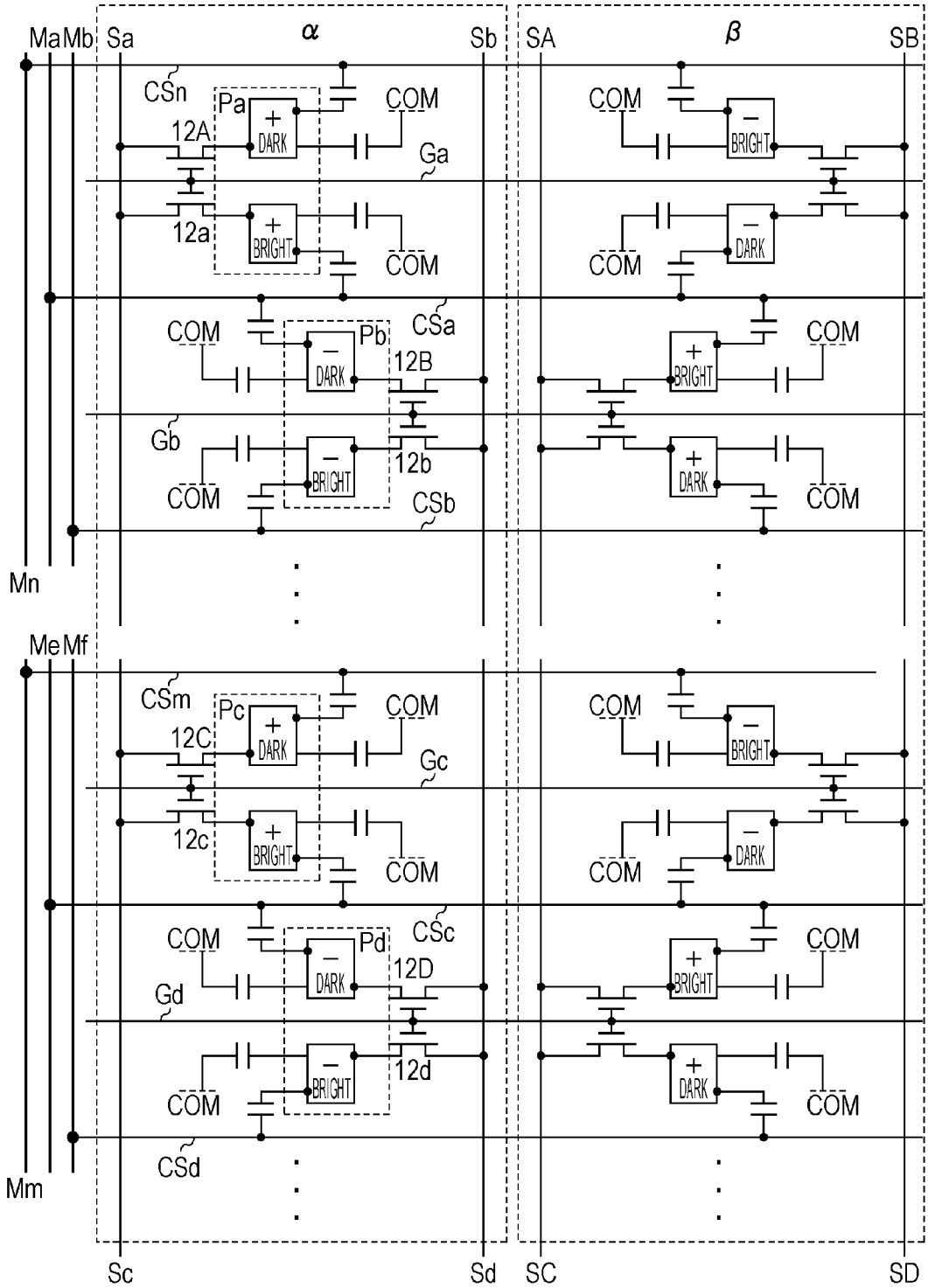
FIG. 23 is a schematic diagram illustrating a display state (bright and dark) of the scanning start side when the driving method in FIG. 20 is used.
Figure 24:
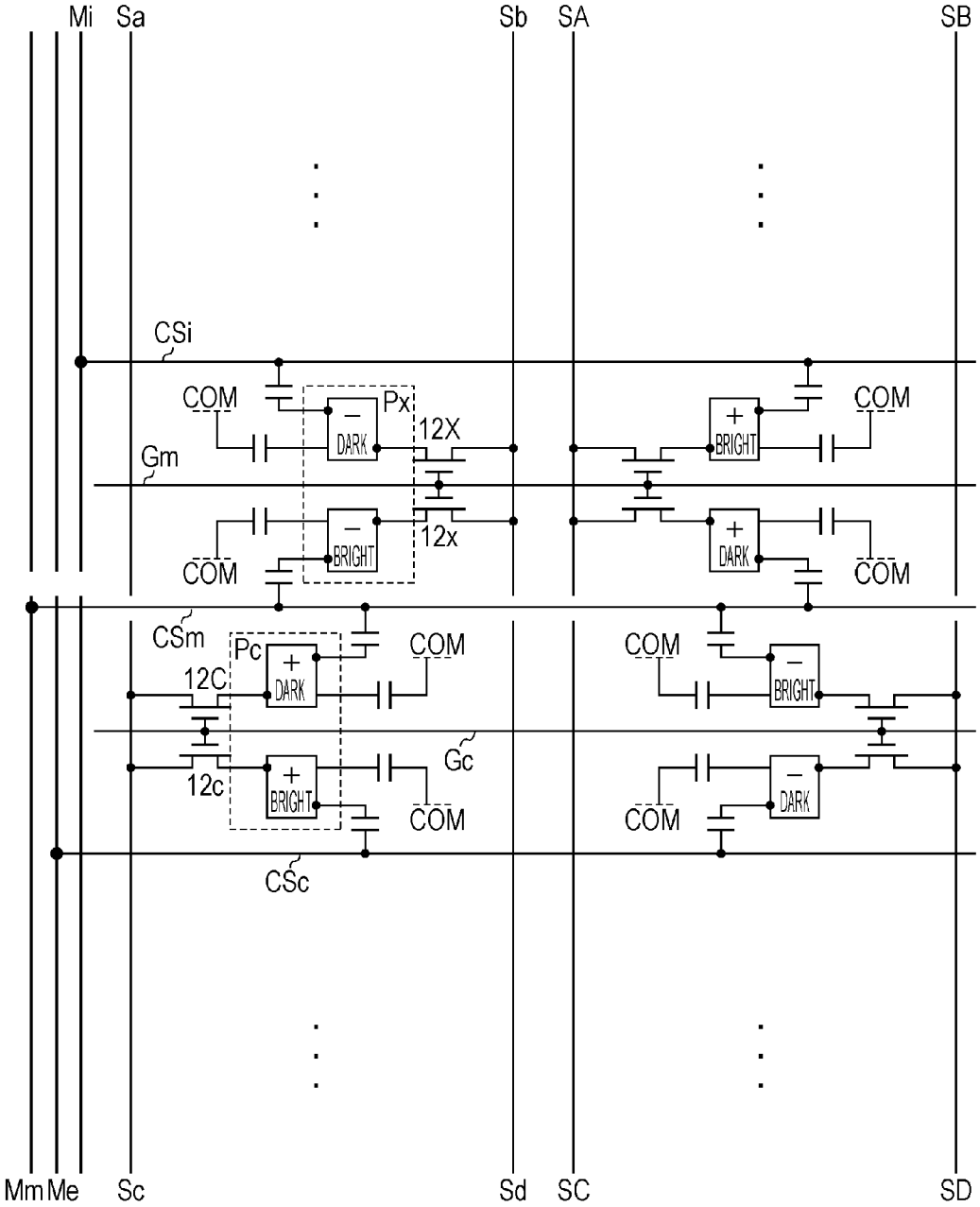
FIG. 24 is a schematic diagram illustrating a display state (bright and dark) of the scanning termination side when the driving method in FIG. 20 is used.
Figure 25:
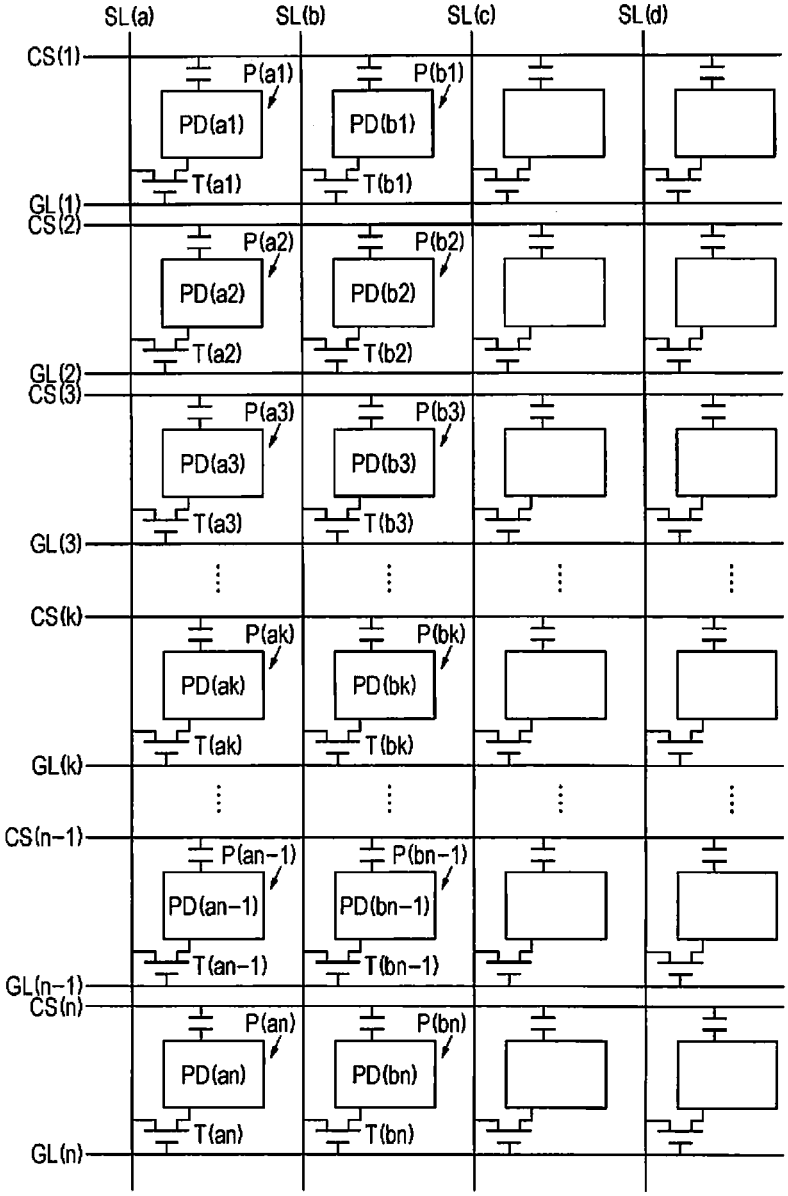
FIG. 25 is an equivalent circuit diagram of an active matrix substrate used in a liquid crystal panel according to the related art.
Figure 26:
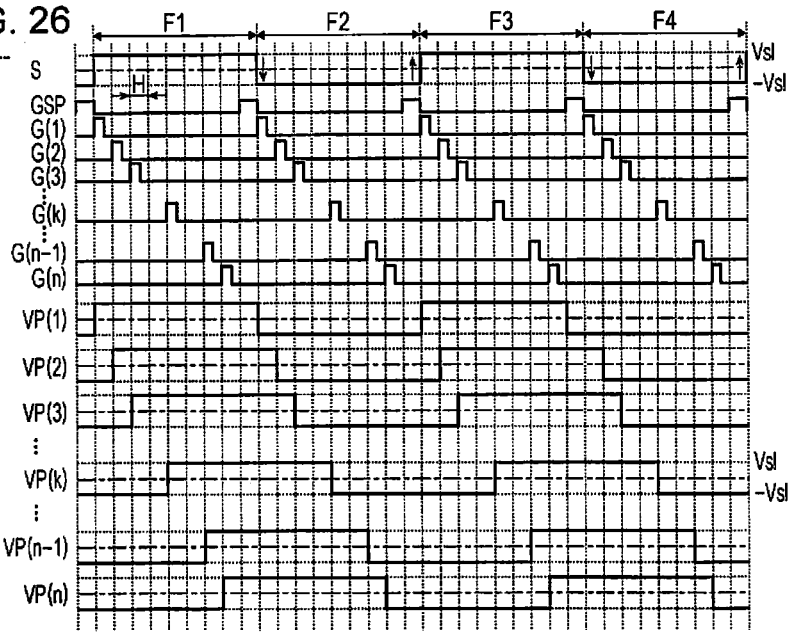
FIG. 26 is a timing chart illustrating an ideal method (normally black mode) of driving a liquid crystal display device when a white solid image is displayed.

A method of driving the portions of the liquid crystal panel illustrated in FIGS. 18 and 19 is illustrated in the timing chart of FIG. 20 and the schematic diagrams of FIGS. 21 and 24. As illustrated in FIG. 20, positive potentials of the data signals are supplied to the data signal lines Sa, SA, Sc, and SC during one vertical scanning period and negative potentials of the data signals are supplied to the data signal lines Sb, SB, Sd, and SD during one vertical scanning period.

Simultaneous scanning of the scanning signal lines Ga and Gb starts at time t0 and simultaneous scanning of the scanning signal lines Ga to Gd ends at a time t1, 1 H (vertical scanning period) after the time t0. Accordingly, the positive potentials of the data signals are written to the pixel electrodes 17A and 17*a*, the positive potentials of the data signals are written to the pixel electrodes 17C and 17*c*, and the negative potentials of the data signals are written to the pixel electrodes 17D and 17*d*.

At a time t2, 1 H after t1, the potential level of the holding capacitance wiring CSn is shifted toward an L (Low) side by a modulation signal transmitted from the inter-CS wiring Mn, the potential of the pixel electrode 17A is accordingly pushed down, the effective potential up to subsequent scanning becomes lower than the potential (+) of the written data signal (a dark region is formed). Further, at the time t2, the potential level of the holding capacitance wiring CSa is shifted toward an H (High) side by modulation signals transmitted from the CS drivers CD1 and CD2 via the inter-CS wirings Ma and Mc, the potential of the pixel electrode 17*a* is accordingly pushed up, and the effective potential up to the subsequent scanning becomes higher than the potential (+) of the written data signal (a bright region is formed). At the time t2, (because the potential level of the holding capacitance wiring CSa is shifted toward the H side), the potential of the pixel electrode 17B is pushed up and the effective potential up to the subsequent scanning becomes higher than the potential (−) of the written data signal (the dark region is formed).

At the time t2, the potential level of the holding capacitance wiring CSm is shifted toward the L (Low) side by a modulation signal transmitted from the inter-CS wiring Mm, the potential of the pixel electrode 17C is accordingly pushed down, the effective potential up to the subsequent scanning becomes lower than the potential (+) of the written data signal (the dark region is formed). Further, at the time t2, the potential level of the holding capacitance wiring CSc is shifted toward the H (High) side by modulation signals transmitted from the CS drivers CD3 and CD4 via the inter-CS wirings Me and Mg, the potential of the pixel electrode 17*c* is accordingly pushed up, and the effective potential up to the subsequent scanning becomes higher than the potential (+) of the written data signal (the bright region is formed).

At a time t3 after 2 H from the time t2, the potential level of the holding capacitance wiring CSb is shifted toward the L (Low) side by modulation signals transmitted from the CS drivers CD1 and CD2 via the inter-CS wirings Mb and Md, the potential of the pixel electrode 17*b* is accordingly pushed down, the effective potential up to subsequent scanning becomes lower than the potential (−) of the written data signal (the bright region is formed).

Then, when the scanning of the pixel Px located in the bottom (scanning termination end portion) of the first region ends at a time t4, the negative potential of the data signal is written to the pixel electrodes 17*x* and 17*x*. At the time t4, since the potential level of the holding capacitance wiring CSm is shifted toward the L (Low) side by the modulation signal transmitted from the inter-CS wiring Mm, the potential of the pixel electrode 17*x* is pushed down and the effective potential up to subsequent scanning becomes lower than the potential (−) of the written data signal (a bright region is formed).

Here, as a gray-scale correction process according to a pixel position (a position in the column direction), the corrected data signals S1' and S2' described in the foregoing second embodiment are supplied to each pixel electrode. Accordingly, it is possible to suppress a change in luminance occurring in the boundary portion between the first and second regions in the liquid crystal display device 10*c*.

When it is assumed that the scanning signal line Ga is an M-th line counted from the upper longer side of the panel and the scanning signal line Gb is an M+1-th line, the scanning signal line Gc is an M+2160-th line counted from the upper long side and the scanning signal line Gd is an M+2161-th line. When the data signal of the M-th line of an N-th frame is written to the scanning signal line Ga installed in the upper half of the panel, the data signal of the M+2160-th line of an N−1-th frame which is an immediately previous frame is written to the scanning signal line Gc installed in the lower half of the panel. By doing this, the sense of display deviation between the upper and lower portions of the panel is suppressed.

The gate driver GD1 includes a plurality of gate driver chips I that are installed along one of two shorter sides of the upper half of the liquid crystal panel 3*c* and are arranged in the column direction. The gate driver GD2 includes a plurality of gate driver chips I that are installed along the other of two shorter sides of the upper half of the liquid crystal panel 3*c* and are arranged in the column direction. The gate driver GD3 includes a plurality of gate driver chips I that are installed along one of two shorter sides of the lower half of the liquid crystal panel 3*c* and are arranged in the column direction. The vertical driver GD4 includes a plurality of gate driver chips I that are installed along the other of two shorter sides of the lower half of the liquid crystal panel 3*c* and are arranged in the column direction. The respective scanning signal lines installed in the upper half of the panel are driven by the gate drivers GD1 and GD2 and the respective scanning signal lines installed in the lower half of the panel are driven by the gate drivers GD3 and GD4. That is, one scanning signal line is connected to two gate drivers disposed on both side thereof and the scanning (pulse) signals with the same phase are supplied from the two gate drivers to the one scanning signal line. By doing this, it is possible to suppress a variation (a change in the degree of signal dullness due to a position in the row direction) in dullness of a signal caused due to CR (time constant) of the scanning signal line.

The source driver SD1 includes 48 source driver chips J (the number of output terminals of one source driver chip is 960) which are installed along one longer side of the upper half of the liquid crystal panel 3*c* and are arranged in the row direction and 4 source driver substrates (not illustrated) (12 source driver chips J are mounted on one source driver substrate). On the other hand, the source driver SD2 includes 48 source driver chips J (the number of output terminals of one source driver chip is 960) which are installed along one longer side of the lower half of the liquid crystal panel 3*c* and are arranged in the row direction and 4 source driver substrates (not illustrated) (12 source driver chips J are mounted on one source driver substrate). The respective data signal lines installed in the upper half of the panel are driven by the source driver SD1 and the respective data signal lines installed in the lower half of the panel are driven by the source driver SD2. For example, the data signal line Sa is driven by the source driver SD1 and the data signal line Sc is driven by the source driver SD2. When the source driver chips J may not be arranged along the longer side of the panel due to a space, the source driver chips may also be arranged on a shorter side of the panel in which there is a room for a space (the source driver chips J and the gate driver chips I are arranged in the column direction). In this case, relay lines connecting the data signal lines to the source terminals of the shorter side of the panel may be provided on the side of the counter substrate or may be provided in portions other than source layers (layers in which source and drain electrodes of the transistors are formed) of the active matrix substrate, that is, in lower layers (gate layers) of the gate insulation films or layers between the source layers and ITO layers (layers in which the pixel electrodes are formed).

The backlight controller BLC receives a video signal QBL output from the pixel mapping circuit PMC and outputs a backlight control signal to the backlight driver BD, and then the backlight BL is driven by the backlight driver BD. Further, the backlight BL is divided into a plurality of portions and the luminance of each portion is individually adjusted according to the video signal QBL (active backlight).

The power controller monitors a supply power level of a commercial power supply connected to each of three power circuits. When abnormality (a decrease in the supply power level) occurs in one commercial power supply or a plurality of commercial power supplies due to any cause, power lines (for example, 3 systems for R, B, and G) to the backlight BL and power lines (for example, 1 system) to the display control substrates DC1 to DC4 are connected to one normal commercial power supply or a plurality of normal commercial power supplies, and an abnormality occurrence signal is output to the backlight controller BLC. The backlight controller BLC receiving the abnormality occurrence signal outputs a control signal configured to lower the upper limit of the luminance of the backlight BL to the backlight driver BD. Accordingly, it is possible to avoid the breakdown or the like of the display control substrates DC1 to DC4 caused due to unexpected abnormality in the commercial power supply.

When the three power circuits are not necessary due to power saving or the like of the liquid crystal display device and only one power circuit connected to a commercial power supply can be configured to be installed, the power controller monitors the supply power level of the one commercial power supply. When abnormality (a decrease in the supply power level) occurs in the commercial power supply due to any cause, the power controller can output an abnormality occurrence signal to the backlight controller BLC (the backlight controller BLC receiving the abnormality occurrence signal can output a control signal configured to decrease the upper limit of the luminance of the backlight BL to the backlight driver BD).

The liquid crystal display device according to an embodiment of the present invention may be configured such that at least in the first region, the potential of the data signal supplied to each data signal line is corrected so that display luminance of a scanning termination end portion of the first region is substantially the same as display luminance of a scanning start end portion of the second region.

The liquid crystal display device according to an embodiment of the present invention may be configured such that at least in the first region, the potential of the data signal supplied to each data signal line is corrected so that a correction amount of the potential of the data signal continuously increases from a frame start time point to a frame end time point in each frame.

The liquid crystal display device according to an embodiment of the present invention may be configured such that the potential of the data signal is not corrected in the scanning start end portions of the first and second regions.

The liquid crystal display device according to an embodiment of the present invention may be configured such that when n (where n is an integer equal to or greater than 1) scanning signal lines are installed in the first region and Vsl is assumed to be the potential of the data signal corresponding to a video signal input from an outside, a corrected potential Vsl'(k) (where k is an integer equal to or greater than 1 or equal to and less than n) of the data signal supplied to each data signal line of the first region for a k-th horizontal scanning period is expressed as in $$Vsl'(k)=Vsl+\Delta Vp\times(k-1)/n, \quad \text{(i)}$$

when a potential of a pixel electrode is decreased by ΔVp by polarity inversion of the data signal, and $$Vsl'(k)=Vsl-\Delta Vph\times(k-1)/n, \quad \text{(ii)}$$

when the potential of the pixel electrode is increased by ΔVph by the polarity inversion of the data signal.

The liquid crystal display device according to an embodiment of the present invention may be configured such that the data signals with polarities opposite to each other are supplied to two adjacent data signal lines for the same horizontal scanning period.

The liquid crystal display device according to an embodiment of the present invention may be configured such that each of first and second pixel columns adjacent to each other includes the plurality of pixels, and two data signal lines of the first region and two data signal lines of the second region are installed in correspondence with each of the first and second pixel columns; each pixel includes one or more pixel electrodes; m (where m is an integer equal to or greater than 1) scanning signal lines are simultaneously selected; in the first and second pixel columns, the data signal line to which one pixel electrode included in one of two consecutive pixels is connected via a transistor differs from the data signal line to which one pixel electrode included in the other of the two consecutive pixels is connected via a transistor; and the transistor via which the one pixel electrode included in the one of the two consecutive pixels is connected and the transistor via which the other pixel electrode included in the other of the two consecutive pixels is connected are each connected to the simultaneously selected m scanning signal lines.

The liquid crystal display device according to an embodiment of the present invention may be configured such that when n (where n is an integer equal to or greater than 1) scanning signal lines are installed in the first region and Vsl is assumed to be the potential of the data signal corresponding to a video signal input from an outside, a corrected potential Vsl'(k) (where k is an even number equal to or greater than 2 or equal to and less than n) of the data signal supplied to each data signal line of the first region for a k/2-th horizontal scanning period is expressed as in $$Vsl'(k)=Vsl+\Delta Vp\times(k/2-1)\times 2/n, \quad \text{(i)}$$

when a potential of a pixel electrode is decreased by ΔVp by polarity inversion of the data signal, and $$Vsl'(k)=Vsl-\Delta Vph\times(k/2-1)\times 2/n, \quad \text{(ii)}$$

when the potential of the pixel electrode is increased by ΔVph by the polarity inversion of the data signal.

The liquid crystal display device according to an embodiment of the present invention may be configured such that the potential of the data signal is corrected based on a potential amount obtained by adding a potential amount decreased by inverting the polarity of the data signal supplied to one data signal line between two data signal lines corresponding to one pixel column and a potential amount decreased by inverting the polarity of the data signal supplied to the other data signal line.

The liquid crystal display device according to an embodiment of the present invention may be configured such that in the first and second regions, the data signals with the polarities opposite to each other are supplied to two data signal lines corresponding to one pixel column for the same horizontal scanning period.

The liquid crystal display device according to an embodiment of the present invention may be configured such that a plurality of pixel electrodes installed in one pixel are each connected to the same scanning signal line and form capacitance with different holding capacitance wirings, and a holding capacitance wiring signal in which a potential level is shifted periodically is supplied to each holding capacitance wiring.

The liquid crystal display device according to an embodiment of the present invention may be configured such that the plurality of pixel electrodes installed on one pixel are each connected to the same data signal line.

A television receiver of the invention includes any one of the liquid crystal display devices described above and a tuner unit that receives a television broadcast.

The present invention is not limited to the respective embodiments described above, but may be modified in various ways within the scope of the claims. Embodiments obtained by appropriately combining technical means disclosed in the different embodiments are included in the technical scope of the present invention.

INDUSTRIAL APPLICABILITY

The present invention is suitable for, for example, a liquid crystal television.

REFERENCE SIGNS LIST

10*a*, 10*b*, 10*c* liquid crystal display device (display device)
3*a*, 3*b*, 3*c* liquid crystal panel (display unit)
50*a*, 50*b* television receiver
20*x* first display control circuit
20*y* second display control circuit
SDx first source driver
SDy second source driver
GDx first gate driver
GDy second gate driver
30*x* first Cs control circuit
30*y* second Cs control circuit
40 tuner
SLx, SLy data signal line
GLx, GLy scanning signal line
CSx, CSy holding capacitance wiring
Px, Py pixel
PDx, PDy pixel electrode
Tx, Ty transistor
α, β pixel column
21*x*, 21*y* data correction circuit
211*x* video data input unit
212*x* average voltage calculation unit
213*x* first LUT
214*x* maximum correction value calculation unit
215*x* second LUT
216*x* correction position counter unit
217*x* position correction unit
218*x* video data output unit
EP1 to EP4 video processing circuit (data correction circuit)
EP5 to EP8 video processing circuit (data correction circuit)

The invention claimed is:

1. A liquid crystal display device in which data signal lines, scanning signal lines, and pixels are formed in each of first and second regions installed in a display unit and in which a part of a current frame is written to the first region and the remainder of the current frame is written to the second region, wherein a data signal with polarity inverted for each vertical scanning period or every plurality of vertical scanning periods is supplied to each data signal line, a scanning direction in the first region is identical to a scanning direction in the second region and the first and second regions are arranged to line up in this order in the scanning direction, and at least in the first region, a potential of the data signal supplied to each data signal line is corrected according to a distance from a pixel corresponding to the scanning signal line scanned in the first horizontal scanning period, when n (where n is an integer equal to or greater than 1) scanning signal lines are installed in the first region and Vsl is assumed to be the potential of the data signal corresponding to a video signal input from an outside, a corrected potential Vsl'(k) (where k is an integer equal to or greater than 1 or equal to and less than n) of the data signal supplied to each data signal line of the first region for a k-th horizontal scanning period is expressed as in:

(i) $Vsl'(k)=Vsl+\Delta Vp\times(k-1)/n$, when a potential of a pixel electrode supplied with the data signal in the k-th horizontal scanning period is decreased by ΔVp by polarity inversion of the data signal, and (ii) $Vsl'(k)=Vsl-\Delta Vph\times(k-1)/n$, when the potential of the pixel electrode supplied with the data signal in the k-th horizontal scanning period is increased by ΔVph by the polarity inversion of the data signal.

2. The liquid crystal display device according to claim 1, wherein at least in the first region; the potential of the data signal supplied to each data signal line is corrected so that display luminance of a scanning termination end portion of the first region is a same luminance as display luminance of a pixel corresponding to the scanning signal line scanned in the first horizontal scanning period of the second region.

3. The liquid crystal display device according to claim 1, wherein at least in the first region, the potential of the data signal supplied to each data signal line is corrected so that a correction amount of the potential of the data signal continuously increases from a frame start time point to a frame end time point in each frame.

4. The liquid crystal display device according to claim 1, wherein the potential of the data signal is not corrected in the pixel corresponding to the scanning signal line scanned in the first horizontal scanning period of the first and second regions.

5. The liquid crystal display device according to claim 1, wherein the data signals with polarities opposite to each other are supplied to two adjacent data signal lines for a same horizontal scanning period.

6. The liquid crystal display device according to claim 1, wherein a plurality of pixel electrodes installed in one pixel are each connected to the same scanning signal line and form capacitance with different holding capacitance wirings, and a holding capacitance wiring signal in which a potential level is shifted periodically is supplied to each holding capacitance wiring.

7. The liquid crystal display device according to claim 6, wherein the plurality of pixel electrodes installed on one pixel are each connected to the same data signal line.

8. A television receiver comprising:

the liquid crystal display device according to claim 1; and a tuner unit that receives a television broadcast.

9. A liquid crystal display device in which data signal lines, scanning signal lines, and pixels are formed in each of first and second regions installed in a display unit and in which a part of a current frame is written to the first region and the remainder of the current frame is written to the second region, wherein a data signal with polarity inverted for each vertical scanning period or every plurality of vertical scanning periods is supplied to each data signal line, a scanning direction in the first region is identical to a scanning direction in the second region and the first and second regions are arranged to line up in this order in the scanning direction, at least in the first region, a potential of the data signal supplied to each data signal line is corrected according to a distance from a pixel corresponding to the scanning signal line scanned in the first horizontal scanning period, each of first and second pixel columns adjacent to each other includes the plurality of pixels, and two data signal lines of the first region and two data signal lines of the second region are installed in correspondence with each of the first and second pixel columns, each pixel includes one or more pixel electrodes, m (where m is an integer equal to or greater than 1) scanning signal lines are simultaneously selected, in the first and second pixel columns, the data signal line to which one pixel electrode included in one of two consecutive pixels is connected via a transistor differs from the data signal line to which one pixel electrode included in the other of the two consecutive pixels is connected via a transistor, the transistor via which the one pixel electrode included in the one of the two consecutive pixels is connected and the transistor via which the other pixel electrode included in the other of the two consecutive pixels is connected are each connected to the simultaneously selected m scanning signal lines, and when n (where n is an integer equal to or greater than 1) scanning signal lines are installed in the first region and Vsl is assumed to be the potential of the data signal corresponding to a video signal input from an outside, a corrected potential Vsl'(k) (where k is an even number equal to or greater than 2 or equal to and less than n) of the data signal supplied to each data signal line of the first region for a k/2-th horizontal scanning period is expressed as in:

(i) $Vsl'(k)=Vsl+\Delta Vp\times(k/2-1)\times 2/n$, when a potential of a pixel electrode supplied with the data signal in the (k/2)-th horizontal scanning period is decreased by $\Delta Vp$ by polarity inversion of the data signal, and (ii) $Vsl'(k)=Vsl-\Delta Vph\times(k/2-1)\times 2/n$, when the potential of the pixel electrode supplied with the data signal in the (k/2)-th horizontal scanning period is increased by $\Delta Vph$ by the polarity inversion of the data signal.

10. The liquid crystal display device according to claim 9, wherein in the first and second regions, the data signals with the polarities opposite to each other are supplied to two data signal lines corresponding to one pixel column for a same horizontal scanning period.

11. A liquid crystal display device in which data signal lines, scanning signal lines, and pixels are formed in each of first and second regions installed in a display unit and in which a part of a current frame is written to the first region and the remainder of the current frame is written to the second region wherein a data signal with polarity inverted for each vertical scanning period or every plurality of vertical scanning periods is supplied to each data signal line, a scanning direction in the first region is identical to a scanning direction in the second region and the first and second regions are arranged to line up in this order in the scanning direction, at least in the first region, a potential of the data signal supplied to each data signal line is corrected according to a distance from a pixel corresponding to the scanning signal line scanned in the first horizontal scanning period, each of first and second pixel columns adjacent to each other includes the plurality of pixels, and two data signal lines of the first region and two data signal lines of the second region are installed in correspondence with each of the first and second pixel columns, each pixel includes one or more pixel electrodes, m (where m is an integer equal to or greater than 1) scanning signal lines are simultaneously selected, in the first and second pixel columns, the data signal line to which one pixel electrode included in one of two consecutive pixels is connected via a transistor differs from the data signal line to which one pixel electrode included in the other of the two consecutive pixels is connected via a transistor, the transistor via which the one pixel electrode included in the one of the two consecutive pixels is connected and the transistor via which the other pixel electrode included in the other of the two consecutive pixels is connected are each connected to the simultaneously selected m scanning signal lines, and the potential of the data signal is corrected based on a potential amount obtained by adding a potential amount decreased by inverting the polarity of the data signal supplied to one data signal line between two data signal lines corresponding to one pixel column and a potential amount decreased by inverting the polarity of the data signal supplied to the other data signal line.

12. The liquid crystal display device according to claim 11, wherein in the first and second regions, the data signals with the polarities opposite to each other are supplied to two data signal lines corresponding to one pixel column for the same horizontal scanning period.

* * * * *